US008618401B2

(12) United States Patent
Kobayashi

(10) Patent No.: US 8,618,401 B2
(45) Date of Patent: Dec. 31, 2013

(54) INFORMATION PROCESSING APPARATUS, MELODY LINE EXTRACTION METHOD, BASS LINE EXTRACTION METHOD, AND PROGRAM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 1055 days.

(21) Appl. No.: 12/630,451

(22) Filed: Dec. 3, 2009

(65) Prior Publication Data

US 2010/0246842 A1 Sep. 30, 2010

(30) Foreign Application Priority Data

Dec. 5, 2008 (JP) ..... P2008-311566

(51) Int. Cl.
*G10H 3/00* (2006.01)

(52) U.S. Cl.
USPC ..... 84/609; 84/613; 84/649; 84/650

(58) Field of Classification Search
USPC ..... 84/609, 613, 649, 650
See application file for complete search history.

(56) References Cited

U.S. PATENT DOCUMENTS

| | | | | |
|---|---|---|---|---|
| 6,226,606 | B1 * | 5/2001 | Acero et al. | 704/218 |
| 7,488,886 | B2 * | 2/2009 | Kemp | 84/609 |
| 8,168,877 | B1 * | 5/2012 | Rutledge et al. | 84/613 |
| 2007/0131094 | A1 * | 6/2007 | Kemp | 84/609 |
| 2009/0193959 | A1 * | 8/2009 | Mestres et al. | 84/609 |
| 2010/0170382 | A1 * | 7/2010 | Kobayashi | 84/613 |
| 2010/0192755 | A1 * | 8/2010 | Morris et al. | 84/637 |
| 2010/0211200 | A1 * | 8/2010 | Kobayashi | 700/94 |
| 2010/0246842 | A1 * | 9/2010 | Kobayashi | 381/61 |
| 2011/0209596 | A1 * | 9/2011 | Mestres et al. | 84/609 |
| 2012/0125179 | A1 * | 5/2012 | Kobayashi | 84/611 |
| 2012/0297958 | A1 * | 11/2012 | Rassool et al. | 84/609 |
| 2012/0297959 | A1 * | 11/2012 | Serletic et al. | 84/626 |

FOREIGN PATENT DOCUMENTS

| | | |
|---|---|---|
| JP | 2008-58755 | 3/2008 |
| JP | 2008-123011 | 5/2008 |
| JP | 2008-209579 | 9/2008 |

* cited by examiner

*Primary Examiner* — David S. Warren
(74) *Attorney, Agent, or Firm* — Finnegan Henderson Farabow Garrett & Dunner LLP

(57) ABSTRACT

An information processing apparatus is provided which includes a signal conversion unit for converting an audio signal to a pitch signal indicating a signal intensity of each pitch, a melody probability estimation unit for estimating for each frame a probability of each pitch being a melody note, based on the audio signal, and a melody line determination unit for detecting a maximum likelihood path from among paths of pitches from a start frame to an end frame of the audio signal, and for determining the maximum likelihood path as a melody line, based on the probability of each pitch being a melody note, the probability being estimated for each frame by the melody probability estimation unit.

12 Claims, 55 Drawing Sheets

FIG.6

TABLE 1: EXAMPLE OF MUSIC CATEGORY

| CATEGORY | FEATURE |
|---|---|
| OLD PIECE | POOR SOUND QUALITY.<br>PROPORTION OF VOLUME IN BACKGROUND IS SMALL. |
| MALE VOCAL<br>LOUD BACKGROUND | MALE VOCAL.<br>NOISY BACKGROUND PERFORMANCE. |
| MALE VOCAL<br>SOFT BACKGROUND | MALE VOCAL.<br>VOICE STANDING OUT FROM BACKGROUND PERFORMANCE. |
| FEMALE VOCAL<br>LOUD BACKGROUND | FEMALE VOCAL.<br>NOISY BACKGROUND PERFORMANCE. |
| ... | ... |

- INPUT DATA:
  PARTIAL LOG SPECTRUM WITH SPECIFIC WINDOW WIDTH
- TEACHER DATA: BEAT PROBABILITY
  (1: BEAT, 0: NOT BEAT)
- LEARNING RESULT:
  BEAT PROBABILITY FORMULA $$\text{BEAT SCORE } BS(k,d) = \sum_{n} P(F_{k+nd}),\ \{F_{k+nd} \in F\}$$

NUMBER OF SUPPLEMENTARY BEATS $B_{fill} = Round\left(\frac{F_{h+1} - F_h}{d_h}\right) - 1$

- INPUT DATA:
  LOG SPECTRA OF A PLURALITY OF MUSIC PIECES
- TEACHER DATA:
  TEMPO DECIDED TO BE CORRECT BY HUMAN BEING LISTENING TO EACH MUSIC PIECE
- LEARNING RESULT:
  ESTIMATED TEMPO DISCRIMINATION FORMULA

FIG.42

- INDEPENDENT VARIABLE:
  ROOT FQ FOR EACH OF A PLURALITY OF BEAT SECTIONS WHOSE CORRECT CHORDS ARE KNOWN

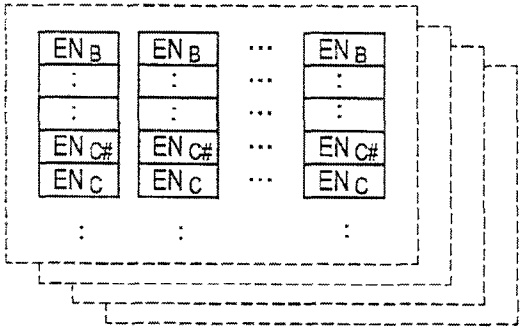

- DUMMY DATA (TEACHER DATA):
  - WHEN LEARNING FOR MAJOR CHORD ··· 1 WHEN MAJOR CHORD, OTHERWISE 0
  - WHEN LEARNING FOR MINOR CHORD ··· 1 WHEN MINOR CHORD, OTHERWISE 0
  - WHEN LEARNING FOR 7th CHORD ··· 1 WHEN 7th CHORD, OTHERWISE 0
  - WHEN LEARNING FOR 9th CHORD ··· 1 WHEN 9th CHORD, OTHERWISE 0

⇩

LOGISTIC REGRESSION ANALYSIS

⇩

- CHORD PROBABILITY FORMULA
  - MAJOR CHORD → CP major (x1, x2, ...) = ...
  - MINOR CHORD → CP minor (x1, x2, ...) = ...
  - 7th CHORD → CP seven (x1, x2, ...) = ...
  - 9th CHORD → CP nine (x1, x2, ...) = ...

FIG.53

KEY TRANSITION PROBABILITY (Maj → Maj) Pr (Δk)

| KEY TYPE | MODULATION AMOUNT | PROBABILITY VALUE |
|---|---|---|
| Maj → Maj | +5 (-7) | 0.0001 |
| Maj → Maj | +4 (-8) | 0.0001 |
| Maj → Maj | +3 (-9) | 0.0001 |
| Maj → Maj | +2 (-10) | 0.0001 |
| Maj → Maj | +1 (-11) | 0.0002 |
| Maj → Maj | 0 | 0.9987 |

| KEY TYPE | MODULATION AMOUNT | PROBABILITY VALUE |
|---|---|---|
| Maj → Maj | +11 (-1) | 0.0000 |
| Maj → Maj | +10 (-2) | 0.0001 |
| Maj → Maj | +9 (-3) | 0.0001 |
| Maj → Maj | +8 (-4) | 0.0001 |
| Maj → Maj | +7 (-5) | 0.0001 |
| Maj → Maj | +6 (-6) | 0.0000 |

KEY TRANSITION PROBABILITY (Maj → m)

:

KEY TRANSITION PROBABILITY (m → Maj)

:

KEY TRANSITION PROBABILITY (m → m)

:

INFORMATION PROCESSING APPARATUS, MELODY LINE EXTRACTION METHOD, BASS LINE EXTRACTION METHOD, AND PROGRAM

BACKGROUND OF THE INVENTION

1. Field of the Invention

The present invention relates to an information processing apparatus, a melody line extraction method, a bass line extraction method, and a program.

2. Description of the Related Art

Recently, attention is being paid to a technology for extracting, from arbitrary music data, feature quantity (also referred to as "FQ") unique to the music data. The unique feature quantity, which is the subject here, includes the cheerfulness of the music piece, the beat, the melody part, the bass part, the chord progression, or the like, for example. However, it is extremely difficult to directly extract the feature quantity from the music data. With regard to a technology for extracting the melody part and the bass part from music data, JP-A-2008-209579 and JP-A-2008-58755 disclose technologies for estimating the pitch of a melody part or a bass part from an acoustic signal simultaneously including voice and sounds of a plurality of types of instruments. Particularly, the technologies disclosed in the documents are for estimating the pitch of a melody part or a bass part by using an expectation-maximization (EM) algorithm.

SUMMARY OF THE INVENTION

However, even if the technologies disclosed in JP-A-2008-209579 and JP-A-2008-58755 are used, it is extremely difficult to accurately extract a melody line and a bass line from music data. Thus, in light of the foregoing, it is desirable to provide novel and improved information processing apparatus, melody line/bass line extraction methods, and program that are capable of accurately extracting a melody line or a bass line from music data.

According to an embodiment of the present invention, there is provided an information processing apparatus including a signal conversion unit for converting an audio signal to a pitch signal indicating a signal intensity of each pitch, a melody probability estimation unit for estimating for each frame a probability of each pitch being a melody note, based on the audio signal, and a melody line determination unit for detecting a maximum likelihood path from among paths of pitches from a start frame to an end frame of the audio signal, and for determining the maximum likelihood path as a melody line, based on the probability of each pitch being a melody note, the probability being estimated for each frame by the melody probability estimation unit.

Furthermore, the information processing apparatus may further include a centre extraction unit for extracting, in a case the audio signal is a stereo signal, a centre signal from the stereo signal. In this case, the signal conversion unit converts the centre signal extracted by the centre extraction unit to the pitch signal.

Furthermore, the information processing apparatus may further include a signal classification unit for classifying the audio signal into a specific category. In this case, the melody probability estimation unit estimates the probability of each pitch being a melody note, based on a classification result of the signal classification unit. Also, the melody line determination unit detects the maximum likelihood path based on the classification result of the signal classification unit.

Furthermore, the information processing apparatus may further include a pitch distribution estimation unit for estimating for the pitch signal, for each of specific periods, a distribution of pitches which are melody notes. In this case, the melody line determination unit detects the maximum likelihood path based on estimation results of the pitch distribution estimation unit.

Furthermore, the information processing apparatus may further include a smoothing unit for smoothing, for each beat section, a pitch of the melody line determined by the melody line determination unit.

Furthermore, the melody probability estimation unit may generate a calculation formula for extracting the probability of each pitch being a melody note by supplying a plurality of audio signals whose melody lines are known and the melody lines to a calculation formula generation apparatus capable of automatically generating a calculation formula for extracting feature quantity of an arbitrary audio signal, and estimate for each frame the probability of each pitch being a melody note by using the calculation formula, the calculation formula generation apparatus automatically generating the calculation formula by using a plurality of audio signals and the feature quantity of each of the audio signals.

Furthermore, the information processing apparatus may further include a beat detection unit for detecting each beat section of the audio signal, a chord probability detection unit for detecting, for each beat section detected by the beat detection unit, a probability of each chord being played, and a key detection unit for detecting a key of the audio signal by using the probability of each chord being played detected for each beat section by the chord probability detection unit. In this case, the melody line determination unit detects the maximum likelihood path based on the key detected by the key detection unit.

According to another embodiment of the present invention, there is provided an information processing apparatus including a signal conversion unit for converting an audio signal to a pitch signal indicating a signal intensity of each pitch, a bass probability estimation unit for estimating for each frame a probability of each pitch being a bass note, based on the audio signal, and a bass line determination unit for detecting a maximum likelihood path from among paths of pitches from a start frame to an end frame of the audio signal, and for determining the maximum likelihood path as a bass line, based on the probability of each pitch being a bass note, the probability being estimated for each frame by the bass probability estimation unit.

According to another embodiment of the present invention, there is provided a melody line extraction method including the steps of converting an audio signal to a pitch signal indicating a signal intensity of each pitch, estimating for each frame a probability of each pitch being a melody note, based on the audio signal, and detecting a maximum likelihood path from among paths of pitches from a start frame to an end frame of the audio signal, and determining the maximum likelihood path as a melody line, based on the probability of each pitch being a melody note, the probability being estimated for each frame by the step of estimating a probability of each pitch being a melody note. The steps are performed by an information processing apparatus.

According to another embodiment of the present invention, there is provided a bass line extraction method including the steps of converting an audio signal to a pitch signal indicating a signal intensity of each pitch, estimating for each frame a probability of each pitch being a bass note, based on the audio signal, and detecting a maximum likelihood path from among paths of pitches from a start frame to an end frame of the audio signal, and determining the maximum likelihood path as a bass line, based on the probability of each pitch being a bass note, the probability being estimated for each frame by the step of estimating a probability of each pitch being a bass note. The steps are performed by an information processing apparatus.

According to another embodiment of the present invention, there is provided a program for causing a computer to execute the steps of converting an audio signal to a pitch signal indicating a signal intensity of each pitch, estimating for each frame a probability of each pitch being a melody note, based on the audio signal, and detecting a maximum likelihood path from among paths of pitches from a start frame to an end frame of the audio signal, and determining the maximum likelihood path as a melody line, based on the probability of each pitch being a melody note, the probability being estimated for each frame by the step of estimating a probability of each pitch being a melody note.

According to another embodiment of the present invention, there is provided a program for causing a computer to execute the steps of converting an audio signal to a pitch signal indicating a signal intensity of each pitch, estimating for each frame a probability of each pitch being a bass note, based on the audio signal, and detecting a maximum likelihood path from among paths of pitches from a start frame to an end frame of the audio signal, and determining the maximum likelihood path as a bass line, based on the probability of each pitch being a bass note, the probability being estimated for each frame by the step of estimating a probability of each pitch being a bass note.

According to another embodiment of the present invention, there may be provided a recording medium which stores the program and which can be read by a computer.

According to the embodiments of the present invention described above, a melody line or a bass line can be accurately extracted from music data.

BRIEF DESCRIPTION OF THE DRAWINGS

FIG. 6 is an explanatory diagram showing a music classification example according to the present embodiment;

FIG. 42 is an explanatory diagram showing an example of the chord probability computation method according to the present embodiment;

FIG. 53 is an explanatory diagram showing an example of the key detection method according to the present embodiment;

DETAILED DESCRIPTION OF THE EMBODIMENT(S)

Figure 1:
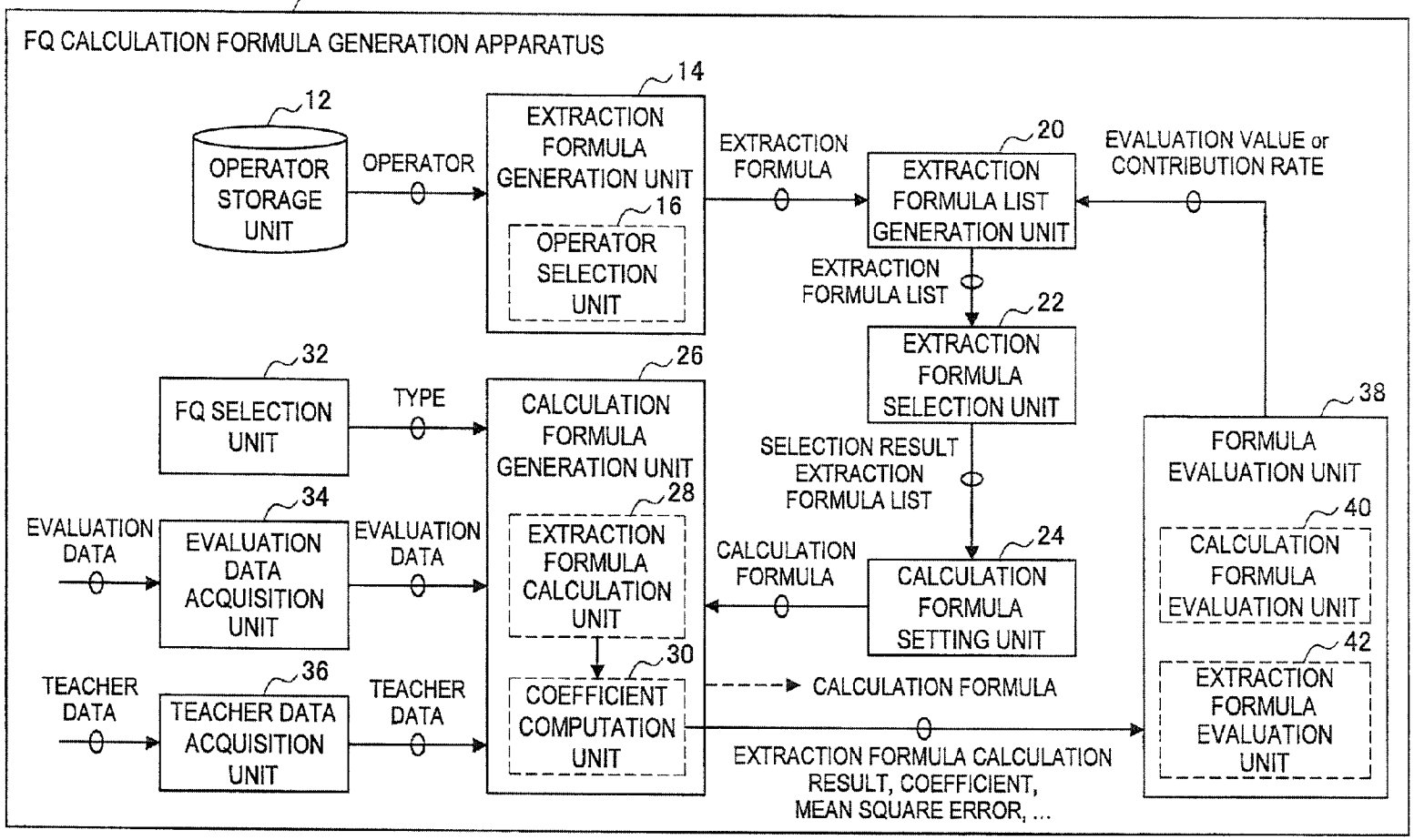
FIG. 1 is an explanatory diagram showing a configuration example of a feature quantity calculation formula generation apparatus for automatically generating an algorithm for calculating feature quantity.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

In this specification, explanation will be made in the order shown below.

(Explanation Items)

1. Infrastructure Technology 1-1. Configuration Example of Feature Quantity Calculation Formula Generation Apparatus 10

2. Embodiment 2-1. Overall Configuration of Information Processing Apparatus 100

2-2. Configuration of Centre Extraction Unit 102

2-3. Configuration of Log Spectrum Analysis Unit 104

2-4. Configuration of Category Estimation Unit 106

2-5. Configuration of Pitch Distribution Estimation Unit 108

2-6. Configuration of Melody Probability Estimation Unit 110

2-7. Configuration of Melody Line Determination Unit 112

2-8. Configuration of Smoothing Unit 114

2-9. Configurations of Beat Detection Unit 116 and Key Detection Unit 118

2-9-1. Configuration of Beat Detection Unit 116

2-9-2. Configuration of Chord Probability Detection Unit 120

2-9-3. Configuration of Key Detection Unit 118

2-10. Hardware Configuration Example 2-11. Conclusion

<1. Infrastructure Technology>

First, before describing a technology according to an embodiment of the present invention, an infrastructure technology used for realizing the technological configuration of the present embodiment will be briefly described. The infrastructure technology described here relates to an automatic generation method of an algorithm for quantifying in the form of feature quantity the feature of arbitrary input data. Various types of data such as a signal waveform of an audio signal or brightness data of each colour included in an image may be used as the input data, for example. Furthermore, when taking a music piece for an example, by applying the infrastructure technology, an algorithm for computing feature quantity indicating the cheerfulness of the music piece or the tempo is automatically generated from the waveform of the music data. Moreover, a learning algorithm disclosed in JP-A-2008-123011 can also be used instead of the configuration example of a feature quantity calculation formula generation apparatus 10 described below.

(1-1. Configuration Example of Feature Quantity Calculation Formula Generation Apparatus 10)

First, referring to FIG. 1, a functional configuration of the feature quantity calculation formula generation apparatus 10 according to the above-described infrastructure technology will be described. FIG. 1 is an explanatory diagram showing a configuration example of the feature quantity calculation formula generation apparatus 10 according to the above-described infrastructure technology. The feature quantity calculation formula generation apparatus 10 described here is an example of means (learning algorithm) for automatically generating an algorithm (hereinafter, a calculation formula) for quantifying in the form of feature quantity, by using arbitrary input data, the feature of the input data.

As shown in FIG. 1, the feature quantity calculation formula generation apparatus 10 mainly has an operator storage unit 12, an extraction formula generation unit 14, an extraction formula list generation unit 20, an extraction formula selection unit 22, and a calculation formula setting unit 24. Furthermore, the feature quantity calculation formula generation apparatus 10 includes a calculation formula generation unit 26, a feature quantity selection unit 32, an evaluation data acquisition unit 34, a teacher data acquisition unit 36, and a formula evaluation unit 38. Moreover, the extraction formula generation unit 14 includes an operator selection unit 16. Also, the calculation formula generation unit 26 includes an extraction formula calculation unit 28 and a coefficient computation unit 30. Furthermore, the formula evaluation unit 38 includes a calculation formula evaluation unit 40 and an extraction formula evaluation unit 42.

First, the extraction formula generation unit 14 generates a feature quantity extraction formula (hereinafter, an extraction formula), which serves a base for a calculation formula, by combining a plurality of operators stored in the operator storage unit 12. The "operator" here is an operator used for executing specific operation processing on the data value of the input data. The types of operations executed by the operator include a differential computation, a maximum value extraction, a low-pass filtering, an unbiased variance computation, a fast Fourier transform, a standard deviation computation, an average value computation, or the like. Of course, it is not limited to these types of operations exemplified above, and any type of operation executable on the data value of the input data may be included.

Furthermore, a type of operation, an operation target axis, and parameters used for the operation are set for each operator. The operation target axis means an axis which is a target of an operation processing among axes defining each data value of the input data. For example, when taking music data as an example, the music data is given as a waveform for volume in a space formed from a time axis and a pitch axis (frequency axis). When performing a differential operation on the music data, whether to perform the differential operation along the time axis or to perform the differential operation along the frequency axis has to be determined. Thus, each parameter includes information relating to an axis which is to be the target of the operation processing among axes forming a space defining the input data.

Furthermore, a parameter becomes necessary depending on the type of an operation. For example, in case of the low-pass filtering, a threshold value defining the range of data values to be passed has to be fixed as a parameter. Due to these reasons, in addition to the type of an operation, an operation target axis and a necessary parameter are included in each operator. For example, operators are expressed as F#Differential, F#MaxIndex, T#LPF_1;0.861, T#UVariance, . . . F and the like added at the beginning of the operators indicate the operation target axis. For example, F means frequency axis, and T means time axis.

Differential and the like added, being divided by #, after the operation target axis indicate the types of the operations. For example, Differential means a differential computation operation, MaxIndex means a maximum value extraction operation, LPF means a low-pass filtering, and UVariance means an unbiased variance computation operation. The number following the type of the operation indicates a parameter. For example, LPF_1;0.861 indicates a low-pass filter having a range of 1 to 0.861 as a passband. These various operators are stored in the operator storage unit 12, and are read and used by the extraction formula generation unit 14. The extraction formula generation unit 14 first selects arbitrary operators by the operator selection unit 16, and generates an extraction formula by combining the selected operators.

For example, F#Differential, F#MaxIndex, T#LPF_1; 0.861 and T#UVariance are selected by the operator selection unit 16, and an extraction formula f expressed as the following equation (1) is generated by the extraction formula generation unit 14. However, 12Tones added at the beginning indicates the type of input data which is a processing target. For example, when 12Tones is described, signal data (log spectrum described later) in a time-pitch space obtained by analyzing the waveform of input data is made to be the operation processing target. That is, the extraction formula expressed as the following equation (1) indicates that the log spectrum described later is the processing target, and that, with respect to the input data, the differential operation and the maximum value extraction are sequentially performed along the frequency axis (pitch axis direction) and the low-pass filtering and the unbiased variance operation are sequentially performed along the time axis.

[Equation 1]

$$f=\{12\text{Tones},F\#\text{Differential},F\#\text{MaxIndex},T\#\text{LPF_1};0.861,T\#\text{UVariance}\} \quad (1)$$

As described above, the extraction formula generation unit 14 generates an extraction formula as shown as the above-described equation (1) for various combinations of the operators. The generation method will be described in detail. First, the extraction formula generation unit 14 selects operators by using the operator selection unit 16. At this time, the operator selection unit 16 decides whether the result of the operation by the combination of the selected operators (extraction formula) on the input data is a scalar or a vector of a specific size or less (whether it will converge or not).

Moreover, the above-described decision processing is performed based on the type of the operation target axis and the type of the operation included in each operator. When combinations of operators are selected by the operator selection unit 16, the decision processing is performed for each of the combinations. Then, when the operator selection unit 16 decides that an operation result converges, the extraction formula generation unit 14 generates an extraction formula by using the combination of the operators, according to which the operation result converges, selected by the operator selection unit 16. The generation processing for the extraction formula by the extraction formula generation unit 14 is performed until a specific number (hereinafter, number of selected extraction formulae) of extraction formulae are generated. The extraction formulae generated by the extraction formula generation unit 14 are input to the extraction formula list generation unit 20.

When the extraction formulae are input to the extraction formula list generation unit 20 from the extraction formula generation unit 14, a specific number of extraction formulae are selected from the input extraction formulae (hereinafter, number of extraction formulae in list≤number of selected extraction formulae) and an extraction formula list is generated. At this time, the generation processing by the extraction formula list generation unit 20 is performed until a specific number of the extraction formula lists (hereinafter, number of lists) are generated. Then, the extraction formula lists generated by the extraction formula list generation unit 20 are input to the extraction formula selection unit 22.

A concrete example will be described in relation to the processing by the extraction formula generation unit 14 and the extraction formula list generation unit 20. First, the type of the input data is determined by the extraction formula generation unit 14 to be music data, for example. Next, operators $OP_1$, $OP_2$, $OP_3$ and $OP_4$ are randomly selected by the operator selection unit 16. Then, the decision processing is performed as to whether or not the operation result of the music data converges by the combination of the selected operators. When it is decided that the operation result of the music data converges, an extraction formula $f_1$ is generated with the combination of $OP_1$ to $OP_4$. The extraction formula $f_1$ generated by the extraction formula generation unit 14 is input to the extraction formula list generation unit 20.

Furthermore, the extraction formula generation unit 14 repeats the processing same as the generation processing for the extraction formula $f_1$ and generates extraction formulae $f_2$, $f_3$ and $f_4$, for example. The extraction formulae $f_2$, $f_3$ and $f_4$ generated in this manner are input to the extraction formula list generation unit 20. When the extraction formulae $f_1$, $f_2$, $f_3$ and $f_4$ are input, the extraction formula list generation unit 20 generates an extraction formula list $L_1=\{f_1, f_2, f_4\}$, and an extraction formula list $L_2=\{f_1, f_3, f_4\}$, for example. The extraction formula lists $L_1$ and $L_2$ generated by the extraction formula list generation unit 20 are input to the extraction formula selection unit 22. As described above with a concrete example, extraction formulae are generated by the extraction formula generation unit 14, and extraction formula lists are generated by the extraction formula list generation unit 20 and are input to the extraction formula selection unit 22. However, although a case is described in the above-described example where the number of selected extraction formulae is 4, the number of extraction formulae in list is 3, and the number of lists is 2, it should be noted that, in reality, extremely large numbers of extraction formulae and extraction formula lists are generated.

Now, when the extraction formula lists are input from the extraction formula list generation unit 20, the extraction formula selection unit 22 selects, from the input extraction formula lists, extraction formulae to be inserted into the calculation formula described later. For example, when the extraction formulae $f_1$ and $f_4$ in the above-described extraction formula list $L_1$ are to be inserted into the calculation formula, the extraction formula selection unit 22 selects the extraction formulae $f_1$ and $f_4$ with regard to the extraction formula list $L_1$. The extraction formula selection unit 22 performs the above-described selection processing for each of the extraction formula lists. Then, when the selection processing is complete, the result of the selection processing by the extraction formula selection unit 22 and each of the extraction formula lists are input to the calculation formula setting unit 24.

When the selection result and each of the extraction formula lists are input from the extraction formula selection unit 22, the calculation formula setting unit 24 sets a calculation formula corresponding to each of the extraction formula, taking into consideration the selection result of the extraction formula selection unit 22. For example, as shown as the following equation (2), the calculation formula setting unit 24 sets a calculation formula $F_m$ by linearly coupling extraction formula $f_k$ included in each extraction formula list $L_m=\{f_1, \ldots, f_K\}$. Moreover, m=1, . . . , M (M is the number of lists), k=1, . . . , K (K is the number of extraction formulae in list), and $B_0, \ldots, B_K$ are coupling coefficients.

[Equation 2]

$$F_m=B_0+B_1f_1+\ldots+B_Kf_K \tag{2}$$

Moreover, the calculation formula $F_m$ can also be set to a non-linear function of the extraction formula $f_k$ (k=1 to K). However, the function form of the calculation formula $F_m$ set by the calculation formula setting unit 24 depends on a coupling coefficient estimation algorithm used by the calculation formula generation unit 26 described later. Accordingly, the calculation formula setting unit 24 is configured to set the function form of the calculation formula $F_m$ according to the estimation algorithm which can be used by the calculation formula generation unit 26. For example, the calculation formula setting unit 24 may be configured to change the function form according to the type of input data. However, in this specification, the linear coupling expressed as the above-described equation (2) will be used for the convenience of the explanation. The information of the calculation formula set by the calculation formula setting unit 24 is input to the calculation formula generation unit 26.

Furthermore, the type of feature quantity desired to be computed by the calculation formula is input to the calculation formula generation unit 26 from the feature quantity selection unit 32. The feature quantity selection unit 32 is means for selecting the type of feature quantity desired to be computed by the calculation formula. Furthermore, evaluation data corresponding to the type of the input data is input to the calculation formula generation unit 26 from the evaluation data acquisition unit 34. For example, in a case the type of the input data is music, a plurality of pieces of music data are input as the evaluation data. Also, teacher data corresponding to each evaluation data is input to the calculation formula generation unit 26 from the teacher data acquisition unit 36. The teacher data here is the feature quantity of each evaluation data. Particularly, the teacher data for the type selected by the feature quantity selection unit 32 is input to the calculation formula generation unit 26. For example, in a case where the input data is music data and the type of the feature quantity is tempo, correct tempo value of each evaluation data is input to the calculation formula generation unit 26 as the teacher data.

When the evaluation data, the teacher data, the type of the feature quantity, the calculation formula and the like are input, the calculation formula generation unit 26 first inputs each evaluation data to the extraction formulae $f_1, \ldots, f_K$ included in the calculation formula $F_m$ and obtains the calculation result by each of the extraction formulae (hereinafter, an extraction formula calculation result) by the extraction formula calculation unit 28. When the extraction formula calculation result of each extraction formula relating to each evaluation data is computed by the extraction formula calculation unit 28, each extraction formula calculation result is input from the extraction formula calculation unit 28 to the coefficient computation unit 30. The coefficient computation unit 30 uses the teacher data corresponding to each evaluation data and the extraction formula calculation result that is input, and computes the coupling coefficients expressed as $B_0, \ldots, B_K$ in the above-described equation (2). For example, the coefficients $B_0, \ldots, B_K$ can be determined by using a least-squares method. At this time, the coefficient computation unit 30 also computes evaluation values such as a mean square error.

The extraction formula calculation result, the coupling coefficient, the mean square error and the like are computed for each type of feature quantity and for the number of the lists. The extraction formula calculation result computed by the extraction formula calculation unit 28, and the coupling coefficients and the evaluation values such as the mean square error computed by the coefficient computation unit 30 are input to the formula evaluation unit 38. When these computation results are input, the formula evaluation unit 38 computes an evaluation value for deciding the validity of each of the calculation formulae by using the input computation results. As described above, a random selection processing is included in the process of determining the extraction formulae configuring each calculation formula and the operators configuring the extraction formulae. That is, there are uncertainties as to whether or not optimum extraction formulae and optimum operators are selected in the determination processing. Thus, evaluation is performed by the formula evaluation unit 38 to evaluate the computation result and to perform recalculation or correct the calculation result as appropriate.

The calculation formula evaluation unit 40 for computing the evaluation value for each calculation formula and the extraction formula evaluation unit 42 for computing a contribution degree of each extraction formula are provided in the formula evaluation unit 38 shown in FIG. 1. The calculation formula evaluation unit 40 uses an evaluation method called AIC or BIC, for example, to evaluate each calculation formula. The AIC here is an abbreviation for Akaike Information Criterion. On the other hand, the BIC is an abbreviation for Bayesian Information Criterion. When using the AIC, the evaluation value for each calculation formula is computed by using the mean square error and the number of pieces of the teacher data (hereinafter, the number of teachers) for each calculation formula. For example, the evaluation value is computed based on the value (AIC) expressed by the following equation (3).

[Equation 3]

$$\text{AIC}=\text{number of teachers}\times\{\log 2n+1+\log(\text{mean square error})\}+2(K+1) \quad (3)$$

According to the above-described equation (3), the accuracy of the calculation formula is higher as the AIC is smaller. Accordingly, the evaluation value for a case of using the AIC is set to become larger as the AIC is smaller. For example, the evaluation value is computed by the inverse number of the AIC expressed by the above-described equation (3). Moreover, the evaluation values are computed by the calculation formula evaluation unit 40 for the number of the types of the feature quantities. Thus, the calculation formula evaluation unit 40 performs averaging operation for the number of the types of the feature quantities for each calculation formula and computes the average evaluation value. That is, the average evaluation value of each calculation formula is computed at this stage. The average evaluation value computed by the calculation formula evaluation unit 40 is input to the extraction formula list generation unit 20 as the evaluation result of the calculation formula.

On the other hand, the extraction formula evaluation unit 42 computes, as an evaluation value, a contribution rate of each extraction formula in each calculation formula based on the extraction formula calculation result and the coupling coefficients. For example, the extraction formula evaluation unit 42 computes the contribution rate according to the following equation (4). The standard deviation for the extraction formula calculation result of the extraction formula $f_K$ is obtained from the extraction formula calculation result computed for each evaluation data. The contribution rate of each extraction formula computed for each calculation formula by the extraction formula evaluation unit 42 according to the following equation (4) is input to the extraction formula list generation unit 20 as the evaluation result of the extraction formula.

[Equation 4]

$$\text{Contribution rate of } f_k = \frac{B_k \times StDev(FQ \text{ of estimation target})}{StDev(\text{calculation result of } f_k)\times \text{Pearson (calculation result of } f_k\text{, estimation target } FQ)} \quad (4)$$

Here, StDev( . . . ) indicates the standard deviation. Furthermore, the feature quantity of an estimation target is the tempo or the like of a music piece. For example, in a case where log spectra of 100 music pieces are given as the evaluation data and the tempo of each music piece is given as the teacher data, StDev(feature quantity of estimation target) indicates the standard deviation of the tempos of the 100 music pieces. Furthermore, Pearson( . . . ) included in the above-described equation (4) indicates a correlation function. For example, Pearson(calculation result of $f_K$, estimation target FQ) indicates a correlation function for computing the correlation coefficient between the calculation result of $f_K$ and the estimation target feature quantity. Moreover, although the tempo of a music piece is indicated as an example of the feature quantity, the estimation target feature quantity is not limited to such.

When the evaluation results are input from the formula evaluation unit 38 to the extraction formula list generation unit 20 in this manner, an extraction formula list to be used for the formulation of a new calculation formula is generated. First, the extraction formula list generation unit 20 selects a specific number of calculation formulae in descending order of the average evaluation values computed by the calculation formula evaluation unit 40, and sets the extraction formula lists corresponding to the selected calculation formulae as new extraction formula lists (selection). Furthermore, the extraction formula list generation unit 20 selects two calculation formulae by weighting in the descending order of the average evaluation values computed by the calculation formula evaluation unit 40, and generates a new extraction formula list by combining the extraction formulae in the extraction formula lists corresponding to the calculation formulae (crossing-over). Furthermore, the extraction formula list generation unit 20 selects one calculation formula by weighting in the descending order of the average evaluation values computed by the calculation formula evaluation unit 40, and generates a new extraction formula list by partly changing the extraction formulae in the extraction formula list corresponding to the calculation formula (mutation). Furthermore, the extraction formula list generation unit 20 generates a new extraction formula list by randomly selecting extraction formulae.

In the above-described crossing-over, the lower the contribution rate of an extraction formula, the better it is that the extraction formula is set unlikely to be selected. Also, in the above-described mutation, a setting is preferable where an extraction formula is apt to be changed as the contribution rate of the extraction formula is lower. The processing by the extraction formula selection unit 22, the calculation formula setting unit 24, the calculation formula generation unit 26 and the formula evaluation unit 38 is again performed by using the extraction formula lists newly generated or newly set in this manner. The series of processes is repeatedly performed until the degree of improvement in the evaluation result of the formula evaluation unit 38 converges to a certain degree. Then, when the degree of improvement in the evaluation result of the formula evaluation unit 38 converges to a certain degree, the calculation formula at the time is output as the computation result. By using the calculation formula that is output, the feature quantity representing a target feature of input data is computed with high accuracy from arbitrary input data different from the above-described evaluation data.

As described above, the processing by the feature quantity calculation formula generation apparatus 10 is based on a genetic algorithm for repeatedly performing the processing while proceeding from one generation to the next by taking into consideration elements such as the crossing-over or the mutation. A computation formula capable of estimating the feature quantity with high accuracy can be obtained by using the genetic algorithm. However, in the embodiment described later, a learning algorithm for computing the calculation formula by a method simpler than that of the genetic algorithm can be used. For example, instead of performing the processing such as the selection, crossing-over and mutation described above by the extraction formula list generation unit 20, a method can be conceived for selecting a combination for which the evaluation value by the calculation formula evaluation unit 40 is the highest by changing the extraction formula to be used by the extraction formula selection unit 22. In this case, the configuration of the extraction formula evaluation unit 42 can be omitted. Furthermore, the configuration can be changed as appropriate according to the operational load and the desired estimation accuracy.

<2. Embodiment>

Hereunder, an embodiment of the present invention will be described. The present embodiment relates to a technology for automatically extracting, from music data provided in the form of Wav data or the like, the melody line of the music piece. Particularly, in the present embodiment, a technology for improving the extraction accuracy for the melody line is proposed. For example, according to this technology, it is possible to reduce the frequency of erroneous detection where the pitches of instruments other than the melody are erroneously detected as the melody. It is also possible to reduce the frequency of erroneously detecting a pitch shifted by a semitone from the original melody as the melody due to vibrato or the like. Furthermore, it is also possible to reduce the frequency of erroneously detecting the pitch in a different octave as the melody. This technology can also be applied to a technology for extracting a bass line from the music data with high accuracy.

(2-1. Overall Configuration of Information Processing Apparatus 100)

Figure 2:
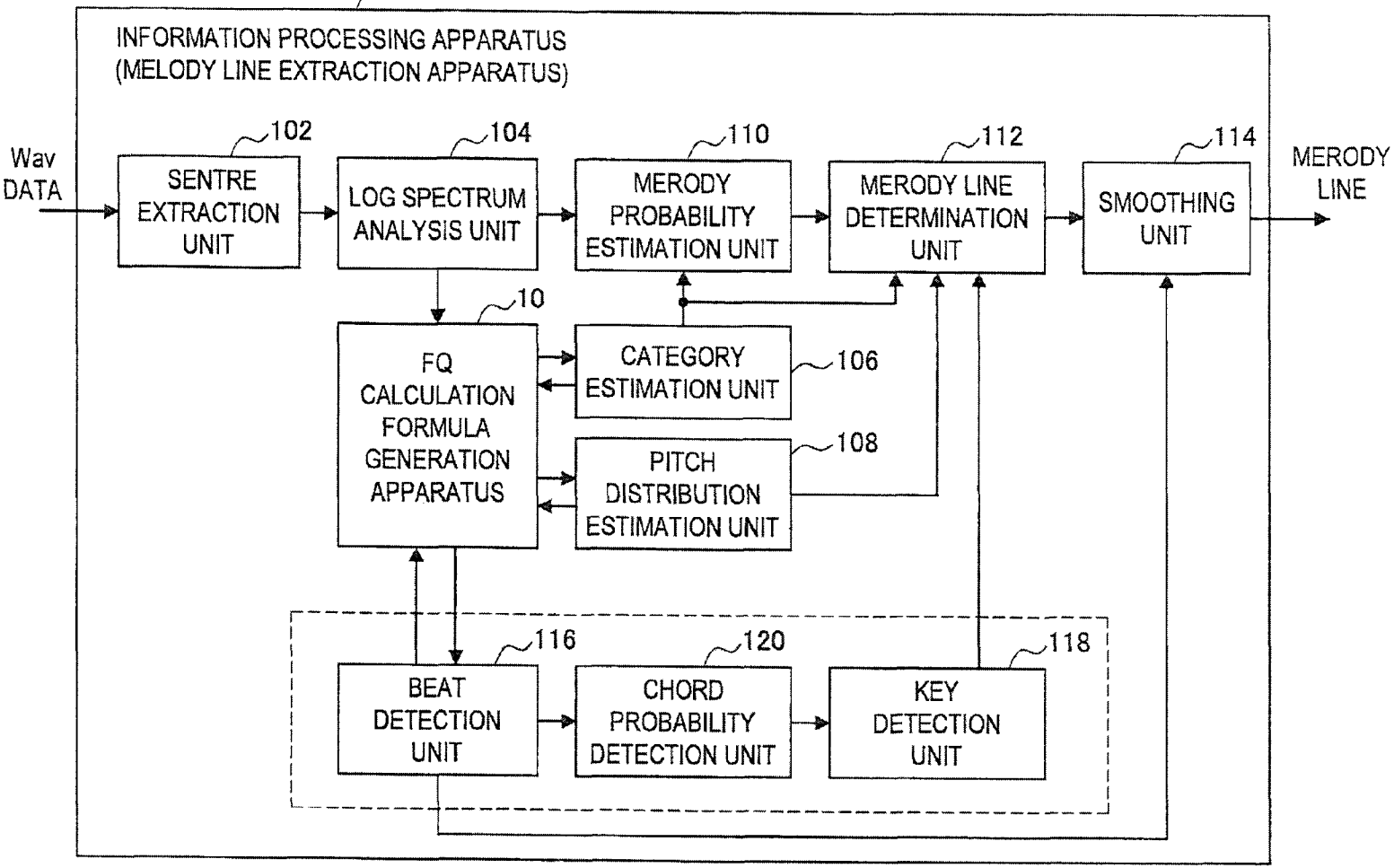
FIG. 2 is an explanatory diagram showing a functional configuration example of an information processing apparatus (melody line extraction apparatus) according to an embodiment of the present invention.

First, referring to FIG. 2, a functional configuration of an information processing apparatus 100 according to the present embodiment will be described. FIG. 2 is an explanatory diagram showing a functional configuration example of the information processing apparatus 100 according to the present embodiment. Moreover, the information processing apparatus 100 described here functions as a melody line extraction apparatus capable of extracting a melody line from music data. Hereunder, after describing the overall configuration of the information processing apparatus 100, detailed configuration of each structural element will be individually described.

As shown in FIG. 2, the information processing apparatus 100 has a centre extraction unit 102, a log spectrum analysis unit 104, a category estimation unit 106, a pitch distribution estimation unit 108, and a melody probability estimation unit 110. Furthermore, the information processing apparatus 100 has a melody line determination unit 112, a smoothing unit 114, a beat detection unit 116, a key detection unit 118, and a chord probability detection unit 120.

Furthermore, the feature quantity calculation formula generation apparatus 10 is included in the information processing apparatus 10 illustrated in FIG. 2. The feature quantity calculation formula generation apparatus 10 may be provided within the information processing apparatus 100 or may be connected to the information processing apparatus 100 as an external device. In the following, for the sake of convenience, the feature quantity calculation formula generation apparatus 10 is assumed to be built in the information processing apparatus 100. Furthermore, instead of being provided with the feature quantity calculation formula generation apparatus 10, the information processing apparatus 100 can also use various learning algorithms capable of generating a calculation formula for feature quantity.

Overall flow of the processing is as described next. First, music data is input to the centre extraction unit 102. Of a stereo component included in the music data, only a centre component is extracted by the centre extraction unit 102. The centre component of the music data is input to the log spectrum analysis unit 104. The centre component of the music data is converted to a log spectrum described later by the log spectrum analysis unit 104. The log spectrum output from the log spectrum analysis unit 104 is input to the feature quantity calculation formula generation apparatus 10, the melody probability estimation unit 110 and the like. Moreover, the log spectrum may be used by structural elements other than the feature quantity calculation formula generation apparatus 10 and the melody probability estimation unit 110. In this case, a desired log spectrum is provided as appropriate to each structural element directly or indirectly from the log spectrum analysis unit 104.

For example, a log spectrum is input to the category estimation unit 106, and the music piece corresponding to the log spectrum is classified into a specific category by using the feature quantity calculation formula generation apparatus 10. Also, a log spectrum is input to the pitch distribution estimation unit 108, and a distribution probability of the melody line is roughly estimated from the log spectrum by using the feature quantity calculation formula generation apparatus 10. Moreover, the probability of each pitch of the log spectrum being the melody line is estimated from the input log spectrum by the melody probability estimation unit 110. At this time, the music category estimated by the category estimation unit 106 is taken into consideration. The probabilities for the melody line estimated by the melody probability estimation unit 110 are input to the melody line determination unit 112. Then, a melody line is determined by the melody line determination unit 112. The determined melody line is smoothed by the smoothing unit 114 for each beat and then is output to the outside.

The flow relating to the melody line extraction process is roughly described as above. For the processing by each structural element, the beat, the key progression or the like of a music piece is used, for example. Thus, the beat is detected by the beat detection unit 116, and the key progression is detected by the key detection unit 118. Also, a chord probability (described later) used in a key detection process is detected by the chord probability detection unit 120. In the following, first, structural elements other than the beat detection unit 116, the key detection unit 118 and the chord probability detection unit 120 will be described in detail, and functions mainly used for extracting the melody line from music data will be described in detail. Then, functional configurations of the beat detection unit 116, key detection unit 118 and chord probability detection unit 120 will be described in detail.

(2-2. Configuration Example of Centre Extraction Unit 102)

First, the centre extraction unit 102 will be described. The centre extraction unit 102 is means for extracting an audio signal localized around the centre (hereinafter, a centre signal) from an input stereo signal. For example, the centre extraction unit 102 computes a volume difference between the centre signal and an audio signal localized at non-centre part (hereinafter, a non-centre signal), and suppresses the non-centre signal according to the computation result. The centre signal here means a signal for which a level difference and a phase difference between left and right channels are small.

Figure 3:
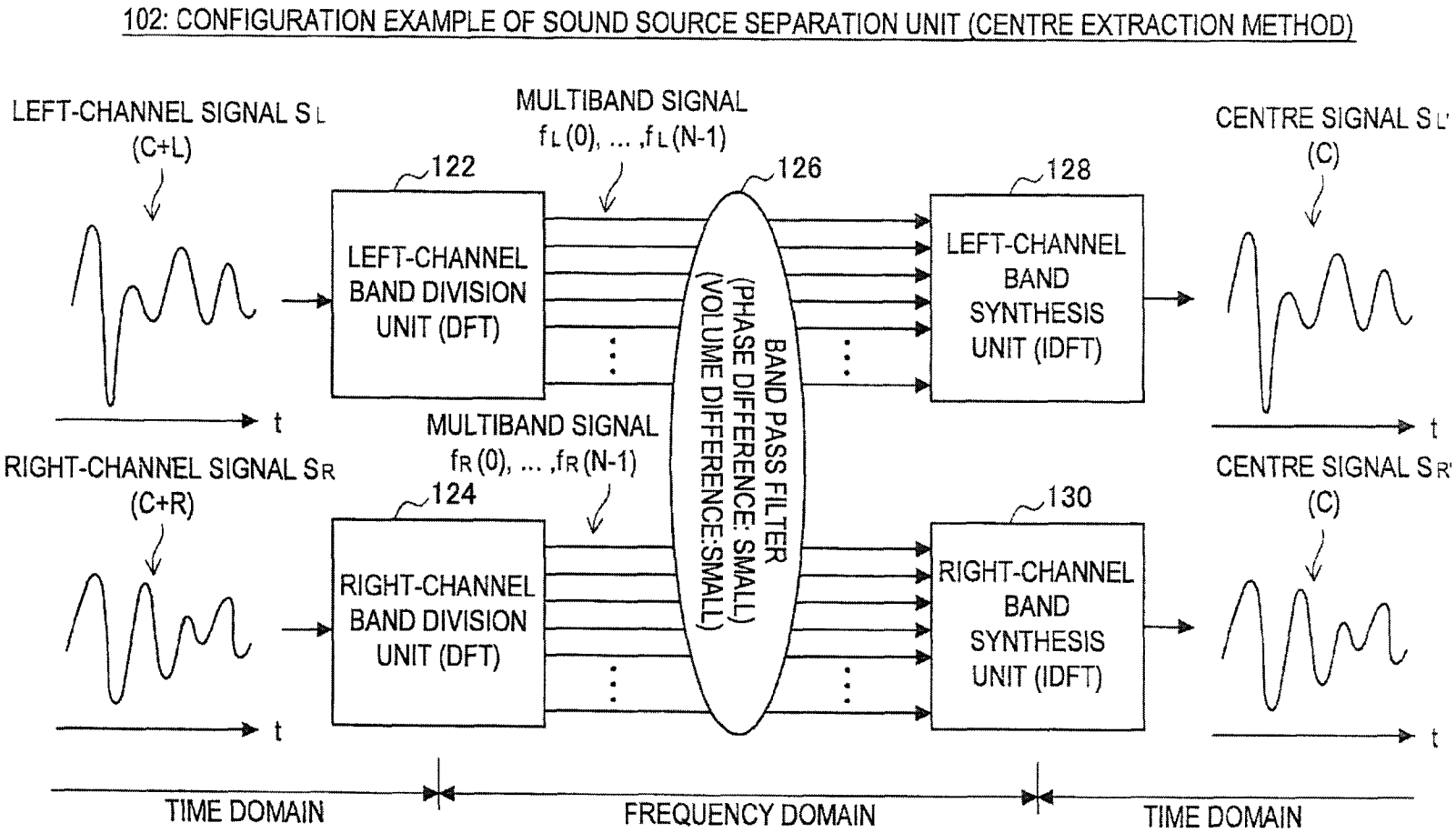
FIG. 3 is an explanatory diagram showing an example of a centre extraction method according to the present embodiment.

Referring to FIG. 3, the configuration of the centre extraction unit 102 will be described in detail. As shown in FIG. 3, the centre extraction unit 102 can be configured from a left-channel band division unit 122, a right-channel band division unit 124, a band pass filter 126, a left-channel band synthesis unit 128, and a right-channel band synthesis unit 130.

First, a left-channel signal $s_L$ of the stereo signal input to the centre extraction unit 102 is input to the left-channel band division unit 122. A non-centre signal L and a centre signal C of the left channel are present in a mixed manner in the left-channel signal $s_L$. Furthermore, the left-channel signal $s_L$ is a volume level signal changing over time. Thus, the left-channel band division unit 122 performs a DFT processing on the left-channel signal $s_L$ that is input and converts the same from a signal in a time domain to a signal in a frequency domain (hereinafter, a multi-band signal $f_L(0), \ldots, f_L(N-1)$). Here, $f_L(K)$ is a sub-band signal corresponding to the k-th (k=0, . . . , N−1) frequency band. Moreover, the above-described DFT is an abbreviation for Discrete Fourier Transform. The left-channel multi-band signal output from the left-channel band division unit 122 is input to the band pass filter 126.

In a similar manner, a right-channel signal $s_R$ of the stereo signal input to the centre extraction unit 102 is input to the right-channel band division unit 124. A non-centre signal R and a centre signal C of the right channel are present in a mixed manner in the right-channel signal $s_R$. Furthermore, the right-channel signal $s_R$ is a volume level signal changing over time. Thus, the right-channel band division unit 124 performs the DFT processing on the right-channel signal $s_R$ that is input and converts the same from a signal in a time domain to a signal in a frequency domain (hereinafter, a multi-band signal $f_R(0), \ldots, f_R(N-1)$). Here, $f_R(k')$ is a sub-band signal corresponding to the k'-th (k'=0, . . . , N−1) frequency band. The right-channel multi-band signal output from the right-channel band division unit 124 is input to the band pass filter 126. Moreover, the number of bands into which the multi-band signals of each channel are divided is N (for example, N=8192).

As described above, the multi-band signals $f_L(k)$ (k=0, . . . , N−1) and $f_R(k')$ (k'=0, . . . , N−1) of respective channels are input to the band pass filter 126. In the following, frequency is labeled in the ascending order such as k=0, . . . , N−1, or k'=0, . . . , N−1. Furthermore, each of the signal components $f_L(k)$ and $f_R(k')$ are referred to as a sub-channel signal. First, in the band pass filter 126, the sub-channel signals $f_L(k)$ and $f_R(k')$ (k'=k) in the same frequency band are selected from the multi-band signals of both channels, and a similarity a(k) between the sub-channel signals is computed. The similarity a(k) is computed according to the following equations (5) and (6), for example. Here, an amplitude component and a phase component are included in the sub-channel signal. Thus, the similarity for the amplitude component is expressed as ap(k), and the similarity for the phase component is expressed as ai(k).

[Equation 5]

$$ai(k) = \cos\theta = \frac{\mathrm{Re}[f_R(k) f_L(k)^*]}{|f_R(k)||f_L(k)|} \tag{5}$$

$$ap(k) = \begin{cases} \dfrac{|f_R(k)|}{|f_L(k)|}, & |f_R(k)| \le |f_L(k)| \\ \dfrac{|f_L(k)|}{|f_R(k)|}, & |f_R(k)| > |f_L(k)| \end{cases} \tag{6}$$

Here, | . . . | indicates the norm of " . . . ". θ indicates the phase difference ($0 \le |\theta| \le \pi$) between $f_L(k)$ and $f_R(k)$. The superscript * indicates a complex conjugate. Re[ . . . ] indicates the real part of " . . . ". As is clear from the above-described equation (6), the similarity ap(k) for the amplitude component is 1 in case the norms of the sub-channel signals $f_L(k)$ and $f_R(k)$ agree. On the contrary, in case the norms of the sub-channel signals $f_L(k)$ and $f_R(k)$ do not agree, the similarity ap(k) takes a value less than 1. On the other hand, regarding the similarity ai(k) for the phase component, when the phase difference θ is 0, the similarity ai(k) is 1; when the phase difference θ is π/2, the similarity ai(k) is 0; and when the phase difference θ is π, the similarity ai(k) is −1. That is, the similarity ai(k) for the phase component is 1 in case the phases of the sub-channel signals $f_L(k)$ and $f_R(k)$ agree, and takes a value less than 1 in case the phases of the sub-channel signals $f_L(k)$ and $f_R(k)$ do not agree.

When a similarity a(k) for each frequency band k (k=0, . . . , N−1) is computed by the above-described method, a frequency band q corresponding to the similarities ap(q) and ai(q) ($o \le q \le N-1$) less than a specific threshold value is extracted by the band pass filter 126. Then, only the sub-channel signal in the frequency band q extracted by the band pass filter 126 is input to the left-channel band synthesis unit 128 or the right-channel band synthesis unit 130. For example, the sub-channel signal $f_L(q)$ ($q=q_0, \ldots, q_{n-1}$) is input to the left-channel band synthesis unit 128. Thus, the left-channel band synthesis unit 128 performs an IDFT processing on the sub-channel signal $f_L(q)$ ($q=q_0, \ldots, q_{n-1}$) input from the band pass filter 126, and converts the same from the frequency domain to the time domain. Moreover, the above-described IDFT is an abbreviation for Inverse Discrete Fourier Transform.

In a similar manner, the sub-channel signal $f_R(q)$ ($q=q_0, \ldots, q_{n-1}$) is input to the right-channel band synthesis unit 130. Thus, the right-channel band synthesis unit 130 performs the IDFT processing on the sub-channel signal $f_R(q)$ ($q=q_0, \ldots, q_{n-1}$) input from the band pass filter 126, and converts the same from the frequency domain to the time domain. A centre signal component $s_L$, included in the left-channel signal $s_L$ is output from the left-channel band synthesis unit 128. On the other hand, a centre signal component $s_R$, included in the right-channel signal $s_R$ is output from the right-channel band synthesis unit 130. The centre extraction unit 102 extracts the centre signal from the stereo signal by the method described above. Then, the centre signal extracted by the centre extraction unit 102 is input to the log spectrum analysis unit 104 (refer to FIG. 2).

(2-3. Configuration of Log Spectrum Analysis Unit 104)

Next, the log spectrum analysis unit 104 will be described. The log spectrum analysis unit 104 is means for converting the input audio signal to an intensity distribution of each pitch. Twelve pitches (C, C#, D, D#, E, F, F#, G, G#, A, A#, B) are included in the audio signal per octave. Furthermore, a centre frequency of each pitch is logarithmically distributed. For example, when taking a centre frequency $f_{A3}$ of a pitch A3 as the standard, a centre frequency of A#3 is expressed as $f_{A\#3}=f_{A3}*2^{1/12}$. Similarly, a centre frequency $f_{B3}$ of a pitch B3 is expressed as $f_{B3}=f_{A\#3}*2^{1/12}$. In this manner, the ratio of the centre frequencies of the adjacent pitches is $1:2^{1/12}$. However, when handling an audio signal, taking the audio signal as a signal intensity distribution in a time-frequency space will cause the frequency axis to be a logarithmic axis, thereby complicating the processing on the audio signal. Thus, the log spectrum analysis unit 104 analyses the audio signal, and converts the same from a signal in the time-frequency space to a signal in a time-pitch space (hereinafter, a log spectrum).

Figure 4:
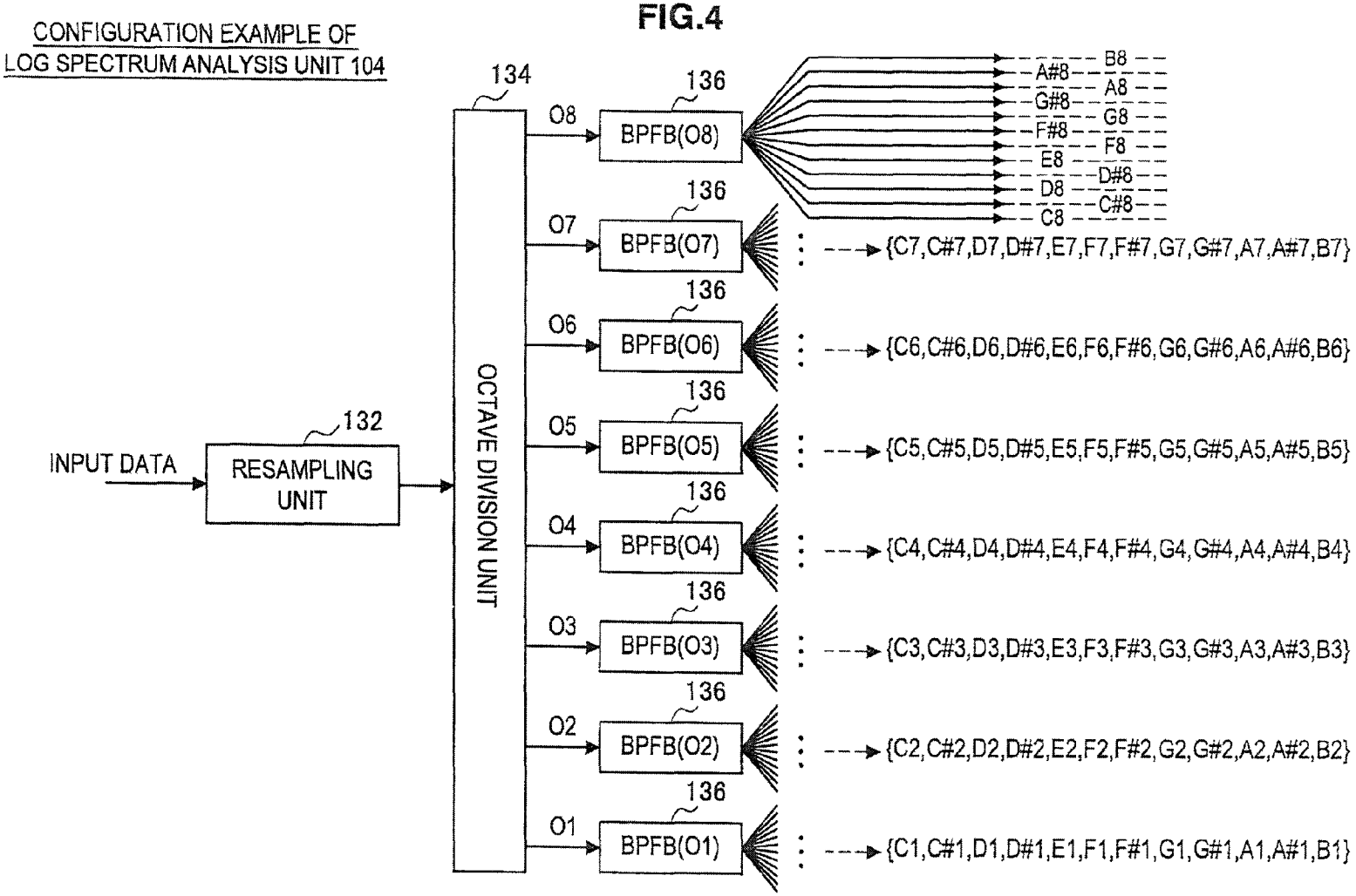
FIG. 4 is an explanatory diagram showing an example of a log spectrum generation method according to the present embodiment.

Referring to FIG. 4, the configuration of the log spectrum analysis unit 104 will be described in detail. As shown in FIG. 4, the log spectrum analysis unit 104 can be configured from a resampling unit 132, an octave division unit 134, and a plurality of band pass filter banks (BPFB) 136.

First, the audio signal is input to the resampling unit 132. Then, the resampling unit 132 converts a sampling frequency (for example, 44.1 kHz) of the input audio signal to a specific sampling frequency. A frequency obtained by taking a frequency at the boundary between octaves (hereinafter, a boundary frequency) as the standard and multiplying the boundary frequency by a power of two is taken as the specific sampling frequency. For example, the sampling frequency of the audio signal takes a boundary frequency 1016.7 Hz between an octave 4 and an octave 5 as the standard and is converted to a sampling frequency $2^5$ times the standard (32534.7 Hz). By converting the sampling frequency in this manner, the highest and lowest frequencies obtained as a result of a band division processing and a down sampling processing that are subsequently performed by the resampling unit 132 will agree with the highest and lowest frequencies of a certain octave. As a result, a process for extracting a signal for each pitch from the audio signal can be simplified.

The audio signal for which the sampling frequency is converted by the resampling unit 132 is input to the octave division unit 134. Then, the octave division unit 134 divides the input audio signal into signals for respective octaves by repeatedly performing the band division processing and the down sampling processing. Each of the signals obtained by the division by the octave division unit 134 is input to a band pass filter bank 136 (BPFB (O1), . . . , BPFB (O8)) provided for each of the octaves (O1, . . . , O8). Each band pass filter bank 136 is configured from 12 band pass filters each having a passband for one of 12 pitches so as to extract a signal for each pitch from the input audio signal for each octave. For example, by passing through the band pass filter bank 136 (BPFB (O8)) of octave 8, signals for 12 pitches (C8, C#8, D8, D#8, E8, F8, F#8, G8, G#8, A8, A#8, B) are extracted from the audio signal for the octave 8.

Figure 5:
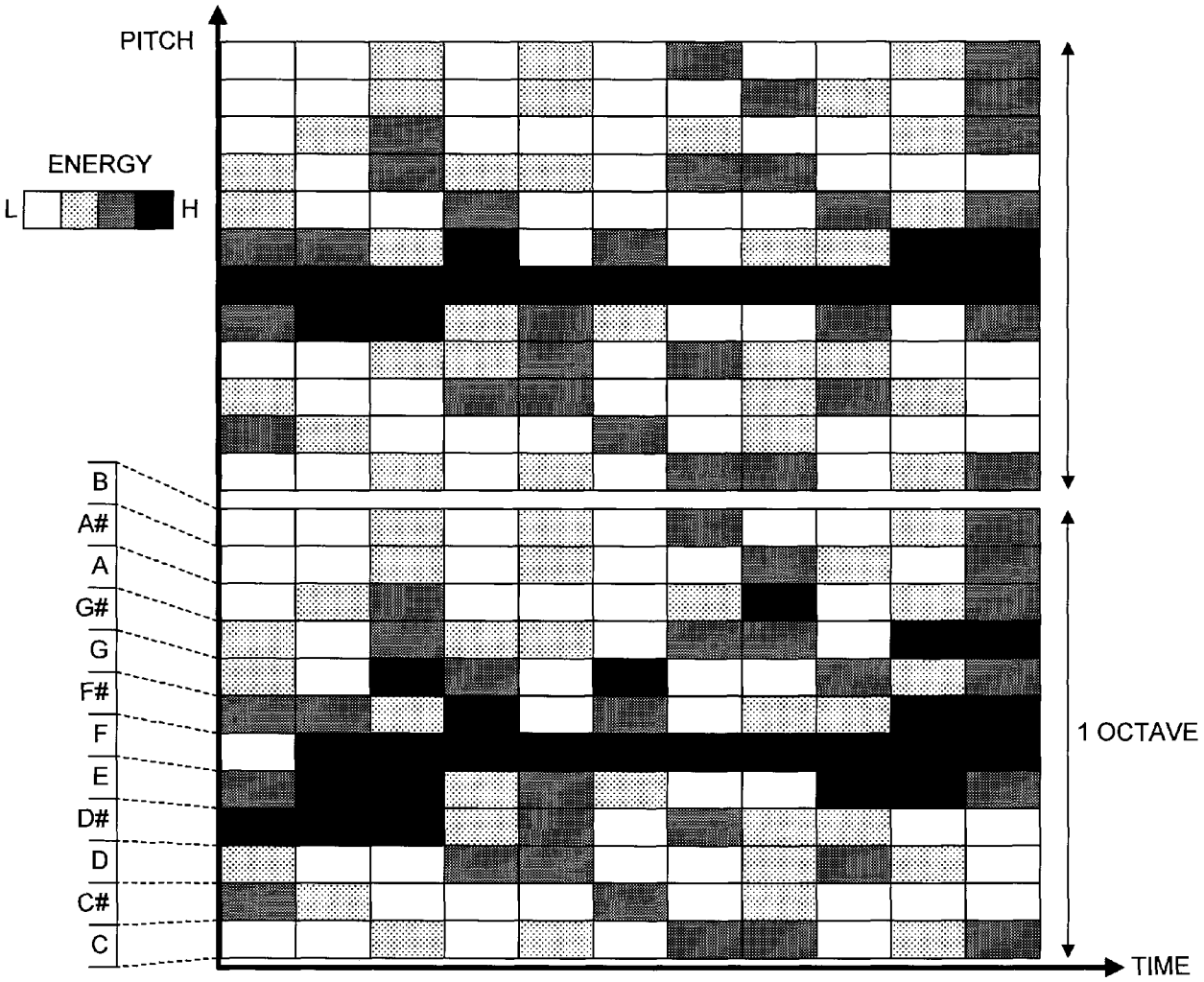
FIG. 5 is an explanatory diagram showing an example of a log spectrum generated by the log spectrum generation method according to the present embodiment.

A log spectrum showing signal intensities (hereinafter, energies) of 12 pitches in each octave can be obtained by the signals output from each band pass filter bank 136. FIG. 5 is an explanatory diagram showing an example of the log spectrum output from the log spectrum analysis unit 104.

Referring to the vertical axis (pitch) of FIG. 5, the input audio signal is divided into 7 octaves, and each octave is further divided into 12 pitches: "C," "C#," "D," "D#," "E," "F," "F#," "G," "G#," "A," "A#," and "B." On the other hand, the horizontal axis (time) of FIG. 5 shows frame numbers at times of sampling the audio signal along the time axis. For example, when the audio signal is resampled at a sampling frequency 127.0888 (Hz) by the resampling unit 132, 1 frame will be a time period corresponding to 1(sec)/127.0888=7.8686(msec). Furthermore, the intensity of colours of the log spectrum shown in FIG. 5 indicates the intensity of the energy of each pitch at each frame. For example, a position S1 is shown with a dark colour, and thus it can be understood that note at the pitch (pitch F) corresponding to the position S1 is produced strongly at the time corresponding to the position S1. Moreover, FIG. 5 is an example of the log spectrum obtained when a certain audio signal is taken as the input signal. Accordingly, if the input signal is different, a different log spectrum is obtained. The log spectrum obtained in this manner is input to the category estimation unit 106 (refer to FIG. 2).

(2-4. Configuration of Category Estimation Unit 106)

Next, the category estimation unit 106 will be described. The category estimation unit 106 is means for estimating, when a signal of a music piece is input, the music category to which the input signal belongs. As described later, by taking into consideration the music category to which each input signal belongs, a detection accuracy can be improved in a melody line detection processing performed later. As shown in FIG. 6, music pieces are categorized, such as "old piece," "male vocal, loud background (BG)," "male vocal, soft background (BG)," "female vocal, loud background (BG)," for example. For example, "old piece" has a feature that, since the level of technology for the recording devices and the sound facilities at the time of the recording is different from that of the present day, the sound quality is poor or the proportion of the volume in the background is small. With respect to other categories, features as shown in FIG. 6 exist for respective categories. Thus, the input signals are classified based on the feature of each music piece. Moreover, the music categories are not limited to those shown in FIG. 6. For example, more refined categories can also be used based on the voice quality or the like.

Figure 7:
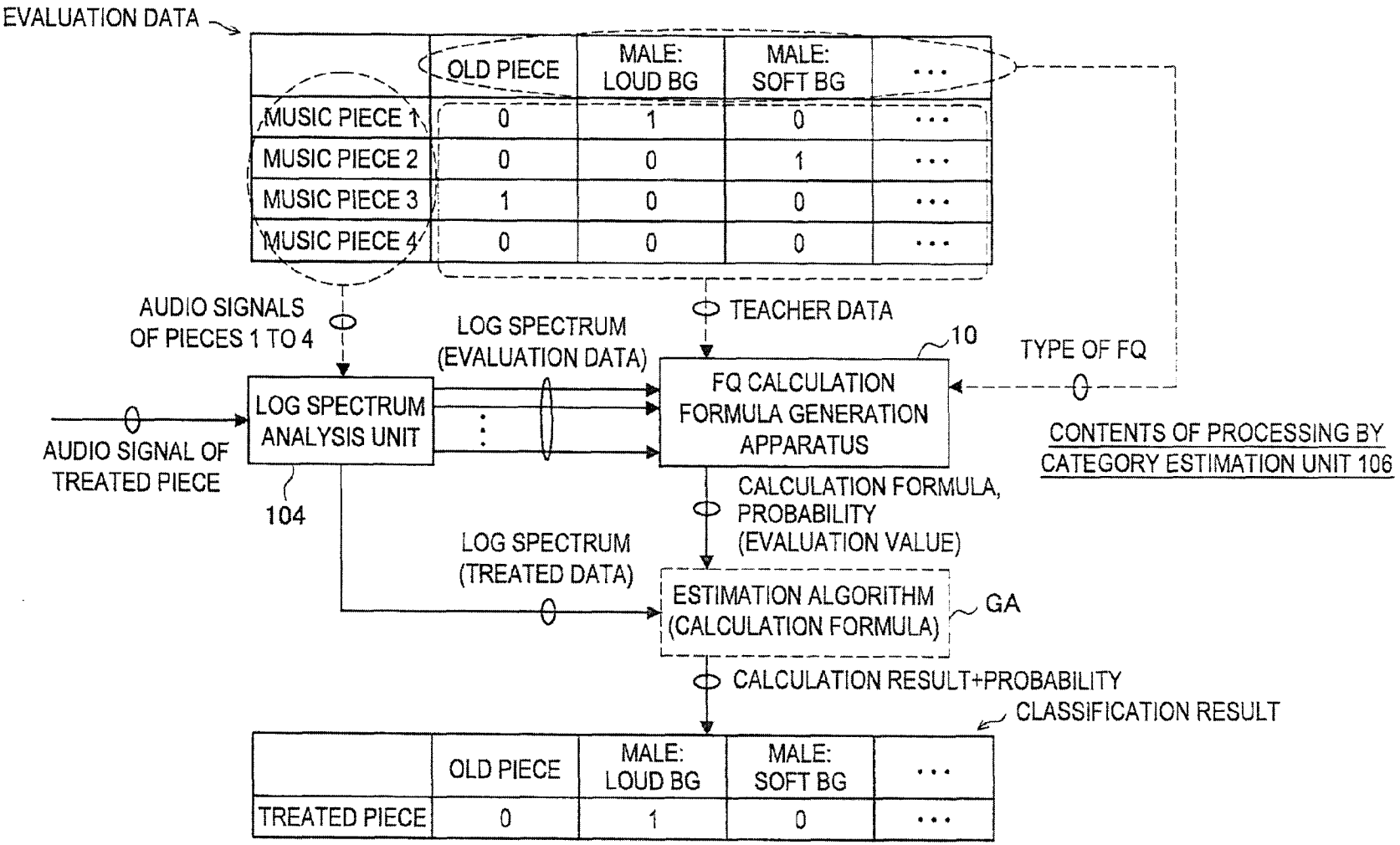
FIG. 7 is an explanatory diagram showing an example of a category estimation method according to the present embodiment.

The category estimation unit 106 performs processing as shown in FIG. 7 to estimate the music category. First, the category estimation unit 106 has a plurality of audio signals (music piece 1, . . . , music piece 4) for being used as evaluation data converted to log spectra by the log spectrum analysis unit 104. Then, the category estimation unit 106 inputs the log spectra of the plurality of audio signals (music piece 1, . . . , music piece 4) to the feature quantity calculation formula generation apparatus 10 as the evaluation data. Furthermore, the category of each audio signal (music piece 1, . . . , music piece 4) used as the evaluation data is given as a category value (0 or 1) as shown in FIG. 7. The category value 0 indicates non-correspondence, and the category value 1 indicates correspondence. For example, audio signal (music piece 1) does not correspond to the categories "old piece" and "male vocal, soft BG," and corresponds to "male vocal, loud BG." The category estimation unit 106 generates an estimation algorithm (calculation formula) for computing the category value as described by using the feature quantity calculation formula generation apparatus 10.

Therefore, the category estimation unit 106 inputs as teacher data the category value of each category at the same time as inputting as the evaluation data the log spectra of the plurality of audio signals (music piece 1, . . . , music piece 4), to the feature quantity calculation formula generation apparatus 10. Accordingly, the log spectra of the audio signals (music piece 1, . . . , music piece 4) as evaluation data and the category value of each category as teacher data are input to the feature quantity calculation formula generation apparatus 10. Moreover, a log spectrum of one music piece is used as the evaluation data corresponding to each audio signal. When the evaluation data and the teacher data as described are input, the feature quantity calculation formula generation apparatus 10 generates for each category a calculation formula GA for computing a category value for each category from the log spectrum of an arbitrary audio signal. At this time, the feature quantity calculation formula generation apparatus 10 simultaneously outputs an evaluation value (probability) output by each calculation formula GA which is finally output.

When the calculation formulae GAs for respective categories are generated by the feature quantity calculation formula generation apparatus 10, the category estimation unit 106 has the audio signal of a music piece actually desired to be classified (hereinafter, treated piece) converted to a log spectrum by the log spectrum analysis unit 104. Then, the category estimation unit 106 inputs the log spectrum of the treated piece to the calculation formulae GAs for respective categories generated by the feature quantity calculation formula generation apparatus 10, and computes the category value for each category for the treated piece. When the category value for each category is computed, the category estimation unit 106 classifies the treated piece into a category with the highest category value. The category estimation unit 106 may also be configured to take the probability by each calculation formula into consideration at the time of classification. In this case, the category estimation unit 106 computes the probability of the treated piece corresponding to each category (hereinafter, correspondence probability) by using the category values computed by the calculation formulae corresponding to respective categories and the probabilities by the calculation formulae. Then, the category estimation unit 106 assigns the treated piece into a category for which the correspondence probability is the highest. As a result, a classification result as illustrated in FIG. 7 is obtained. The classification result obtained in this manner is input to the pitch distribution estimation unit 108, the melody probability estimation unit 110 and the melody line determination unit 112 (refer to FIG. 2).

(2-5. Configuration Example of Pitch Distribution Estimation Unit 108)

Figure 8:
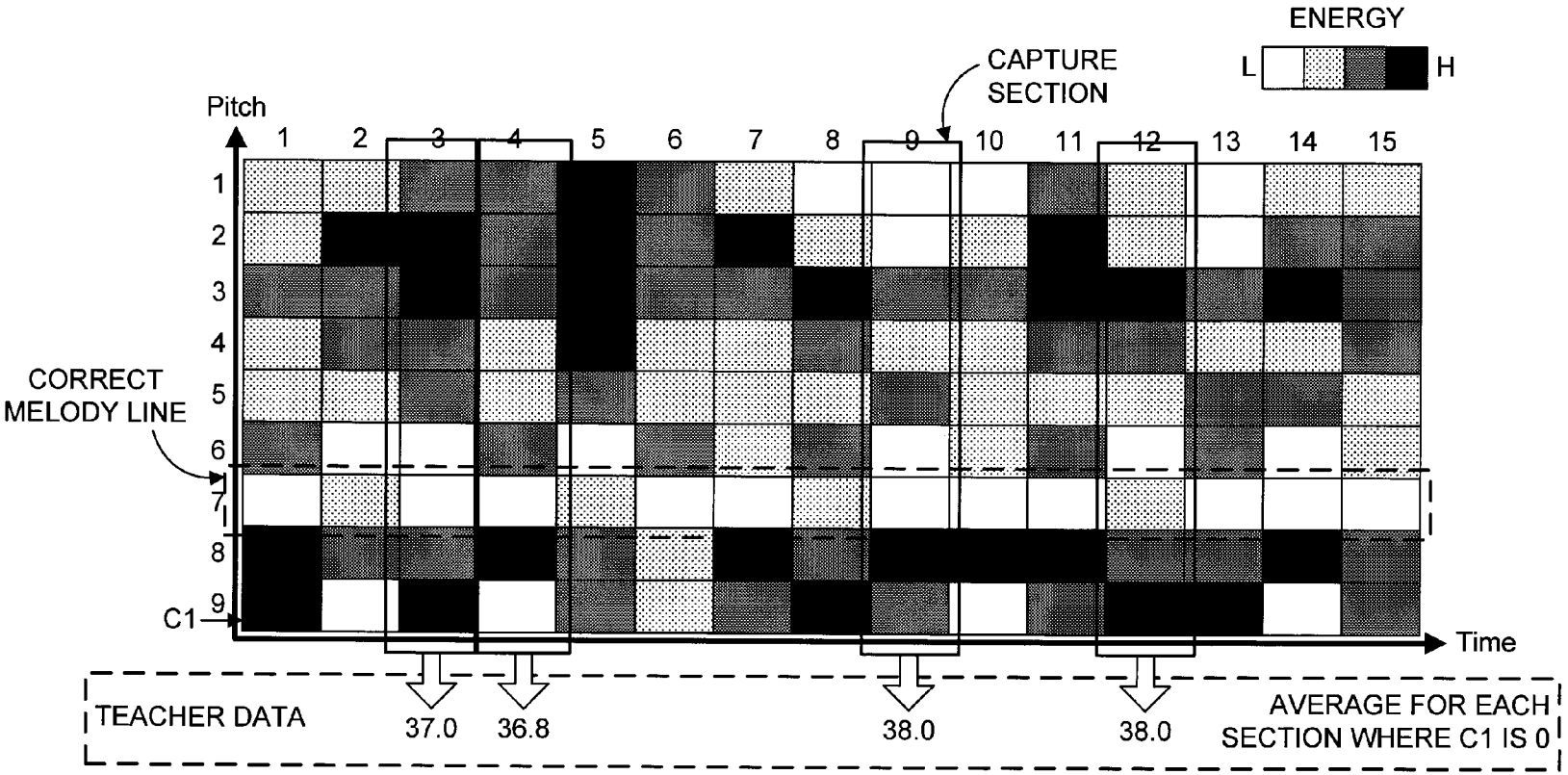
FIG. 8 is an explanatory diagram showing an example of a method of cutting out a log spectrum according to the present embodiment.
Figure 9:
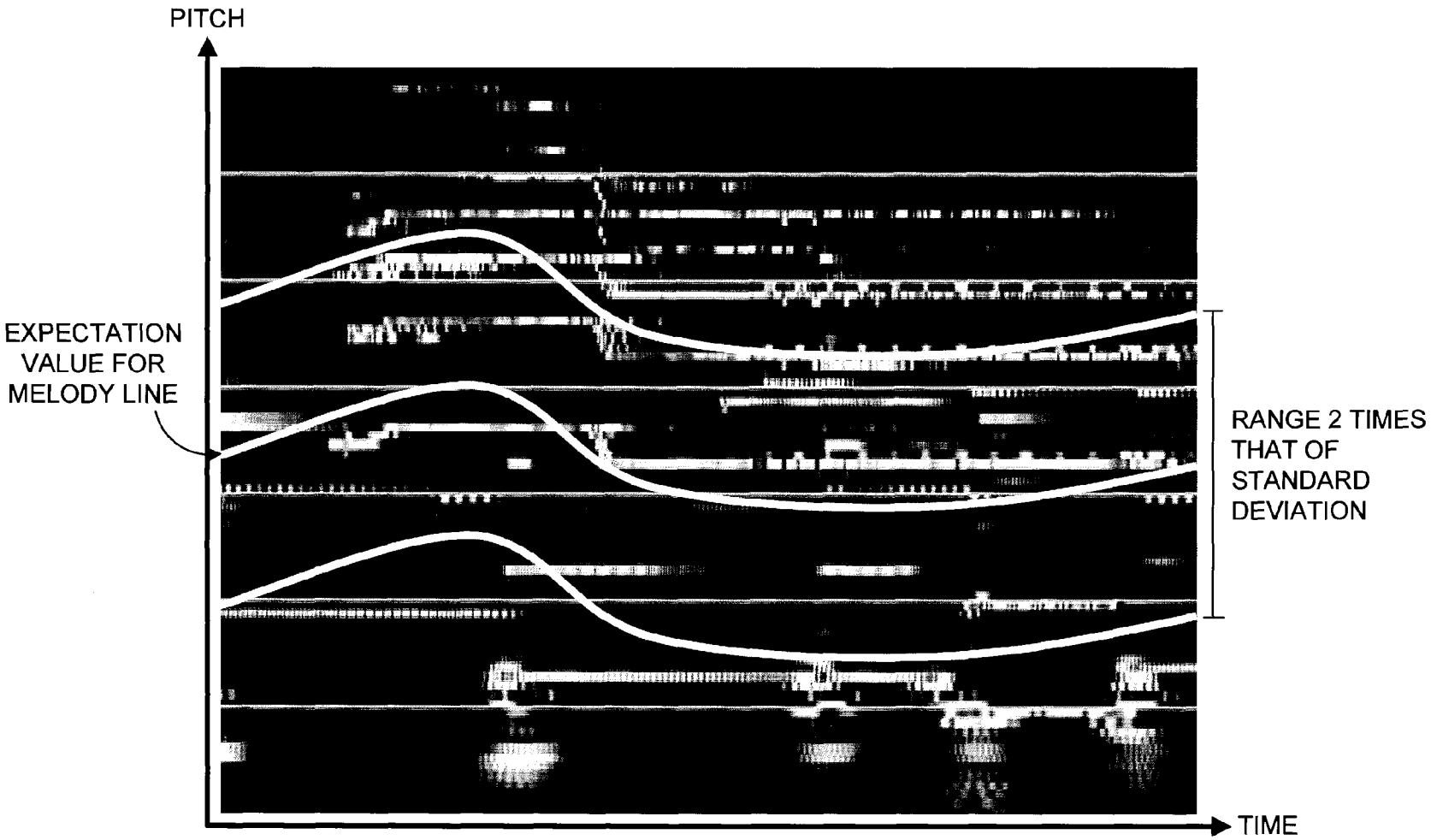
FIG. 9 is an explanatory diagram showing an example of an expectation value and a standard deviation of a melody line estimated by a distribution estimation method for a melody line according to the present embodiment.

Next, referring to FIGS. 8 and 9, the configuration of the pitch distribution estimation unit 108 will be described. The pitch distribution estimation unit 108 is means for automatically estimating the distribution of a melody line. The distribution of a melody line is expressed by an expectation value computed for each section of the melody line changing over time and a standard deviation computed for the whole music piece. To estimate the distribution of the melody line as described from a log spectrum, the pitch distribution estimation unit 108 generates a calculation formula for computing the expectation value for the melody line in each section by using the feature quantity calculation formula generation apparatus 10.

First, as with the category estimation unit 106, the pitch distribution estimation unit 108 inputs, as evaluation data, log spectra of a plurality of audio signals to the feature quantity calculation formula generation apparatus 10. Furthermore, the pitch distribution estimation unit 108 cuts out as teacher data the correct melody line of each audio signal for each section (refer to FIG. 8), and inputs the same to the feature quantity calculation formula generation apparatus 10. When the evaluation data and the teacher data are input in this manner, a calculation formula for computing the expectation value for the melody line in each section is output from the feature quantity calculation formula generation unit 10. Furthermore, the category estimation unit 106 computes, with respect to the log spectrum of each audio signal used as the evaluation data, the errors between output values computed by the calculation formula and the correct melody line used as the teacher data. Furthermore, the category estimation unit 106 computes the standard deviation of the melody line by approximating the obtained errors by the normal distribution. The range defined by the expectation value and the standard deviation of the melody line computed by the pitch distribution estimation unit 108 is expressed as the graph shown in FIG. 9, for example.

In this manner, the pitch distribution estimation unit 108 generates the calculation formula for estimating, from a section (time segment) of a log spectrum, the melody line in the section, by using the feature quantity calculation formula generation apparatus 10, and estimates the distribution of the melody line by using the calculation formula. At this time, the pitch distribution estimation unit 108 generates the calculation formula for each music category estimated by the category estimation unit 106. Then, the pitch distribution estimation unit 108 cuts out time segments from the log spectrum while gradually shifting time, and inputs the cut out log spectrum to the calculation formula and computes the expectation value and the standard deviation of the melody line. As a result, the estimation value for the melody line is computed for each section of the log spectrum. The estimation value for the melody line computed by the pitch distribution estimation unit 108 in this manner is input to the melody line determination unit 112 (refer to FIG. 2).

(2-6. Configuration Example of Melody Probability Estimation Unit 110)

Figure 10:
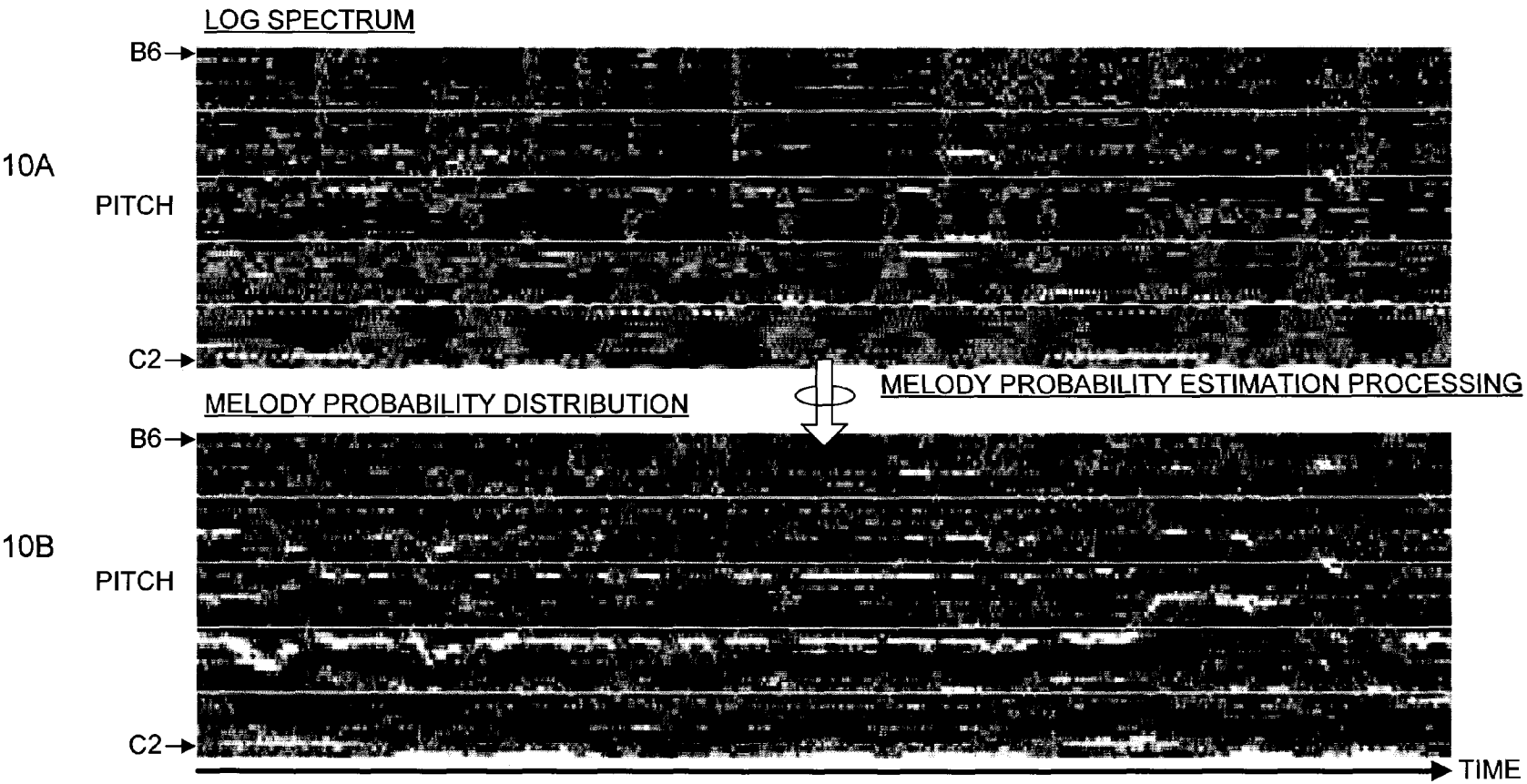
FIG. 10 is an explanatory diagram showing an example of a melody probability estimation method according to the present embodiment.
Figure 11:
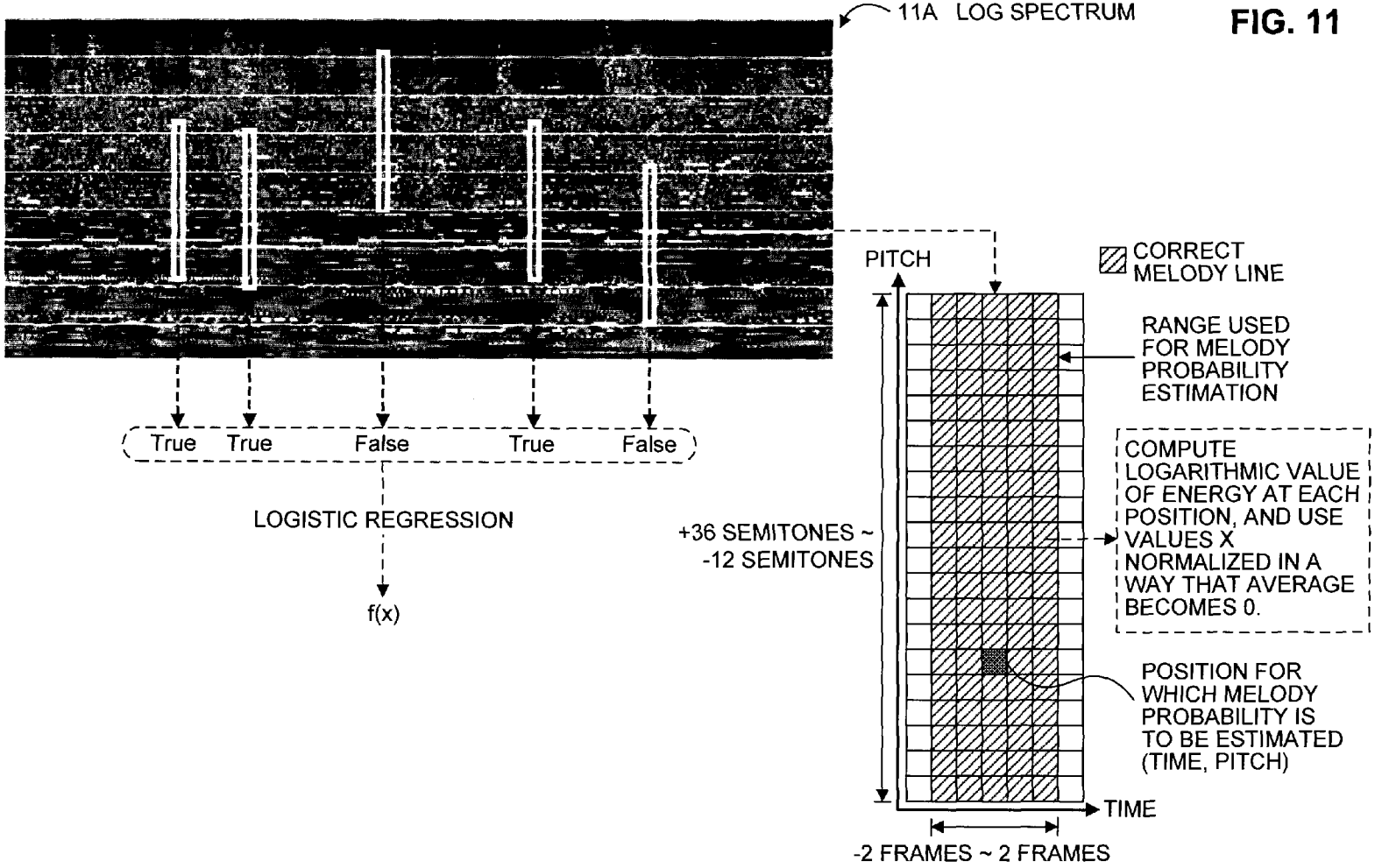
FIG. 11 is an explanatory diagram showing an example of the melody probability estimation method according to the present embodiment.

Next, referring to FIGS. 10 to 12, the configuration of the melody probability estimation unit 110 will be described. The melody probability estimation unit 110 is means for converting the log spectrum output from the log spectrum analysis unit 104 to a melody probability. For example, the melody probability estimation unit 110 converts the log spectrum shown in FIG. 10(A) to the melody probability distribution shown in FIG. 10(B). That is, the melody probability estimation unit 110 computes the melody probability at each coordinate position in the time-pitch space based on the log spectrum. The melody probability here means the probability of the value of the log spectrum at each coordinate position corresponding to the melody line. First, the melody probability estimation unit 110 performs a logistic regression by using the log spectrum of music data whose correct melody line is known in advance to estimate the melody probability at each coordinate position. A function f for computing the melody line from the log spectrum is obtained by this logistic regression. Then, the melody probability estimation unit 110 computes the melody probability distribution as shown in FIG. 10(B) by using the obtained function.

Here, referring to FIGS. 11 and 12, a generation method for the above-described function f and a computation method for the melody probability using the function f respectively of the melody probability estimation unit 110 will be described in detail. First, as shown in FIG. 11, in the time-pitch space defining the values for the log spectrum, the melody probability estimation unit 110 takes the coordinate position for which the melody probability is to be estimated (hereinafter, an estimation position) as a reference point and selects a range having a specific size (hereinafter, a reference range). For example, the melody probability estimation unit 110 selects, with each estimation position as a reference point, a reference range having −12 to +36 semitones in the pitch axis direction and −2 to +2 frames in the time axis direction. An example of the reference range selected by the melody probability estimation unit 110 is schematically shown in FIG. 11. In this example, the coordinate position plotted in black is the estimation position and the hatched part around the estimation position is the reference range.

When the reference range is selected for each estimation position in this manner, the melody probability estimation unit 110 computes the logarithmic value of a log spectrum value (energy) corresponding to each coordinate position in the selected reference range. Furthermore, the melody probability estimation unit 110 normalizes the logarithmic values for the respective coordinate positions in such a way that the average value of the logarithmic values computed for the respective coordinate positions within the reference range becomes 0. The logarithmic value x (in the example of FIG. 11, $x=(x_1, \ldots, x_{245})$; 49 pitches×5 frames) after the normalization is used for the generation processing for the function f(x) for estimating the melody probability. The generation processing for the function f(x) is performed by using a plurality of pieces of music data whose correct melody lines are given in advance (hereinafter, music data for learning). First, the melody probability estimation unit 110 uses the log spectra of the music data for learning and computes for each estimation position the logarithmic value x after normalization (hereinafter, normalized logarithmic value x). Furthermore, the melody probability estimation unit 110 decides whether or not the correct melody line is included in each reference range. In the following, in case the correct melody line is included in the reference range, the decision result will be expressed as True; and in case the correct melody line is not included in the reference range, the decision result will be expressed as False.

When the normalized logarithmic values x and the decision results are obtained, the melody probability estimation unit 110 uses these results and generates "a function f(x) for outputting, in case a normalization logarithmic value x is input, a probability of the decision result being True for a reference range corresponding to the normalized logarithmic value x." The melody probability estimation unit 110 can generate the function f(x) by using a logistic regression, for example. The logistic regression is a method for computing a coupling coefficient by a regression analysis, assuming that the logit of the probability of the decision result being True or False can be expressed by a linear coupling of input variables. For example, when expressing the input variable as $x=(x_1, \ldots, x_n)$, the probability of the decision result being True as P(True), and the coupling coefficient as $\beta_0, \ldots, \beta_n$, the logistic regression model is expressed as the following equation (7). When the following equation (7) is modified, the following equation (8) is obtained, and a function f(x) for computing the probability P(True) of the decision result True from the input variable x is obtained.

[Equation 6]

$$\log\left[\frac{P(\text{True})}{1-P(\text{True})}\right] = \beta_0 + \beta_1 x_1 + \ldots + \beta_n x_n \tag{7}$$

$$f(x) = P(\text{True}) = \frac{1}{1+\exp[-(\beta_0 + \beta_1 x_1 + \ldots + \beta_n x_n)]} \tag{8}$$

The melody probability estimation unit 110 inputs to the above equation (7) the normalized logarithmic value $x=(x_1, \ldots, x_{245})$ and the decision result obtained for each reference range from the music data for learning, and computes the coupling coefficients $\beta_0, \ldots, \beta_{245}$. With the coupling coefficients $\beta_0, \ldots, \beta_{245}$ determined in this manner, the function f(x) for computing from the normalized logarithmic value x the probability P(True) of the decision result being True is obtained. Since the function f(x) is a probability defined in the range of 0.0 to 1.0 and the number of pitches of the correct melody line at one time is 1, the function f(x) is normalized in such a way that the value totaled for the one time becomes 1. Also, the function f(x) is preferably generated for each music category. Thus, the melody probability estimation unit 110 computes the function f(x) for each category by using the music data for learning given for each category.

After generating the function f(x) for each category by such a method, when the log spectrum of treated piece data is input, the melody probability estimation unit 110 selects a function f(x), taking the category input from the category estimation unit 106 for the treated piece data into consideration. For example, in case the treated piece is classified as "old piece," a function f(x) obtained from the music data for learning for "old piece" is selected. Then, the melody probability estimation unit 110 computes the melody probability by the selected function f(x) after having converted the log spectrum value of the treated piece data to a normalized logarithmic value x. When the melody probability is computed by the melody probability estimation unit 110 for each coordinate position in the time-pitch space, the melody probability distribution as shown in FIG. 10(B) is obtained. The melody probability distribution obtained in this manner is input to the melody line determination unit 112 (refer to FIG. 2).

(Flow of Function f(x) Generation Processing)

Figure 12:
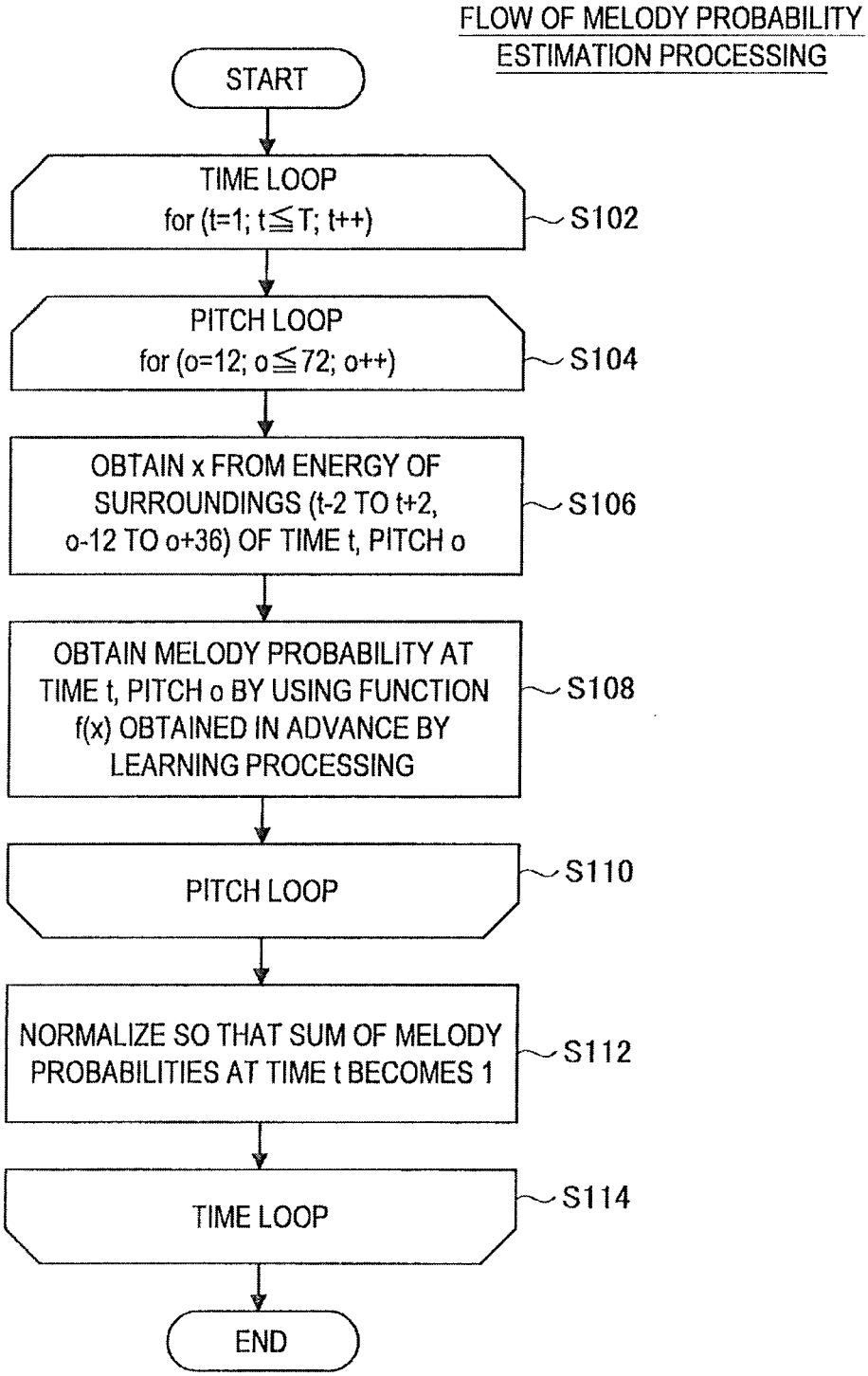
FIG. 12 is an explanatory diagram showing an example of the melody probability estimation method according to the present embodiment.

Here, referring to FIG. 12, a flow of processing of the function f(x) generation method of the melody probability estimation unit 110 will be briefly described.

As shown in FIG. 12, first, the melody probability estimation unit 110 starts a loop processing for the time axis direction (S102). At this time, a time t (frame number t) indicating the estimation position in the time axis direction is set. Then, the melody probability estimation unit 110 starts a loop processing for the pitch axis direction (S104). At this time, a pitch o indicating the estimation position in the pitch axis direction is set. Then, the melody probability estimation unit 110 obtains the normalized logarithmic values x for the reference range for the estimation position indicated by the time t and the pitch o set in steps S102 and S104 (S106). For example, the surroundings (t−2 to t+2, o−12 to o+36) of the estimation position (t, o) are selected as the reference range, and the normalized logarithmic values $x=\{x(t+\Delta t, o+\Delta o); -2\leq\Delta t\leq 2, -12\leq o\leq 36\}$ are computed. Next, the melody probability estimation unit 110 computes the melody probability at the time t and the pitch o by using the function f(x) obtained in advance by a learning process by using the music data for learning (S108).

The melody probability of the estimation position indicated by the time t and the pitch o is estimated by steps S106 and S108. Now, the melody probability estimation unit 110 returns to the process of step S104 (S110), and increments the pitch o of the estimation position by 1 semitone and repeats the processes of steps S106 and S108. The melody probability estimation unit 110 performs the processes of steps S106 and S108 for a specific pitch range (for example, o=12 to 72) by incrementing the pitch o of the estimation position by 1 semitone at a time. After the processes of steps S106 and S108 are performed for the specific pitch range, the melody probability estimation unit 110 proceeds to the process of step S112.

In step S112, the melody probability estimation unit 110 normalizes the melody probabilities at the time t so that the sum of the melody probabilities becomes 1 (S112). That is, with respect to the time t of the estimation position set in step S102, the melody probability for each pitch o is normalized in step S112 in such a way that the sum of the melody probabilities computed for the specific pitch range becomes 1. Then, the melody probability estimation unit 110 returns to the process of step S102 (S114), and repeats the processes of steps S104 to S112 after incrementing the time t of the estimation position by 1 frame. The melody probability estimation unit 110 performs the processes of steps S104 to S112 for a specific time range (for example, t=1 to T) by incrementing the time t of the estimation position by 1 frame at a time. After the processes of steps S104 to S112 are performed for the specific time range, the melody probability estimation unit 110 ends the estimation process for the melody probability.

(2-7. Configuration Example of Melody Line Determination Unit 112)

Figure 13:
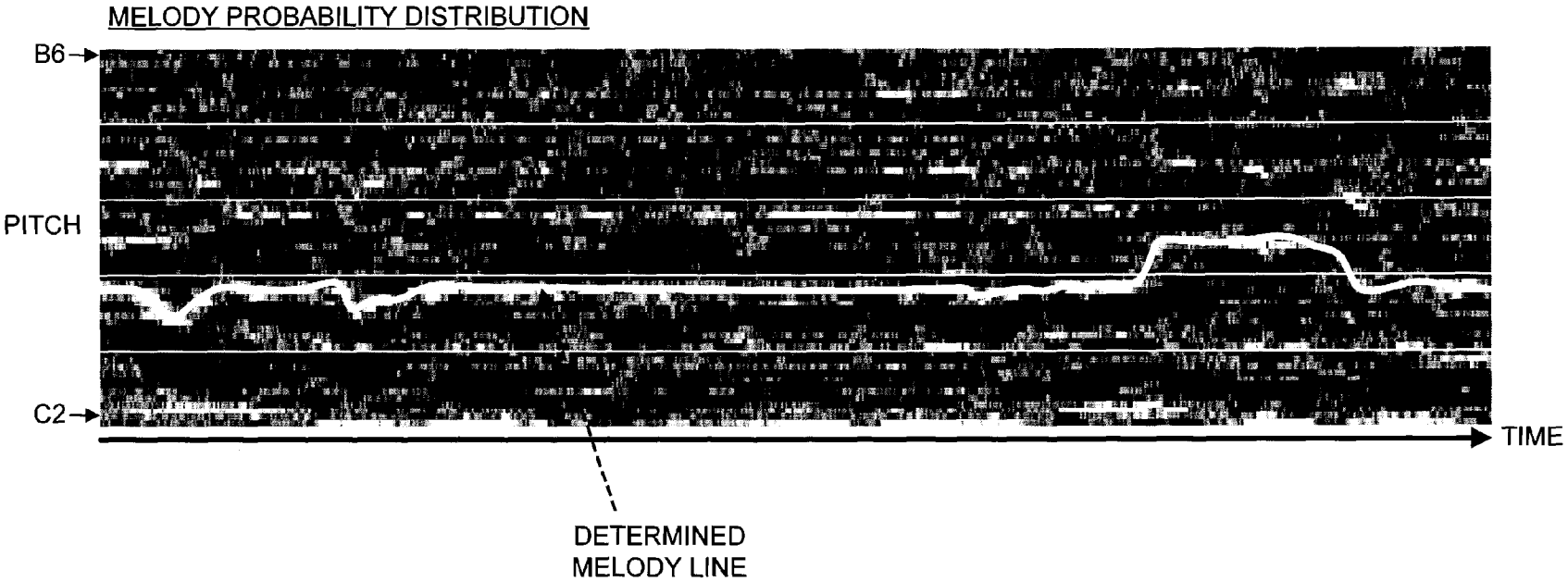
FIG. 13 is an explanatory diagram showing an example of a melody line determination method.

Next, referring to FIGS. 13 to 15, the configuration of the melody line determination unit 112 will be described. The melody line determination unit 112 is means for determining a likely melody line based on the melody probability estimated by the melody probability estimation unit 110 and the expectation value, standard deviation and the like of the melody line that are estimated by the pitch distribution estimation unit 108. To determine the likely melody line, the melody line determination unit 112 performs a process of searching for a path with the highest melody probability in the time-pitch space. For the path search to be performed, $P(o|W_t)$ computed by the pitch distribution estimation unit 108 and probabilities $p(\Delta o)$ and $p(n_t|n_{t-1})$ shown below are used. As already described, the probability $P(o|W_t)$ is the probability of the melody being at a pitch o at a certain time t.

First, the melody line determination unit 112 computes the rate of appearance of pitch transition whose change amount $\Delta o$ at the correct melody line of each music data. After computing the appearance rate of each pitch transition $\Delta o$ for a number of pieces of music data, the melody line determination unit 112 computes, for each pitch transition $\Delta o$, the average value and the standard deviation for the appearance rate for all the pieces of music data. Then, by using the average value and the standard deviation for the appearance rate relating to each pitch transition $\Delta$ that are computed in the manner described above, the melody line determination unit 112 approximates the probabilities $p(\Delta o)$ by a Gaussian distribution having the average value and the standard deviation.

Next, explanation will be given on the probability $p(n_t|n_{t-1})$. The probability $p(n_t|n_{t-1})$ indicates a probability reflecting the transition direction at the time of transition from a pitch $n_{t-1}$ to a pitch $n_t$. The pitch $n_t$ takes any of the values Cdown, C#down, Bdown, Cup, C#up, Bup. Here, "down" means that the pitch goes down, and "up" means that the pitch goes up. On the other hand, $n_{t-1}$ does not take the going up or down of the pitch into consideration, and takes any of the values C, C#, . . . , B. For example, the probability p(Dup|C) indicates the probability of the pitch C going up to the pitch D. The probability $(n_t|n_{t-1})$ is used by shifting an actual key (for example, D) to a specific key (for example, C). For example, in case the current key is D and the specific key is C, a probability p(Gdown|E) is referred to for the transition probability of F#→Adown because F# is changed to E and A is changed to G due to the shifting of the keys.

Also for the probability $p(n_t|n_{t-1})$, as in the case of the probability $p(\Delta o)$, the melody line determination unit 112 computes the rate of appearance of each pitch transition $n_{t-1}\rightarrow n_t$ in the correct melody line of each music data. After computing the appearance rate for each pitch transition $n_{t-1}\rightarrow n_t$ for a number of pieces of music data, the melody line determination unit 112 computes, for each pitch transition $n_{t-1}\rightarrow n_t$, the average value and the standard deviation for the appearance rate for all the pieces of music data. Then, by using the average value and the standard deviation for the appearance rate relating to each pitch transition $n_{t-1}\rightarrow n_t$ that are computed in the manner described above, the melody line determination unit 112 approximates the probabilities $p(n_t|n_{t-1})$ by a Gaussian distribution having the average value and the standard deviation.

Figure 14:
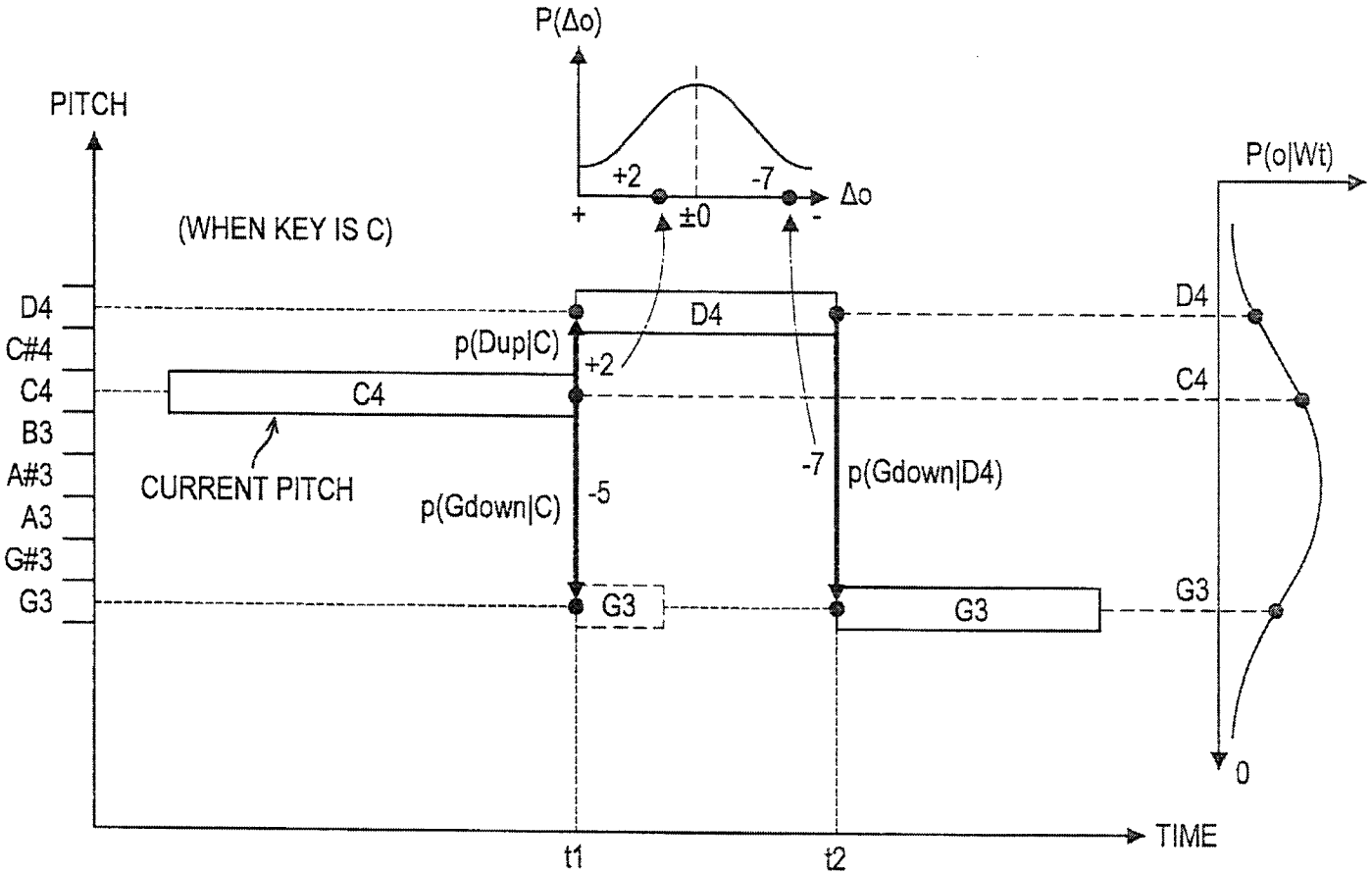
FIG. 14 is an explanatory diagram showing an example of the melody line determination method.
Figure 15:
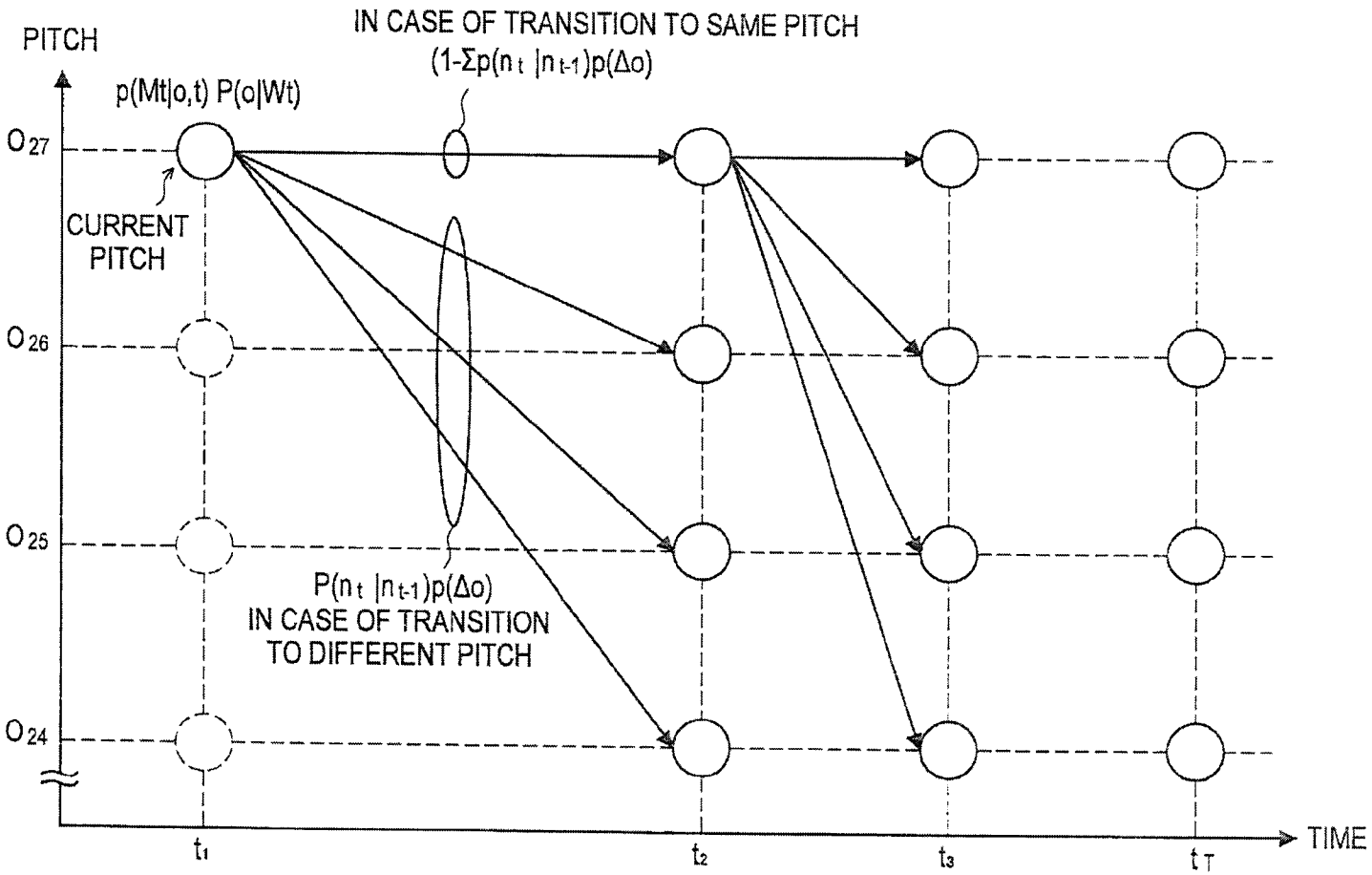
FIG. 15 is an explanatory diagram showing an example of the melody line determination method.

These probabilities are conceptually shown in FIG. 14. In the example of FIG. 14, the current pitch of the melody line is C4. In case of transition of pitch of the melody line at time $t_1$, the probabilities $p(\Delta o)$ and $p(n_t|n_{t-1})$ are referred to. For example, in case of transition from pitch C4 to pitch D4, the difference between the pitches is +2 semitones. Also, in the example of FIG. 14, the transition is to a higher pitch in the same octave. Accordingly, probability $p(\Delta o=+2)$ and probability p(Dup|C) are referred to. On the other hand, in case of transition from pitch C4 to pitch G3, the difference between the pitches is −5 semitones. Also, in the example of FIG. 14, the transition is to a lower pitch in the lower octave. Accordingly, probability $p(\Delta o=-2)$ and probability p(Gdown|C) are referred to. Similarly, in case of transition of melody to pitch D4 at time $t_1$ and then to pitch G3 at time $t_2$, probability $p(\Delta o=-7)$ and probability p(Gdown|D) are referred to. Furthermore, as the probability of each of pitches C4, D4 and G3, probability $P(o|W_t)$ is referred to.

The melody line is determined by using the probabilities $P(o|W_t)$, $p(\Delta o)$ and $p(n_t|n_{t-1})$ obtained in the above-described manner. However, to use the probability $p(n_t|n_{t-1})$, the key of music data for which the melody line is to be estimated becomes necessary. Accordingly, the melody line determination unit 112 detects the key of music data by using the key detection unit 118. The configuration of the key detection unit 118 will be described later. Here, the determination method of the melody line will be described, assuming that the key of music data is already given.

The melody line determination unit 112 determines the melody line by using a Viterbi search. The Viterbi search itself is a well-known path search method based on hidden Markov model. In addition to the probabilities $P(o|W_t)$, $p(\Delta o)$ and $p(n_t|n_{t-1})$, the melody probability estimated by the melody probability estimation unit 110 for each estimation position is used for the Viterbi search by the melody line determination unit 112. In the following, the melody probability at time t and pitch o will be expressed as p(Mt|o,t). Using these probabilities, probability P(o,t) of the pitch o at a certain time point t being the melody is expressed as the following equation (9). Probability $P(t+\Delta t,o|t,o)$ of transition from the pitch o to the same pitch o is expressed as the following equation (10). Furthermore, probability $P(t+\Delta t,o+\Delta o|t,o)$ of transition from the pitch o to a different pitch $o+\Delta o$ is expressed as the following equation (11).

[Equation 7]

$$P(o,t)=p(Mt|o,t)P(o|W_t) \tag{9}$$

$$P(o,t+\Delta t|o,t)=(1-\Sigma p(n_t|n_{t-1}))p(\Delta o) \tag{10}$$

$$P(o+\Delta o,t+\Delta t|o,t)=p(n_t|n_{t-1})p(\Delta o) \tag{11}$$

When using these expressions, probability $P(q_1,q_2)$ for a case of shifting from a node $q_1$ (time $t_1$, pitch $o_{27}$) to a node $q_2$ (time $t_2$, pitch $o_{26}$) is expressed as $P(q_1,q_2)=p(n_{t2}|n_{t1})p(\Delta o=-1)p(M1|o_{27},t_1)p(o_{27}|W_{t1})$. A path for which the probability expressed as above is the largest throughout the music piece is extracted as the likely melody line. Here, the logarithmic value of probability for each Viterbi path is made to the reference for the path search. For example, sum of logarithmic values such as $\log(p(n_{t2}|n_{t1}))+\log(p(\Delta o=-1))+\log(p(M1|o_{27,t1}))+\log(p(o_{27}|W_{t1}))$ will be used for $\log(P)(q_1,q_2)$).

Furthermore, the melody line determination unit 112 may be configured to use as the reference for Viterbi search a summed weighted logarithmic value obtained by performing weighting on respective types of the probabilities, instead of simply using the sum of the logarithmic values as the reference. For example, the melody line determination unit 112 takes as the reference for Viterbi search $\log(p(Mt|o,t)$, $b_1*\log(p(o|Wt))$ of a passed-through node and $b_2*\log(p_{mt}|n_{t-1})$ and $b_3*\log(p(\Delta o))$ of transition between passed-through nodes by summing up the same. Here, b1, b2 and b3 are weight parameters given for each type of probability. That is, the melody line determination unit 112 calculates the above-described summed weighted logarithmic value for throughout the music piece and extracts a path for which the summed logarithmic value is the largest. The path extracted by the melody line determination unit 112 is determined to be the melody line.

Moreover, the probabilities and the weight parameters used for the Viterbi search are preferably different depending on the music category estimated by the category estimation unit 106. For example, for the Viterbi search for a melody line of a music piece classified as "old piece," it is preferable that probabilities obtained from a large number of "old pieces" for which the correct melody lines are given in advance and parameters tuned for "old piece" are used. The melody line determined by the melody line determination unit 112 in this manner is input to the smoothing unit 114 (refer to FIG. 2).

(2-8. Configuration Example of Smoothing Unit 114)

Next, the configuration of the smoothing unit 114 will be described. The smoothing unit 114 is means for smoothing, for each section determined by beats of the music piece, the melody line determined by the melody line determination unit 112. The beats of music data are detected by the beat detection unit 116. The configuration of the beat detection unit 116 will be described later. For example, when beats are detected by the beat detection unit 116, the smoothing unit 114 performs voting for the melody line for each eighth note, and takes the most frequently appearing pitch as the melody line. A beat section may include a plurality of pitches as the melody line. Therefore, the smoothing unit 114 detects for each beat section the appearance frequencies of pitches determined to be the melody line, and smoothes the pitches of each beat section by the most frequently appearing pitch. The pitch smoothed for each beat section in this manner is output to the outside as the melody line.

(2-9. Configuration Examples of Beat Detection Unit 116 and Key Detection Unit 118)

The configurations of the beat detection unit 116 and the key detection unit 118 which are yet to be described will be described below. The configuration example of the chord probability detection unit 120 for computing the chord probability to be used in the key detection process by the key detection unit 118 will also be described here. As described later, a processing result by the chord probability detection unit 120 will be necessary for the processing by the key detection unit 118. Also, a processing result of the beat detection unit 116 will be necessary for the processing by the chord probability detection unit 120. Accordingly, explanation will be made in the order of the beat detection unit 116, the chord probability detection unit 120 and the key detection unit 118.

(2-9-1. Configuration Example of Beat Detection Unit 116)

Figure 16:
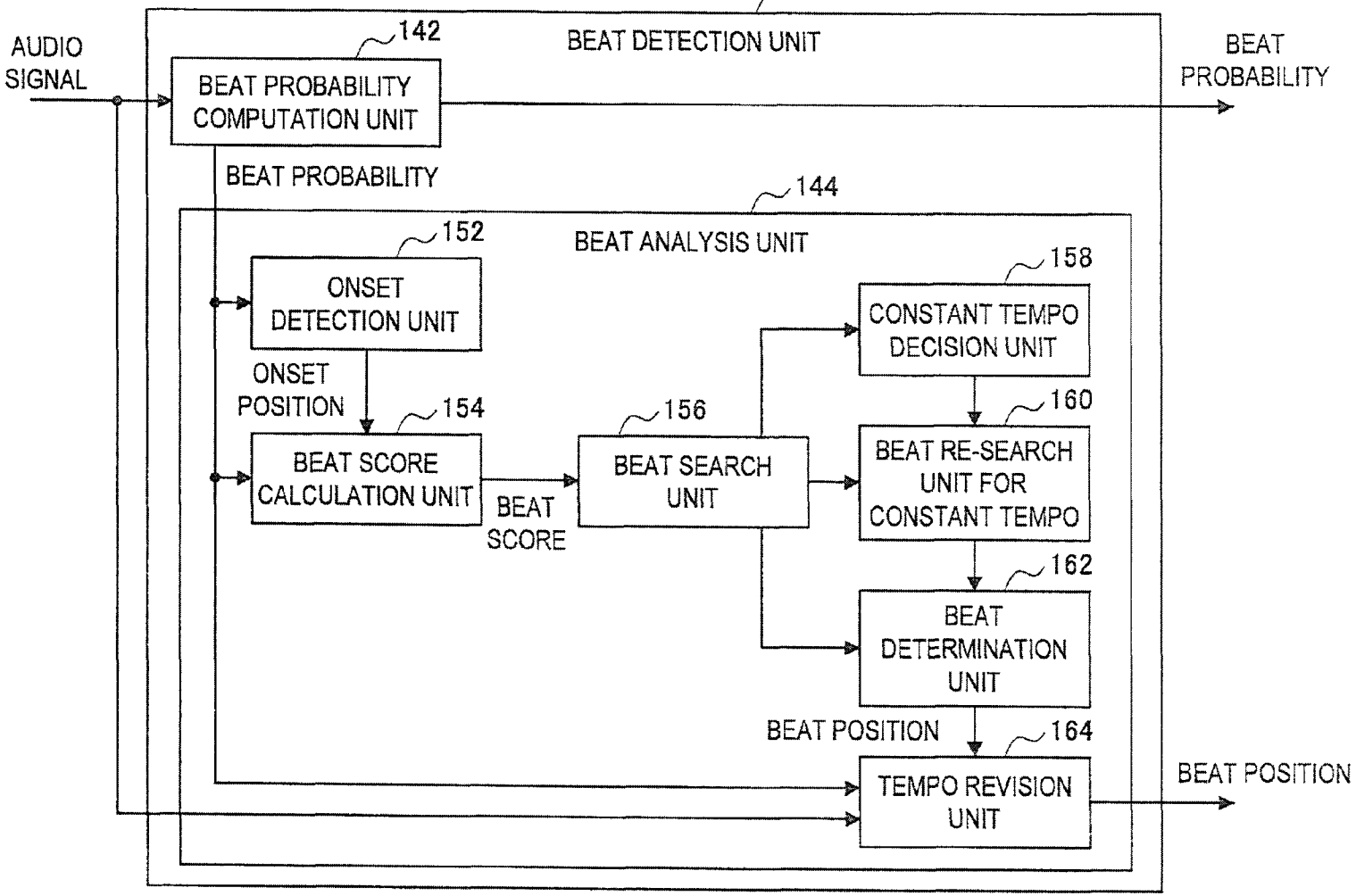
FIG. 16 is an explanatory diagram showing a detailed functional configuration example of a beat detection unit for detecting beats used by the melody line determination method according to the present embodiment.

First, the configuration of the beat detection unit 116 will be described. As described above, the processing result of the beat detection unit 116 is used for processing by the chord probability detection unit 120 and processing for detecting the beats of a music piece to be used by the smoothing unit 114. As shown in FIG. 16, the beat detection unit 116 is configured from a beat probability computation unit 142 and a beat analysis unit 144. The beat probability computation unit 142 is means for computing the probability of each frame being a beat position, based on the log spectrum of music data. Also, the beat analysis unit 144 is means for detecting the beat positions based on the beat probability of each frame computed by the beat probability computation unit 142. In the following, the functions of these structural elements will be described in detail.

Figure 17:
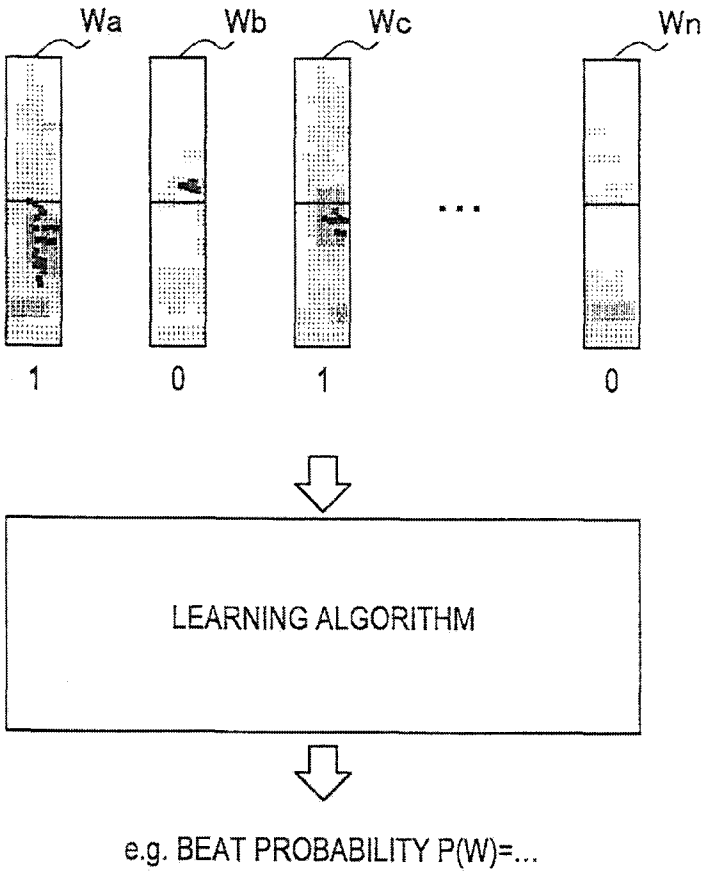
FIG. 17 is an explanatory diagram showing an example of a beat detection method according to the present embodiment.

First, the beat probability computation unit 142 will be described. The beat probability computation unit 142 computes, for each of specific time units (for example, 1 frame) of the log spectrum input from the log spectrum analysis unit 104, the probability of a beat being included in the time unit (hereinafter referred to as "beat probability"). Moreover, when the specific time unit is 1 frame, the beat probability may be considered to be the probability of each frame coinciding with a beat position (position of a beat on the time axis). A formula to be used by the beat probability computation unit 142 to compute the beat probability is generated by using the learning algorithm by the feature quantity calculation formula generation apparatus 10. Also, data such as those shown in FIG. 17 are given to the feature quantity calculation formula generation apparatus 10 as the teacher data and evaluation data for learning. In FIG. 17, the time unit used for the computation of the beat probability is 1 frame.

As shown in FIG. 17, fragments of log spectra (hereinafter referred to as "partial log spectrum") which has been converted from an audio signal of a music piece whose beat positions are known and beat probability for each of the partial log spectra are supplied to the feature quantity calculation formula generation apparatus 10. That is, the partial log spectrum is supplied to the feature quantity calculation formula generation apparatus 10 as the evaluation data, and the beat probability as the teacher data. Here, the window width of the partial log spectrum is determined taking into consideration the trade-off between the accuracy of the computation of the beat probability and the processing cost. For example, the window width of the partial log spectrum may include 7 frames preceding and following the frame for which the beat probability is to be calculated (i.e. 15 frames in total).

Furthermore, the beat probability supplied as the teacher data indicates, for example, whether a beat is included in the centre frame of each partial log spectrum, based on the known beat positions and by using a true value (1) or a false value (0). The positions of bars are not taken into consideration here, and when the centre frame corresponds to the beat position, the beat probability is 1; and when the centre frame does not correspond to the beat position, the beat probability is 0. In the example shown in FIG. 17, the beat probabilities of partial log spectra Wa, Wb, Wc, . . . , Wn are given respectively as 1, 0, 1, . . . , 0. A beat probability formula (P(W)) for computing the beat probability from the partial log spectrum is generated by the feature quantity calculation formula generation apparatus 10 based on a plurality of sets of evaluation data and teacher data. When the beat probability formula P(W) is generated in this manner, the beat probability computation unit 142 cuts out from a log spectrum of treated music data a partial log spectrum for each frame, and sequentially computes the beat probabilities by applying the beat probability formula P(W) to respective partial log spectra.

Figure 18:
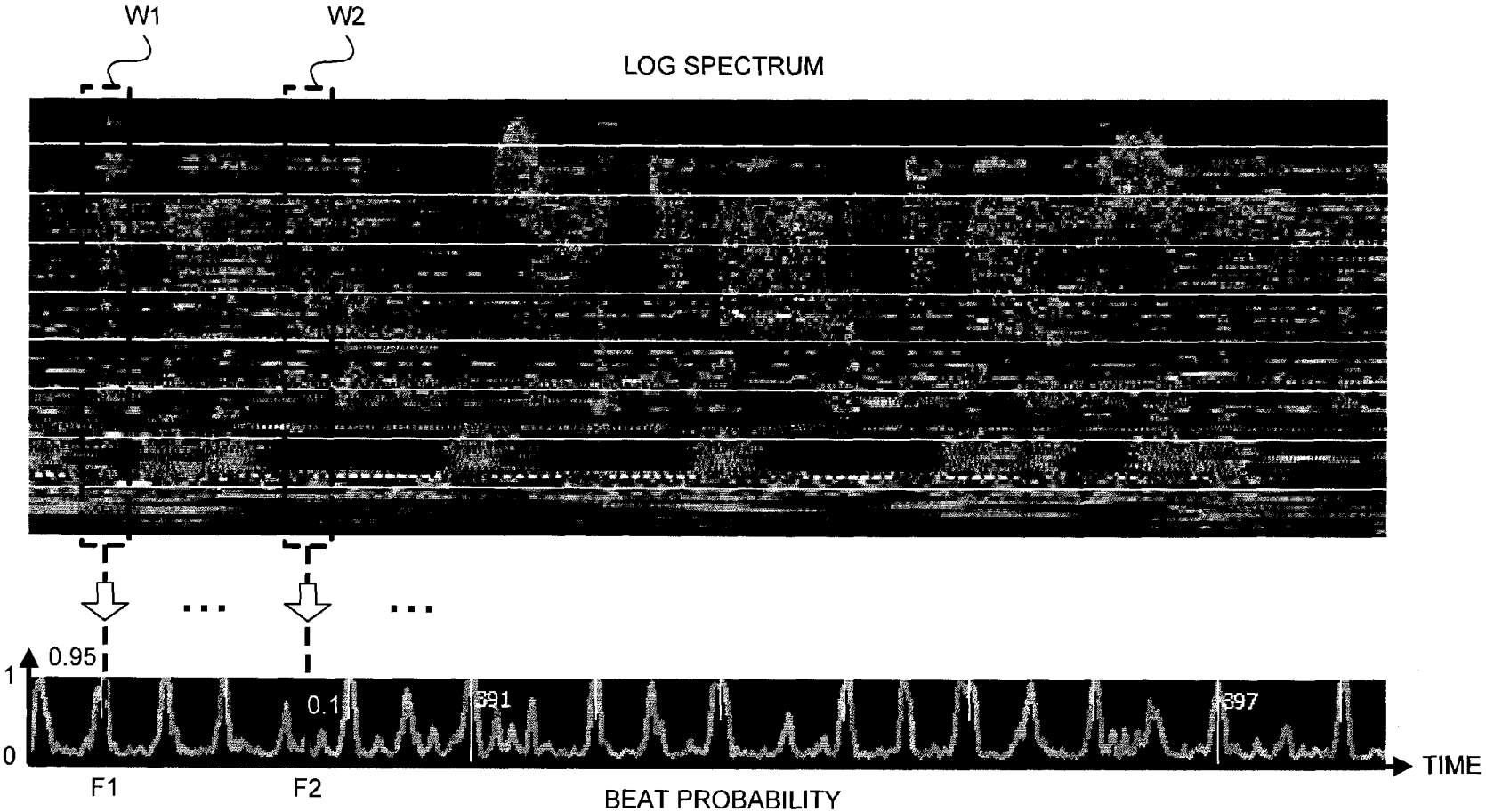
FIG. 18 is an explanatory diagram showing an example of the beat detection method according to the present embodiment.

FIG. 18 is an explanatory diagram showing an example of the beat probability computed by the beat probability computation unit 142. An example of the log spectrum to be input to the beat probability computation unit 142 from the log spectrum analysis unit 104 is shown in FIG. 18(A). On the other hand, in FIG. 18(B), the beat probability computed by the beat probability computation unit 142 based on the log spectrum (A) is shown with a polygonal line on the time axis. For example, referring to a frame position F1, it can be seen that a partial log spectrum W1 corresponds to the frame position F1. That is, beat probability P(W1)=0.95 of the frame F1 is computed from the partial log spectrum W1. Similarly, beat probability P(W2) of a frame position F2 is calculated to be 0.1 based on a partial log spectrum W2 cut out from the log spectrum. The beat probability P(W1) of the frame position F1 is high and the beat probability P(W2) of the frame position F2 is low, and thus it can be said that the possibility of the frame position F1 corresponding to a beat position is high, and the possibility of the frame position F2 corresponding to a beat position is low.

Moreover, the beat probability formula used by the beat probability computation unit 142 may be generated by another learning algorithm. However, it should be noted that, generally, the log spectrum includes a variety of parameters, such as a spectrum of drums, an occurrence of a spectrum due to utterance, and a change in a spectrum due to change of chord. In case of a spectrum of drums, it is highly probable that the time point of beating the drum is the beat position. On the other hand, in case of a spectrum of voice, it is highly probable that the beginning time point of utterance is the beat position. To compute the beat probability with high accuracy by collectively using the variety of parameters, it is suitable to use the feature quantity calculation formula generation apparatus 10 or the learning algorithm disclosed in JP-A-2008-123011. The beat probability computed by the beat probability computation unit 142 in the above-described manner is input to the beat analysis unit 144.

The beat analysis unit 144 determines the beat position based on the beat probability of each frame input from the beat probability computation unit 142. As shown in FIG. 16, the beat analysis unit 144 includes an onset detection unit 152, a beat score calculation unit 154, a beat search unit 156, a constant tempo decision unit 158, a beat re-search unit 160 for constant tempo, a beat determination unit 162, and a tempo revision unit 164. The beat probability of each frame is input from the beat probability computation unit 142 to the onset detection unit 152, the beat score calculation unit 154 and the tempo revision unit 164.

Figure 19:
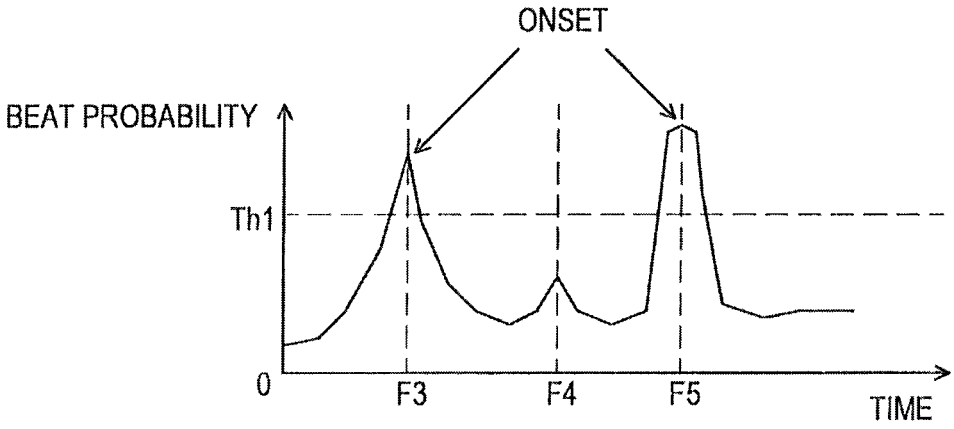
FIG. 19 is an explanatory diagram showing an example of the beat detection method according to the present embodiment.

The onset detection unit 152 detects onsets included in the audio signal based on the beat probability input from the beat probability computation unit 142. The onset here means a time point in an audio signal at which a sound is produced. More specifically, a point at which the beat probability is above a specific threshold value and takes a maximal value is referred to as the onset. For example, in FIG. 19, an example of the onsets detected based on the beat probability computed for an audio signal is shown. In FIG. 19, as with FIG. 18(B), the beat probability computed by the beat probability computation unit 142 is shown with a polygonal line on the time axis. In case of the graph for the beat probability illustrated in FIG. 19, the points taking a maximal value are three points, i.e. frames F3, F4 and F5. Among these, regarding the frames F3 and F5, the beat probabilities at the time points are above a specific threshold value Th1 given in advance. On the other hand, the beat probability at the time point of the frame F4 is below the threshold value Th1. In this case, two points, i.e. the frames F3 and F5, are detected as the onsets.

Figure 20:
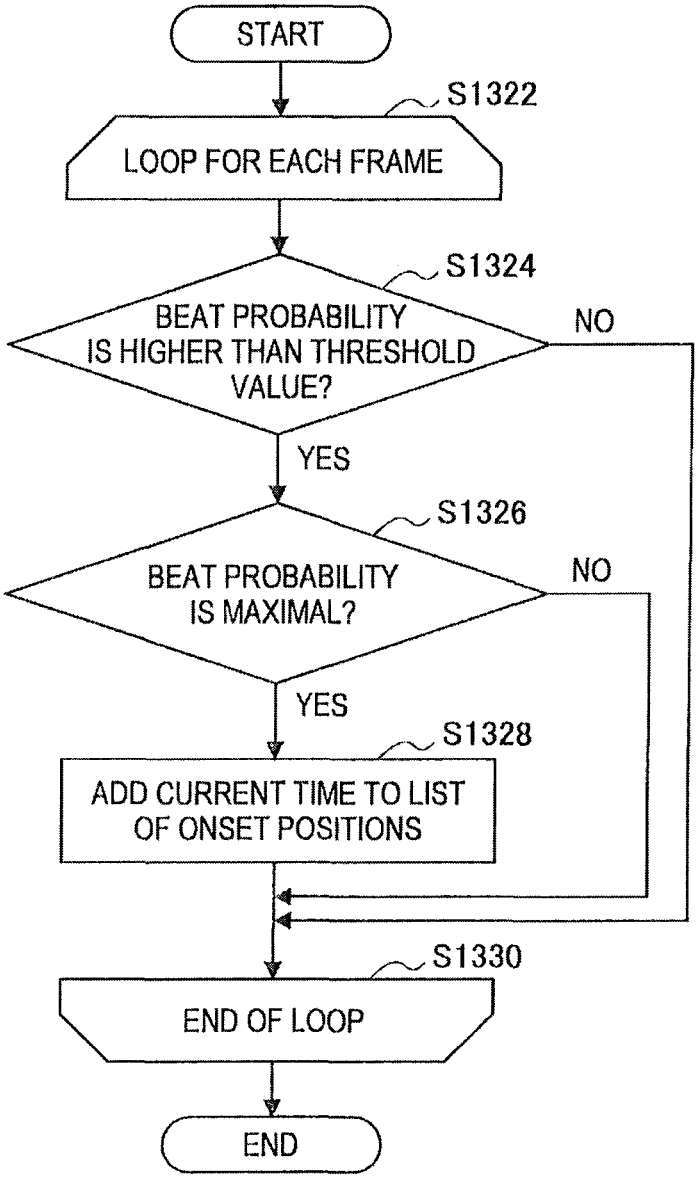
FIG. 20 is an explanatory diagram showing an example of the beat detection method according to the present embodiment.

Here, referring to FIG. 20, an onset detection process flow of the onset detection unit 152 will be briefly described. As shown in FIG. 20, first, the onset detection unit 152 sequentially executes a loop for the frames, starting from the first frame, with regard to the beat probability computed for each frame (S1322). Then, the onset detection unit 152 decides, with respect to each frame, whether the beat probability is above the specific threshold value (S1324), and whether the beat probability indicates a maximal value (S1326). Here, when the beat probability is above the specific threshold value and the beat probability is maximal, the onset detection unit 152 proceeds to the process of step S1328. On the other hand, when the beat probability is below the specific threshold value, or the beat probability is not maximal, the process of step S1328 is skipped. At step S1328, current times (or frame numbers) are added to a list of the onset positions (S1328). Then, when the processing regarding all the frames is over, the loop of the onset detection process is ended (S1330).

Figure 21:
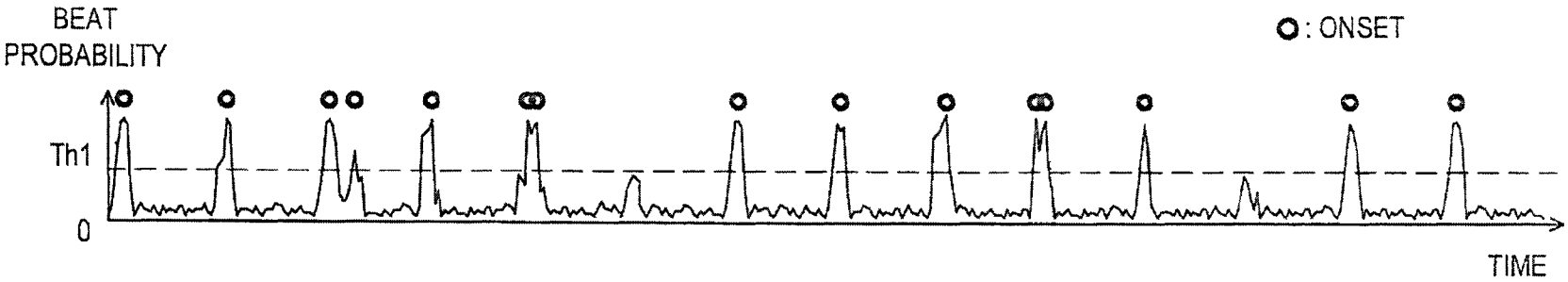
FIG. 21 is an explanatory diagram showing an example of the beat detection method according to the present embodiment.

With the onset detection process by the onset detection unit 152 as described above, a list of the positions of the onsets included in the audio signal (a list of times or frame numbers of respective onsets) is generated. Also, with the above-described onset detection process, positions of onsets as shown in FIG. 21 are detected, for example. FIG. 21 shows the positions of the onsets detected by the onset detection unit 152 in relation to the beat probability. In FIG. 21, the positions of the onsets detected by the onset detection unit 152 are shown with circles above the polygonal line showing the beat probability. In the example of FIG. 21, maximal values with the beat probabilities above the threshold value Th1 are detected as 15 onsets. The list of the positions of the onsets detected by the onset detection unit 152 in this manner is output to the beat score calculation unit 154 (refer to FIG. 16).

The beat score calculation unit 154 calculates, for each onset detected by the onset detection unit 152, a beat score indicating the degree of correspondence to a beat among beats forming a series of beats with a constant tempo (or a constant beat interval).

Figure 22:
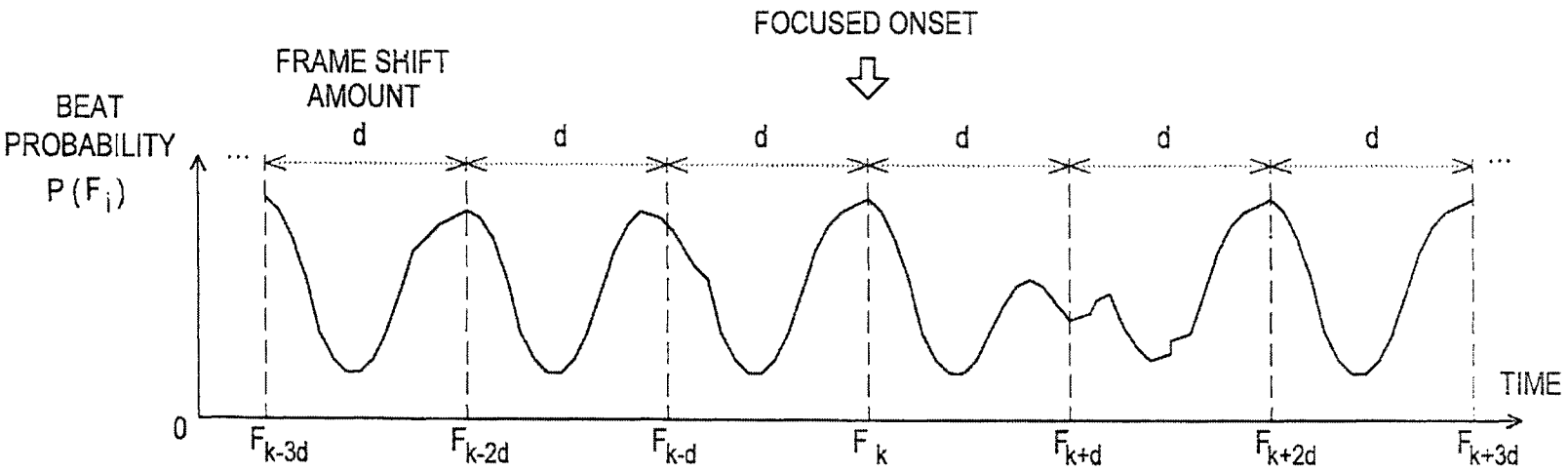
FIG. 22 is an explanatory diagram showing an example of the beat detection method according to the present embodiment.

First, the beat score calculation unit 154 sets a focused onset as shown in FIG. 22. In the example of FIG. 22, among the onsets detected by the onset detection unit 152, the onset at a frame position $F_k$ (frame number k) is set as a focused onset. Furthermore, a series of frame positions $F_{k-3}$, $F_{k-2}$, $F_{k-1}$, $F_k$, $F_{k+1}$, $F_{k+2}$, and $F_{k+3}$ distanced from the frame position $F_k$ at integer multiples of a specific distance d is being referred. In the following, the specific distance d is referred to as a shift amount, and a frame position distanced at an integer multiple of the shift amount d is referred to as a shift position. The beat score calculation unit 154 takes the sum of the beat probabilities at all the shift positions ( . . . $F_{k-3}$, $F_{k-2}$, $F_{k-1}$, $F_k$, $F_{k+1}$, $F_{k+2}$, and $F_{k+3}$ . . . ) included in a group F of frames for which the beat probability has been calculated as the beat score of the focused onset. For example, when the beat probability at a frame position $F_i$ is $P(F_i)$, a beat score BS(k,d) in relation to the frame number k and the shift amount d for the focused onset is expressed by the following equation (12). The beat score BS(k,d) expressed by the following equation (12) can be said to be the score indicating the possibility of an onset at the k-th frame of the audio signal being in sync with a constant tempo having the shift amount d as the beat interval.

[Equation 8]

$$BS(k, d) = \sum_n P(F_{k+nd}) \tag{12}$$

Figure 23:
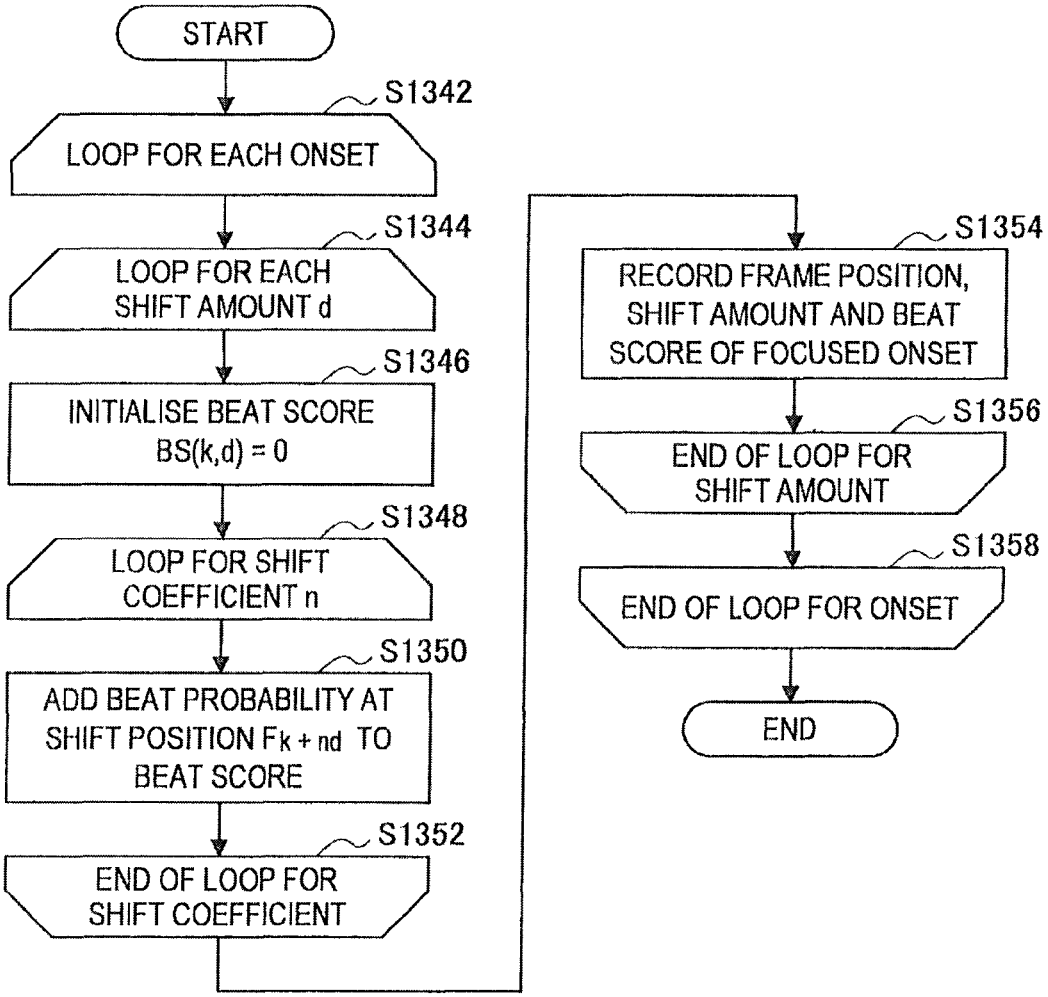
FIG. 23 is an explanatory diagram showing an example of the beat detection method according to the present embodiment.

Here, referring to FIG. 23, a beat score calculation processing flow of the beat score calculation unit 154 will be briefly described.

As shown in FIG. 23, first, the beat score calculation unit 154 sequentially executes a loop for the onsets, starting from the first onset, with regard to the onsets detected by the onset detection unit 152 (S1322). Furthermore, the beat score calculation unit 154 executes a loop for each of all the shift amounts d with regard to the focused onset (S1344). The shift amounts d, which are the subjects of the loop, are the values of the intervals at all the beats which may be used in a music performance. The beat score calculation unit 154 then initialises the beat score BS(k,d) (that is, zero is substituted into the beat score BS(K,d)) (S1346). Next, the beat score calculation unit 154 executes a loop for a shift coefficient n for shifting a frame position $F_d$ of the focused onset (S1348). Then, the beat score calculation unit 154 sequentially adds the beat probability $P(F_{k+nd})$ at each of the shift positions to the beat score BS(k,d) (S1350). Then, when the loop for all the shift coefficients n is over (S1352), the beat score calculation unit 154 records the frame position (frame number k), the shift amount d and the beat score BS(k,d) of the focused onset (S1354). The beat score calculation unit 154 repeats this computation of the beat score BS(k,d) for every shift amount of all the onsets (S1356, S1358).

Figure 24:
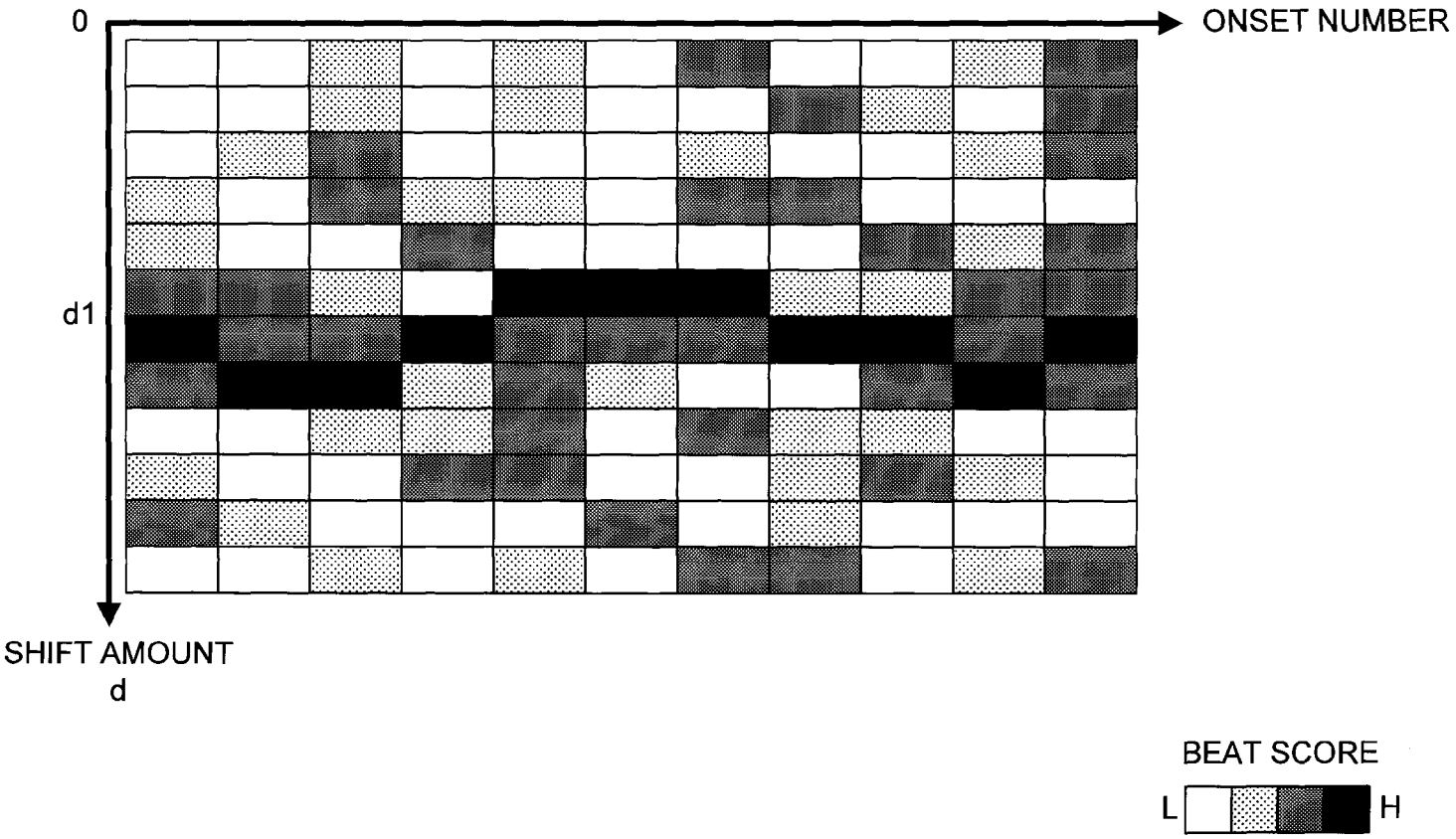
FIG. 24 is an explanatory diagram showing an example of the beat detection method according to the present embodiment.

With the beat score calculation process by the beat score calculation unit 154 as described above, the beat score BS(k,d) across a plurality of the shift amounts d is output for every onset detected by the onset detection unit 152. A beat score distribution chart as shown in FIG. 24 is obtained by the above-described beat score calculation process. The beat score distribution chart visualizes the beat scores output from the beat score calculation unit 154. In FIG. 24, the onsets detected by the onset detection unit 152 are shown in time series along the horizontal axis. The vertical axis in FIG. 24 indicates the shift amount for which the beat score for each onset has been computed. Furthermore, the intensity of the colour of each dot in the figure indicates the level of the beat score calculated for the onset at the shift amount. In the example of FIG. 24, in the vicinity of a shift amount d1, the beat scores are high for all the onsets. When assuming that the music piece is played at a tempo at the shift amount d1, it is highly possible that many of the detected onsets correspond to the beats. The beat scores calculated by the beat score calculation unit 154 are input to the beat search unit 156.

Figure 25:
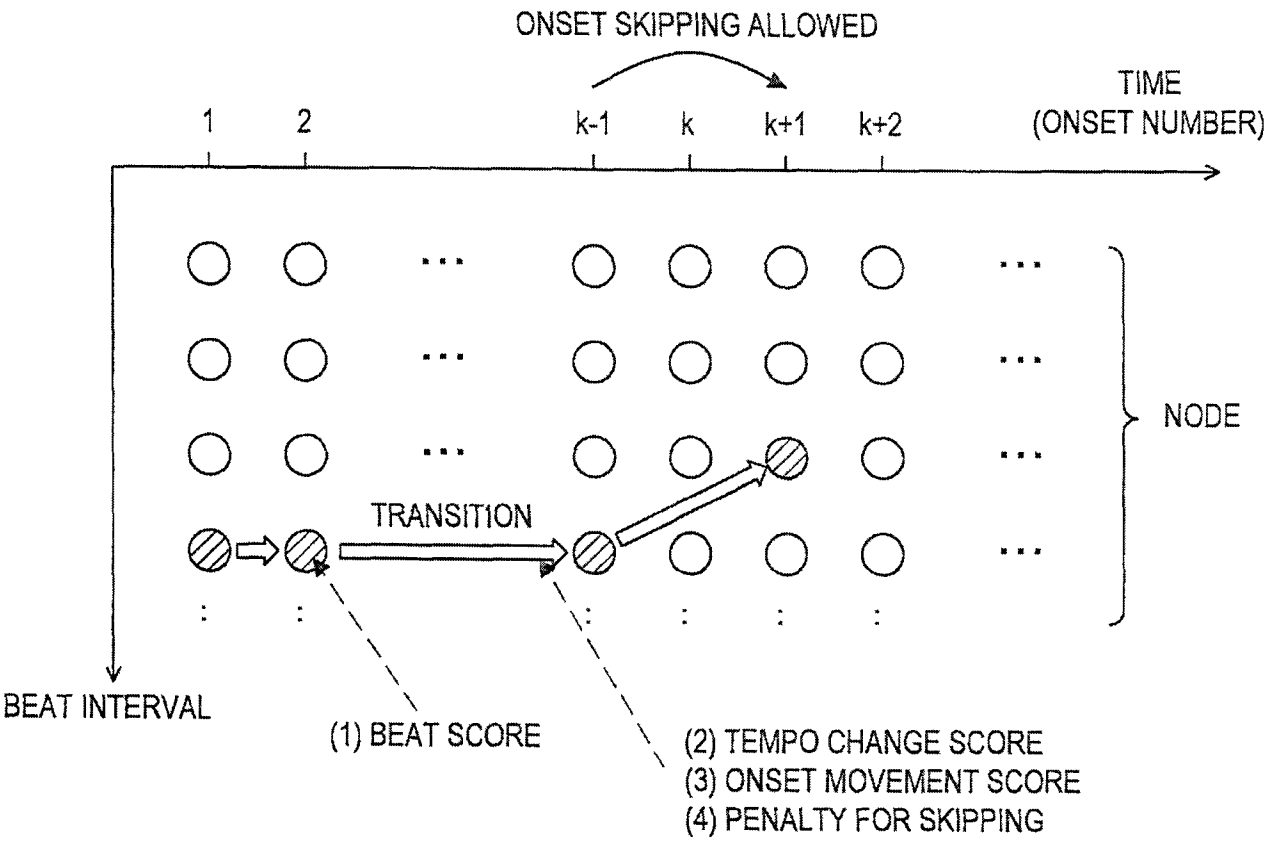
FIG. 25 is an explanatory diagram showing an example of the beat detection method according to the present embodiment.

The beat search unit 156 searches for a path of onset positions showing a likely tempo fluctuation, based on the beat scores computed by the beat score calculation unit 154. A Viterbi search algorithm based on hidden Markov model may be used as the path search method by the beat search unit 156, for example. For the Viterbi search by the beat search unit 156, the onset number is set as the unit for the time axis (horizontal axis) and the shift amount used at the time of beat score computation is set as the observation sequence (vertical axis) as schematically shown in FIG. 25, for example. The beat search unit 156 searches for a Viterbi path connecting nodes respectively defined by values of the time axis and the observation sequence. In other words, the beat search unit 156 takes as the target node for the path search each of all the combinations of the onset and the shift amount used at the time of calculating the beat score by the beat score calculation unit 154. Moreover, the shift amount of each node is equivalent to the beat interval assumed for the node. Thus, in the following, the shift amount of each node may be referred to as the beat interval.

With regard to the node as described, the beat search unit 156 sequentially selects, along the time axis, any of the nodes, and evaluates a path formed from a series of the selected nodes. At this time, in the node selection, the beat search unit 156 is allowed to skip onsets. For example, in the example of FIG. 25, after the k−1st onset, the k-th onset is skipped and the k+1st onset is selected. This is because normally onsets that are beats and onsets that are not beats are mixed in the onsets, and a likely path has to be searched from among paths including paths not going through onsets that are not beats.

For example, for the evaluation of a path, four evaluation values may be used, namely (1) beat score, (2) tempo change score, (3) onset movement score, and (4) penalty for skipping. Among these, (1) beat score is the beat score calculated by the beat score calculation unit 154 for each node. On the other hand, (2) tempo change score, (3) onset movement score and (4) penalty for skipping are given to a transition between nodes. Among the evaluation values to be given to a transition between nodes, (2) tempo change score is an evaluation value given based on the empirical knowledge that, normally, a tempo fluctuates gradually in a music piece. Thus, a value given to the tempo change score is higher as the difference between the beat interval at a node before transition and the beat interval at a node after the transition is smaller.

Figure 26:
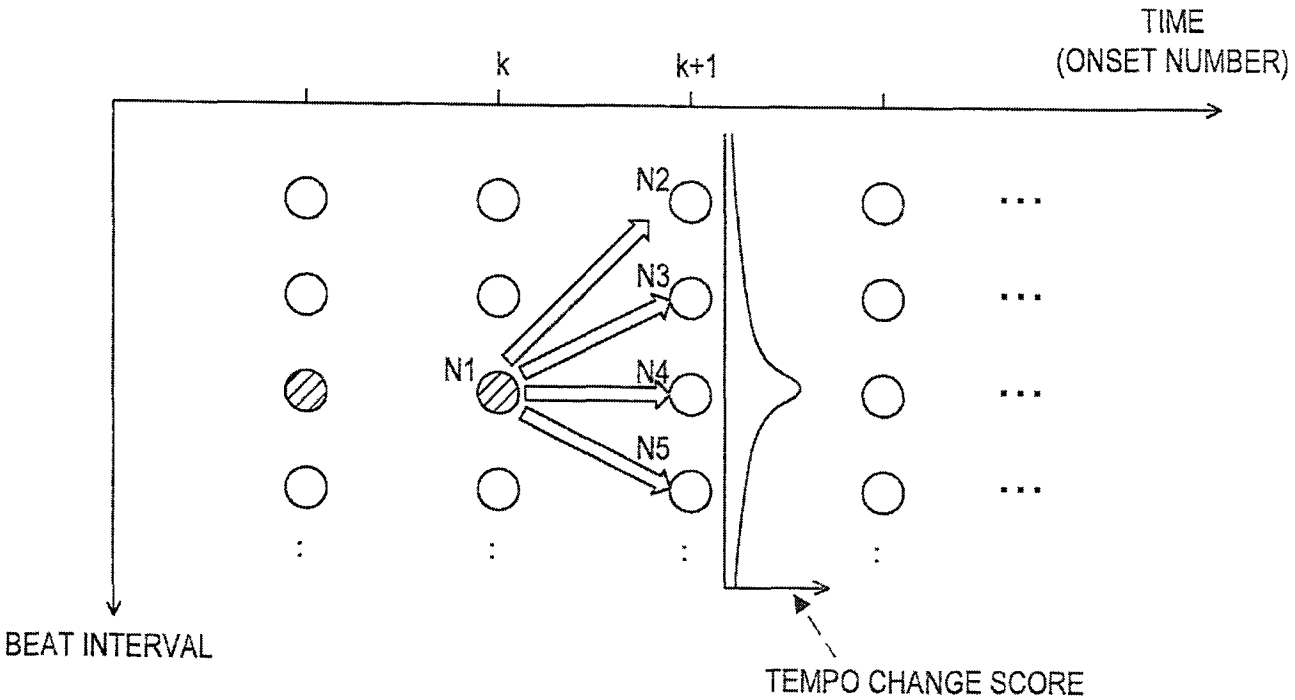
FIG. 26 is an explanatory diagram showing an example of the beat detection method according to the present embodiment.

Here, referring to FIG. 26, (2) tempo change score will be described in detail. In the example of FIG. 26, a node N1 is currently selected. The beat search unit 156 possibly selects any of nodes N2 to N5 as the next node. Although nodes other than N2 to N5 might also be selected, for the sake of convenience of description, four nodes, i.e. nodes N2 to N5, will be described. Here, when the beat search unit 156 selects the node N4, since there is no difference between the beat intervals at the node N1 and the node N4, the highest value will be given as the tempo change score. On the other hand, when the beat search unit 156 selects the node N3 or N5, there is a difference between the beat intervals at the node N1 and the node N3 or N5, and thus, a lower tempo change score compared to when the node N4 is selected is given. Furthermore, when the beat search unit 156 selects the node N2, the difference between the beat intervals at the node N1 and the node N2 is larger than when the node N3 or N5 is selected. Thus, an even lower tempo score is given.

Figure 27:
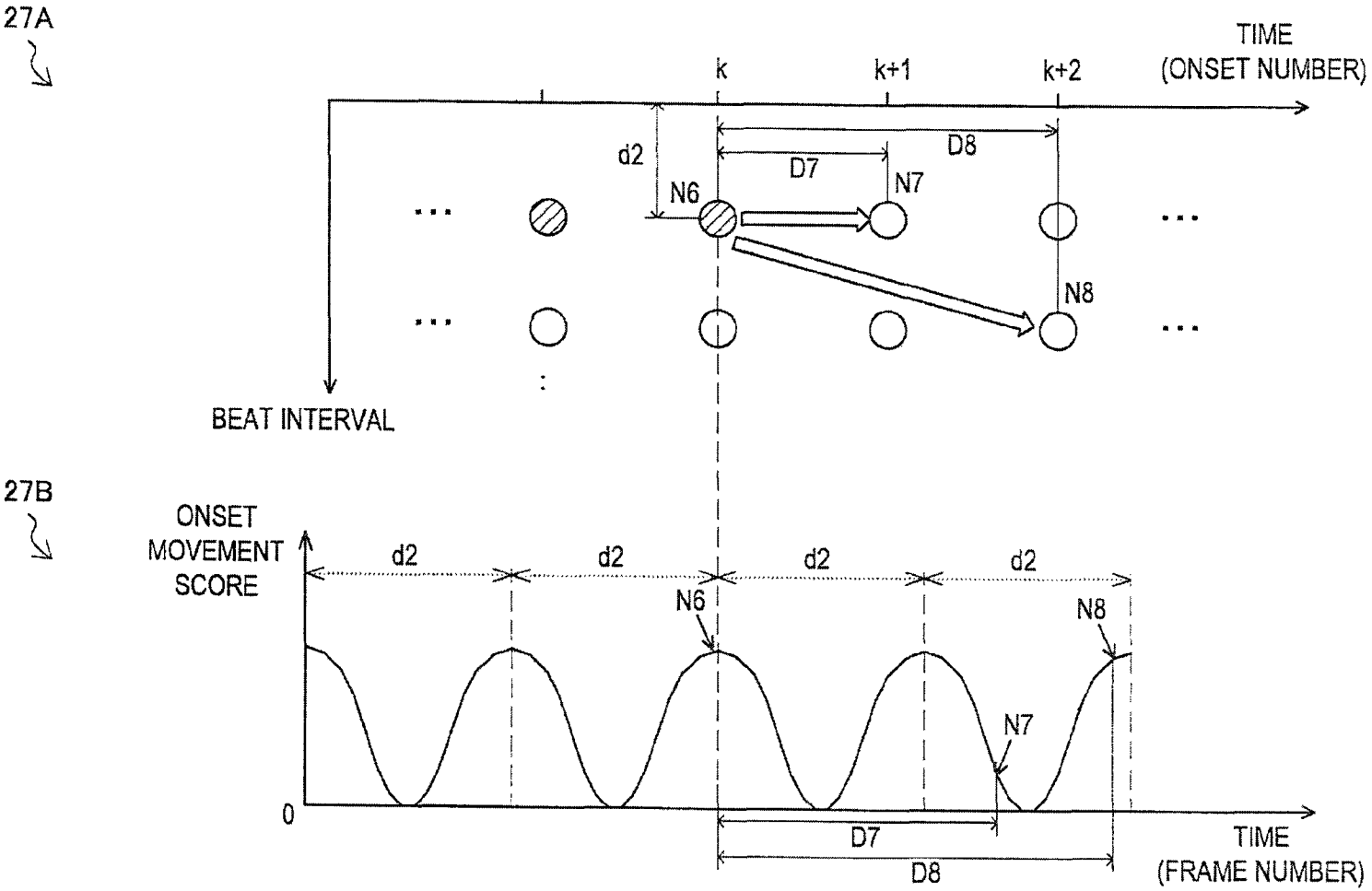
FIG. 27 is an explanatory diagram showing an example of the beat detection method according to the present embodiment.

Next, referring to FIG. 27, (3) onset movement score will be described in detail. The onset movement score is an evaluation value given in accordance with whether the interval between the onset positions of the nodes before and after the transition matches the beat interval at the node before the transition. In FIG. 27(A), a node N6 with a beat interval d2 for the k-th onset is currently selected. Also, two nodes, N7 and N8 are shown as the nodes which may be selected next by the beat search unit 156. Among these, the node N7 is a node of the k+1st onset, and the interval between the k-th onset and the k+1st onset (for example, difference between the frame numbers) is D7. On the other hand, the node N8 is a node of the k+2nd onset, and the interval between the k-th onset and the k+2nd onset is D8.

Here, when assuming an ideal path where all the nodes on the path correspond, without fail, to the beat positions in a constant tempo, the interval between the onset positions of adjacent nodes is an integer multiple (same interval when there is no rest) of the beat interval at each node. Thus, as shown in FIG. 27(B), a higher onset movement score is given as the interval between the onset positions is closer to the integer multiple of the beat interval d2 at the node N6, in relation to the current node N6. In the example of FIG. 27(B), since the interval D8 between the nodes N6 and N8 is closer to the integer multiple of the beat interval d2 at the node N6 than the interval D7 between the nodes N6 and N7, a higher onset movement score is given to the transition from the node N6 to the node N8.

Figure 28:
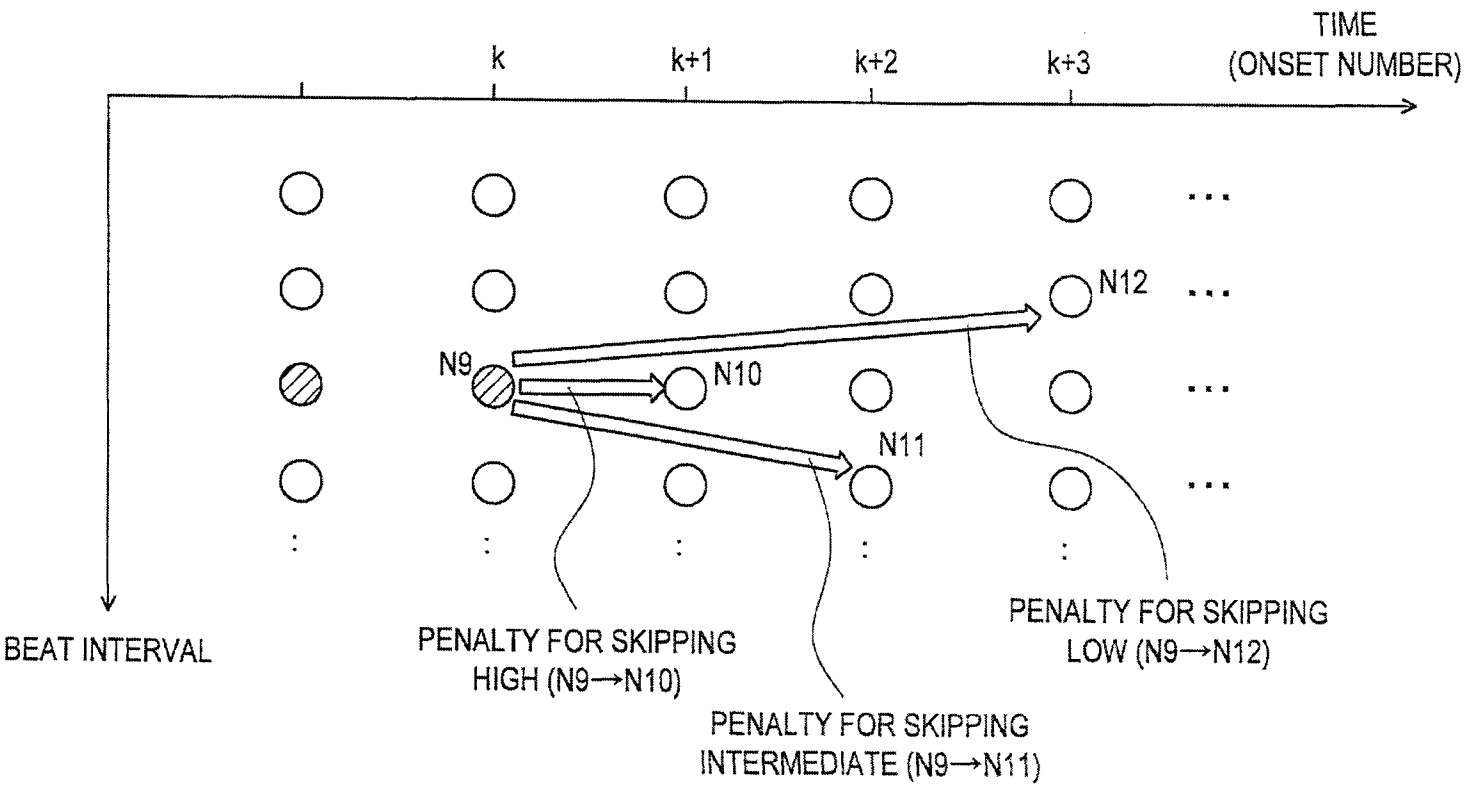
FIG. 28 is an explanatory diagram showing an example of the beat detection method according to the present embodiment.

Next, referring to FIG. 28, (4) penalty for skipping is described in detail. The penalty for skipping is an evaluation value for restricting an excessive skipping of onsets in a transition between nodes. Accordingly, the score is lower as more onsets are skipped in one transition, and the score is higher as fewer onsets are skipped in one transition. Here, lower score means higher penalty. In the example of FIG. 28, a node N9 of the k-th onset is selected as the current node. Also, in the example of FIG. 28, three nodes, N10, N11 and N12 are shown as the nodes which may be selected next by the beat search unit 156. The node N10 is the node of the k+1st onset, the node N11 is the node of the k+2nd onset, and the node N12 is the node of the k+3rd onset.

Accordingly, in case of transition from the node N9 to the node N10, no onset is skipped. On the other hand, in case of transition from the node N9 to the node N11, the k+1st onset is skipped. Also, in case of transition from the node N9 to the node N12, the k+1st and k+2nd onsets are skipped. Thus, the penalty for skipping takes a relatively high value in case of transition from the node N9 to the node N10, an intermediate value in case of transition from the node N9 to the node N11, and a low value in case of transition from the node N9 to the node N12. As a result, at the time of the path search, a phenomenon that a larger number of onsets are skipped to thereby make the interval between the nodes constant can be prevented.

Figure 29:
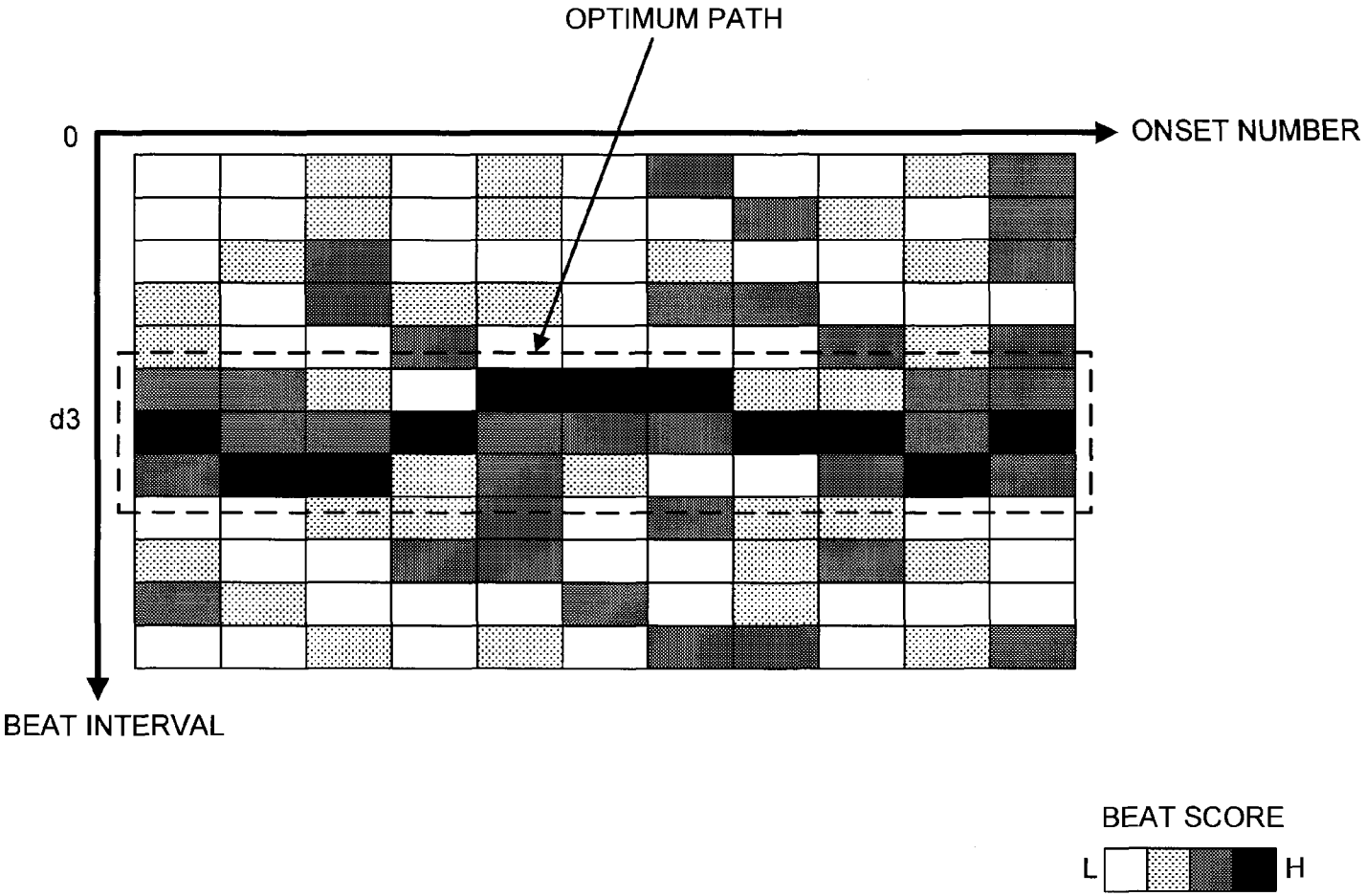
FIG. 29 is an explanatory diagram showing an example of the beat detection method according to the present embodiment.

Heretofore, the four evaluation values used for the evaluation of paths searched out by the beat search unit 156 have been described. The evaluation of paths described by using FIG. 25 is performed, with respect to a selected path, by sequentially multiplying by each other the evaluation values of the above-described (1) to (4) given to each node or for the transition between nodes included in the path. The beat search unit 156 determines, as the optimum path, the path whose product of the evaluation values is the largest among all the conceivable paths. The path determined in this manner is as shown in FIG. 29, for example. FIG. 29 shows an example of a Viterbi path determined as the optimum path by the beat search unit 156. In the example of FIG. 29, the optimum path determined by the beat search unit 156 is outlined by dotted-lines on the beat score distribution chart shown in FIG. 24. In the example of FIG. 29, it can be seen that the tempo of the music piece for which search is conducted by the beat search unit 156 fluctuates, centering on a beat interval d3. The optimum path (a list of nodes included in the optimum path) determined by the beat search unit 156 is input to the constant tempo decision unit 158, the beat re-search unit 160 for constant tempo, and the beat determination unit 162.

Figure 30:
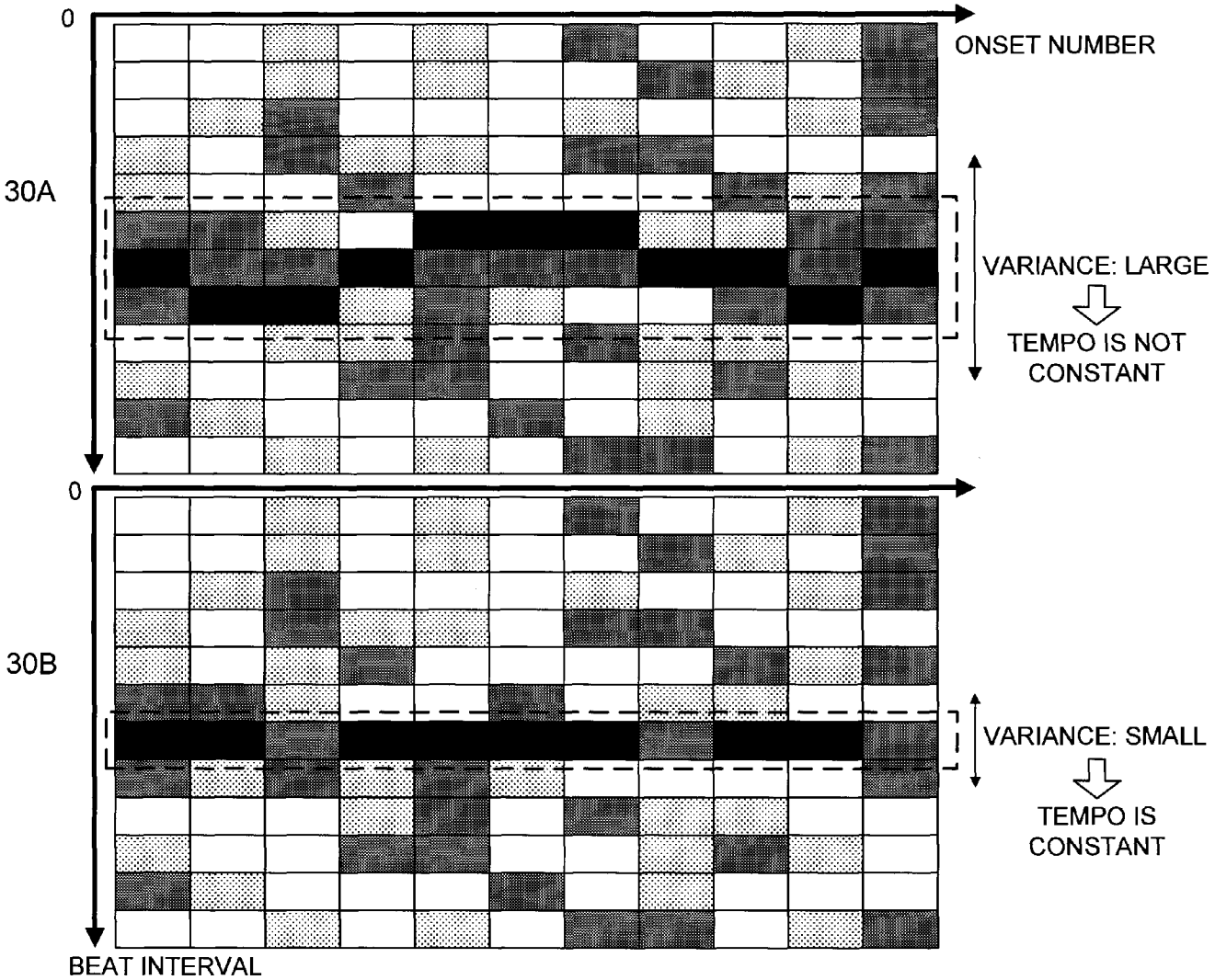
FIG. 30 is an explanatory diagram showing an example of the beat detection method according to the present embodiment.

The constant tempo decision unit 158 decides whether the optimum path determined by the beat search unit 156 indicates a constant tempo with low variance of beat intervals that are assumed for respective nodes. First, the constant tempo decision unit 158 calculates the variance for a group of beat intervals at nodes included in the optimum path input from the beat search unit 156. Then, when the computed variance is less than a specific threshold value given in advance, the constant tempo decision unit 158 decides that the tempo is constant; and when the computed variance is more than the specific threshold value, the constant tempo decision unit 158 decides that the tempo is not constant. For example, the tempo is decided by the constant tempo decision unit 158 as shown in FIG. 30.

For example, in the example shown in FIG. 30(A), the beat interval for the onset positions in the optimum path outlined by the dotted-lines varies according to time. With such a path, the tempo may be decided as not constant as a result of a decision relating to a threshold value by the constant tempo decision unit 158. On the other hand, in the example shown in FIG. 30(B), the beat interval for the onset positions in the optimum path outlined by the dotted-lines is nearly constant through out the music piece. Such a path may be decided as constant as a result of the decision relating to a threshold value by the constant tempo decision unit 158. The result of the decision relating to a threshold value by the constant tempo decision unit 158 obtained in this manner is input to the beat re-search unit 160 for constant tempo.

When the optimum path extracted by the beat search unit 156 is decided by the constant tempo decision unit 158 to indicate a constant tempo, the beat re-search unit 160 for constant tempo re-executes the path search, limiting the nodes which are the subjects of the search to those only around the most frequently appearing beat intervals. For example, the beat re-search unit 160 for constant tempo executes a re-search process for a path by a method illustrated in FIG. 31. Moreover, as with FIG. 25, the beat re-search unit 160 for constant tempo executes the re-search process for a path for a group of nodes along a time axis (onset number) with the beat interval as the observation sequence.

Figure 31:
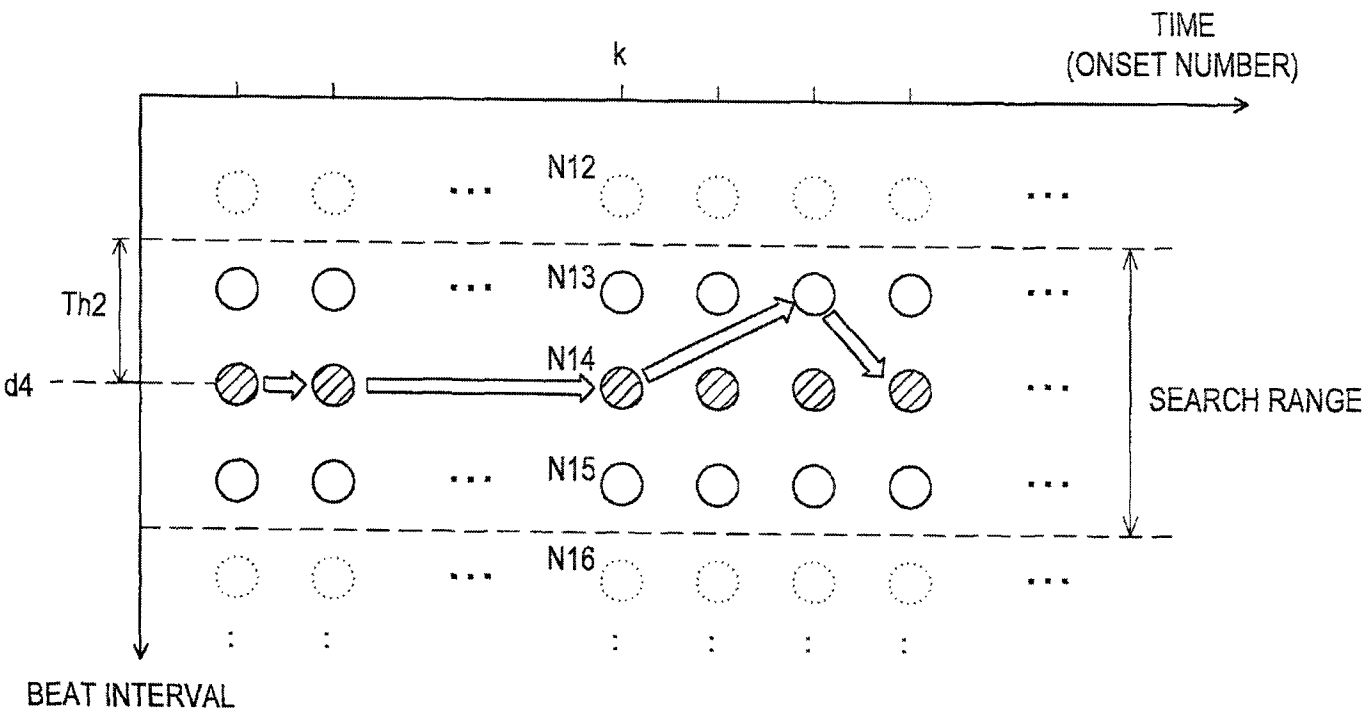
FIG. 31 is an explanatory diagram showing an example of the beat detection method according to the present embodiment.

For example, it is assumed that the mode of the beat intervals at the nodes included in the path determined to be the optimum path by the beat search unit 156 is d4, and that the tempo for the path is decided to be constant by the constant tempo decision unit 158. In this case, the beat re-search unit 160 for constant tempo searches again for a path with only the nodes for which the beat interval d satisfies $d4-Th2 \le d \le d4+Th2$ (Th2 is a specific threshold value) as the subjects of the search. In the example of FIG. 31, five nodes N12 to N16 are shown for the k-th onset. Among these, the beat intervals at N13 to N15 are included within the search range ($d4-Th2 \le d \le d4+Th2$) with regard to the beat re-search unit 160 for constant tempo. In contrast, the beat intervals at N12 and N16 are not included in the above-described search range. Thus, with regard to the k-th onset, only the three nodes, N13 to N15, are made to be the subjects of the re-execution of the path search by the beat re-search unit 160 for constant tempo.

Moreover, the flow of the re-search process for a path by the beat re-search unit 160 for constant tempo is similar to the path search process by the beat search unit 156 except for the range of the nodes which are to be the subjects of the search. According to the path re-search process by the beat re-search unit 160 for constant tempo as described above, errors relating to the beat positions which might partially occur in a result of the path search can be reduced with respect to a music piece with a constant tempo. The optimum path redetermined by the beat re-search unit 160 for constant tempo is input to the beat determination unit 162.

Figure 32:
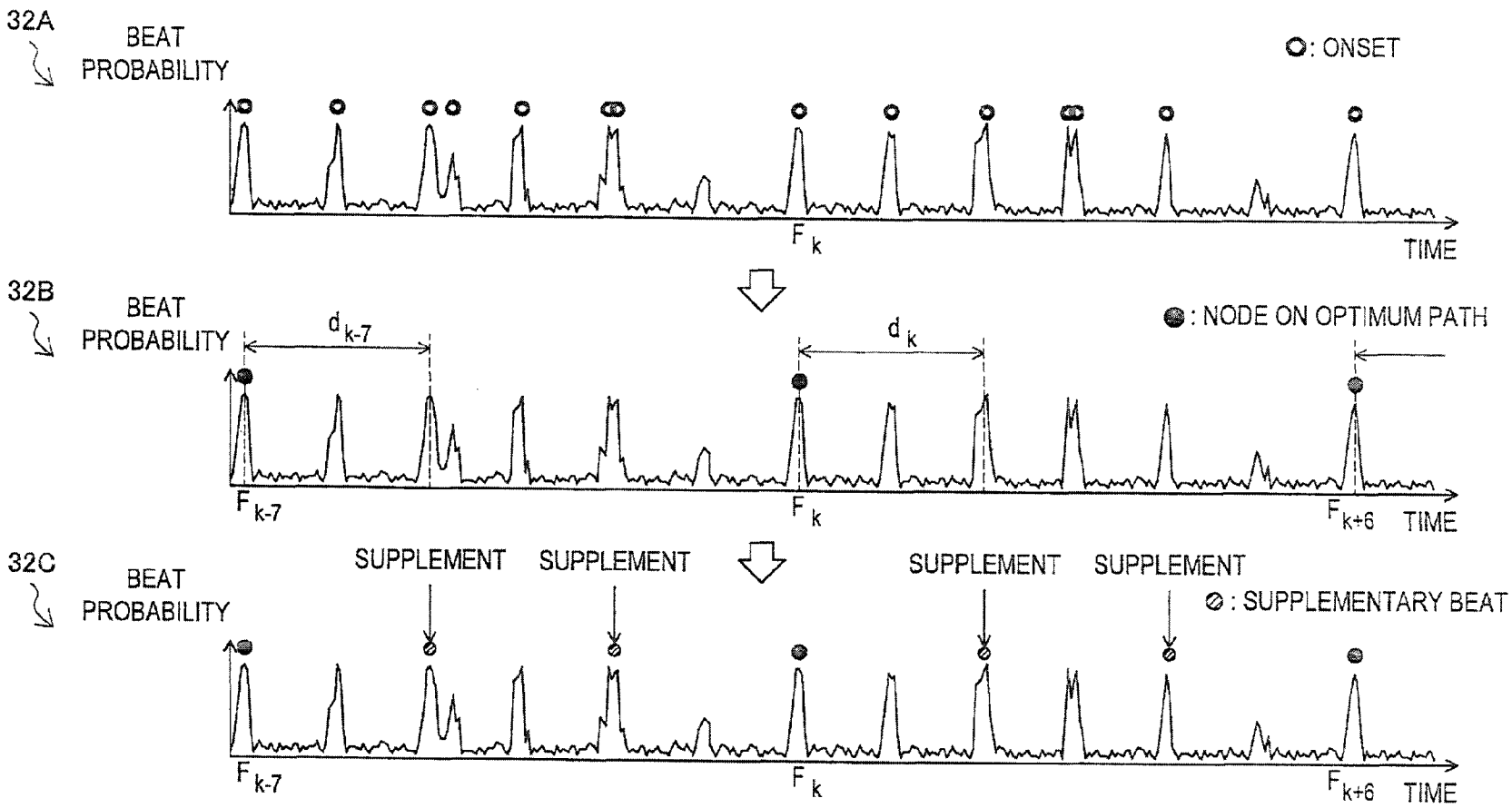
FIG. 32 is an explanatory diagram showing an example of the beat detection method according to the present embodiment.

The beat determination unit 162 determines the beat positions included in the audio signal, based on the optimum path determined by the beat search unit 156 or the optimum path redetermined by the beat re-search unit 160 for constant tempo as well as on the beat interval at each node included in the path. For example, the beat determination unit 162 determines the beat position by a method as shown in FIG. 32. In FIG. 32(A), an example of the onset detection result obtained by the onset detection unit 152 is shown. In this example, 14 onsets in the vicinity of the k-th onset that are detected by the onset detection unit 152 are shown. In contrast, FIG. 32(B) shows the onsets included in the optimum path determined by the beat search unit 156 or the beat re-search unit 160 for constant tempo. In the example of (B), the k−7th onset, the k-th onset and the k+6th onset (frame numbers $F_{k-7}$, $F_k$, $F_{k+6}$), among the 14 onsets shown in (A), are included in the optimum path. Furthermore, the beat interval at the k−7th onset (equivalent to the beat interval at the corresponding node) is $d_{k-7}$, and the beat interval at the k-th onset is $d_k$.

Figure 33:
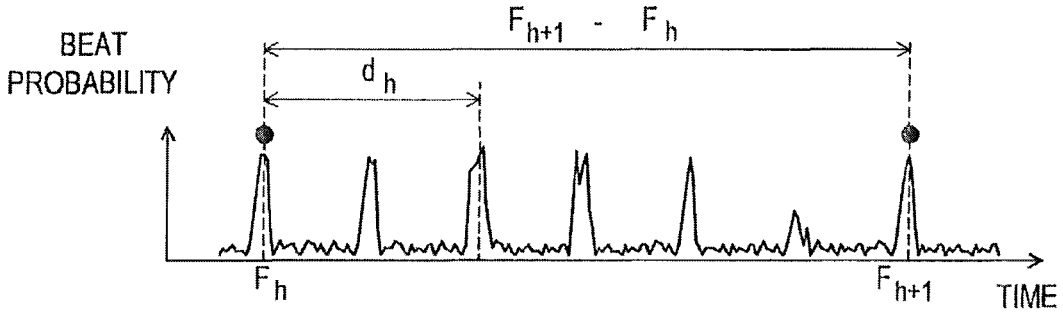
FIG. 33 is an explanatory diagram showing an example of the beat detection method according to the present embodiment.

With respect to such onsets, first, the beat determination unit 162 takes the positions of the onsets included in the optimum path as the beat positions of the music piece. Then, the beat determination unit 162 furnishes supplementary beats between adjacent onsets included in the optimum path according to the beat interval at each onset. At this time, the beat determination unit 142 first determines the number of supplementary beats to furnish the beats between onsets adjacent to each other on the optimum path. For example, as shown in FIG. 33, the beat determination unit 162 takes the positions of two adjacent onsets as $F_h$ and $F_{h+1}$, and the beat interval at the onset position $F_h$ as $d_h$. In this case, the number of supplementary beats $B_{fill}$ to be furnished between $F_h$ and $F_{h+1}$ is given by the following equation.

[Equation 9]

$$B_{fill} = \text{Round}\left(\frac{F_{h+1} - F_h}{d_h}\right) - 1 \tag{13}$$

Here, Round ( . . . ) indicates that " . . . " is rounded off to the nearest whole number. According to the above equation (13), the number of supplementary beats to be furnished by the beat determination unit 162 will be a number obtained by rounding off, to the nearest whole number, the value obtained by dividing the interval between adjacent onsets by the beat interval, and then subtracting 1 from the obtained whole number in consideration of the fencepost problem.

Next, the beat determination unit 162 furnishes the supplementary beats, by the determined number of beats, between onsets adjacent to each other on the optimum path so that the beats are arranged at an equal interval. In FIG. 32(C), onsets after the furnishing of supplementary beats are shown. In the example of (C), two supplementary beats are furnished between the k−7th onset and the k-th onset, and two supplementary beats are furnished between the k-th onset and the k+6th onset. It should be noted that the positions of supplementary beats provided by the beat determination unit 162 does not necessarily correspond with the positions of onsets detected by the onset detection unit 152. With this configuration, the position of a beat can be determined without being affected by a sound produced locally off the beat position. Furthermore, the beat position can be appropriately grasped even in case there is a rest at the beat position and no sound is produced. A list of the beat positions determined by the beat determination unit 162 (including the onsets on the optimum path and supplementary beats furnished by the beat determination unit 162) in this manner is input to the tempo revision unit 164.

Figure 34:
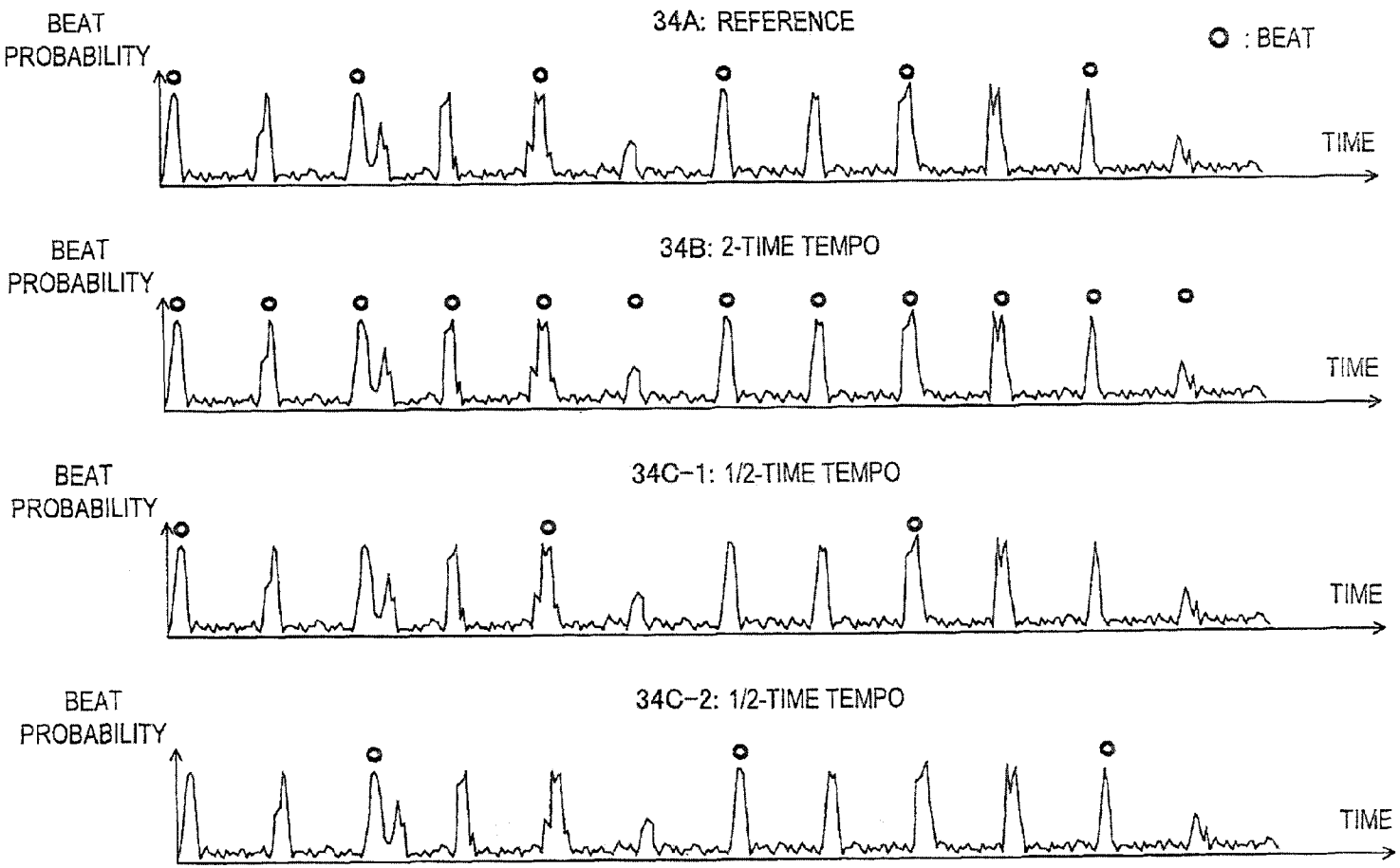
FIG. 34 is an explanatory diagram showing an example of the beat detection method according to the present embodiment.

The tempo revision unit 164 revises the tempo indicated by the beat positions determined by the beat determination unit 162. The tempo before revision is possibly a constant multiple of the original tempo of the music piece, such as 2 times, 1/2 times, 3/2 times, 2/3 times or the like (refer to FIG. 34). Accordingly, the tempo revision unit 164 revises the tempo which is erroneously grasped to be a constant multiple and reproduces the original tempo of the music piece. Here, reference is made to the example of FIG. 34 showing patterns of beat positions determined by the beat determination unit 162. In the example of FIG. 34, 6 beats are included for pattern (A) in the time range shown in the figure. In contrast, for pattern (B), 12 beats are included in the same time range. That is, the beat positions of pattern (B) indicate a 2-time tempo with the beat positions of pattern (A) as the reference.

On the other hand, with pattern (C-1), 3 beats are included in the same time range. That is, the beat positions of pattern (C-1) indicate a 1/2-time tempo with the beat positions of pattern (A) as the reference. Also, with pattern (C-2), as with pattern (C-1), 3 beats are included in the same time range, and thus a 1/2-time tempo is indicated with the beat positions of pattern (A) as the reference. However, pattern (C-1) and pattern (C-2) differ from each other by the beat positions which will be left to remain at the time of changing the tempo from the reference tempo. The revision of tempo by the tempo revision unit 164 is performed by the following procedures (S1) to (S3), for example.

(S1) Determination of Estimated Tempo estimated based on Waveform (S2) Determination of Optimum Basic Multiplier among a Plurality of Multipliers (S3) Repetition of (S2) until Basic Multiplier is 1

Figure 35:
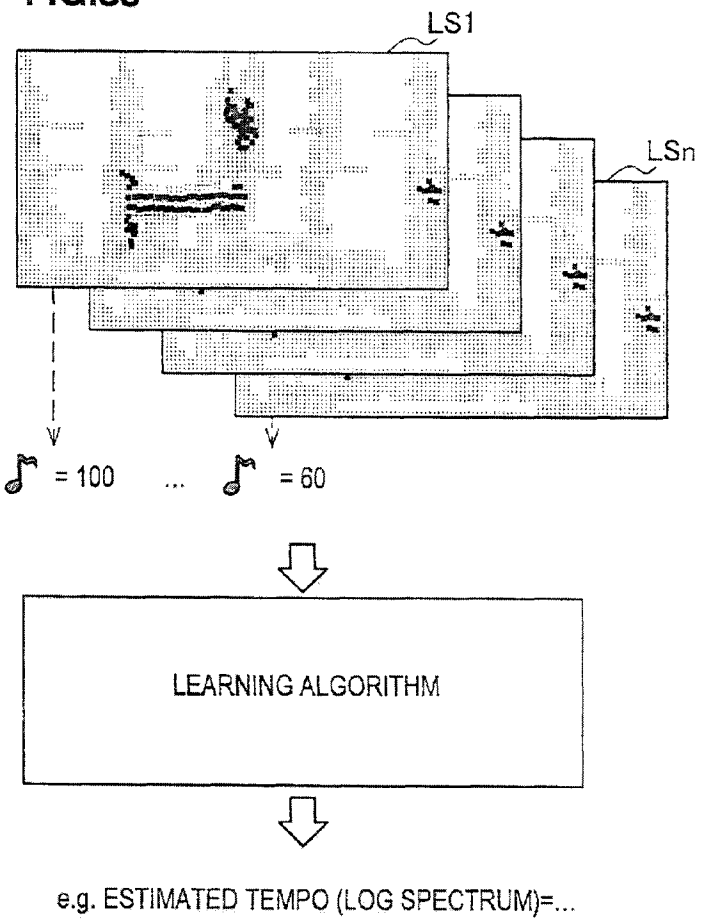
FIG. 35 is an explanatory diagram showing an example of the beat detection method according to the present embodiment.

First, explanation will be made on (S1) Determination of Estimated Tempo estimated based on waveform. The tempo revision unit 164 determines an estimated tempo which is estimated to be adequate from the sound features appearing in the waveform of the audio signal. For example, the feature quantity calculation formula generation apparatus 10 or a calculation formula for estimated tempo discrimination (an estimated tempo discrimination formula) generated by the learning algorithm disclosed in JP-A-2008-123011 are used for the determination of the estimated tempo. For example, as shown in FIG. 35, log spectra of a plurality of music pieces are supplied as evaluation data to the feature quantity calculation formula generation apparatus 10. In the example of FIG. 35, log spectra LS1 to LSn are supplied. Furthermore, tempos decided to be correct by a human being listening to the music pieces are supplied as teacher data. In the example of FIG. 35, a correct tempo (LS1:100, . . . , LSn:60) of each log spectrum is supplied. The estimated tempo discrimination formula is generated based on a plurality of sets of such evaluation data and teacher data. The tempo revision unit 164 computes the estimated tempo of a treated piece by using the generated estimated tempo discrimination formula.

Next, explanation will be made on (2) Determination of Optimum Basic Multiplier among a Plurality of Multiplier. The tempo revision unit 164 determines a basic multiplier, among a plurality of basic multipliers, according to which a revised tempo is closest to the original tempo of a music piece. Here, the basic multiplier is a multiplier which is a basic unit of a constant ratio used for the revision of tempo. For example, any of seven types of multipliers, i.e. 1/3, 1/2, 2/3, 1, 3/2, 2 and 3 is used as the basic multiplier. However, the application range of the present embodiment is not limited to these examples, and the basic multiplier may be any of five types of multipliers, i.e. 1/3, 1/2, 1, 2 and 3, for example. To determine the optimum basic multiplier, the tempo revision unit 164 first calculates an average beat probability after revising the beat positions by each basic multiplier. However, in case of the basic multiplier being 1, an average beat probability is calculated for a case where the beat positions are not revised. For example, the average beat probability is computed for each basic multiplier by the tempo revision unit 164 by a method as shown in FIG. 36.

Figure 36:
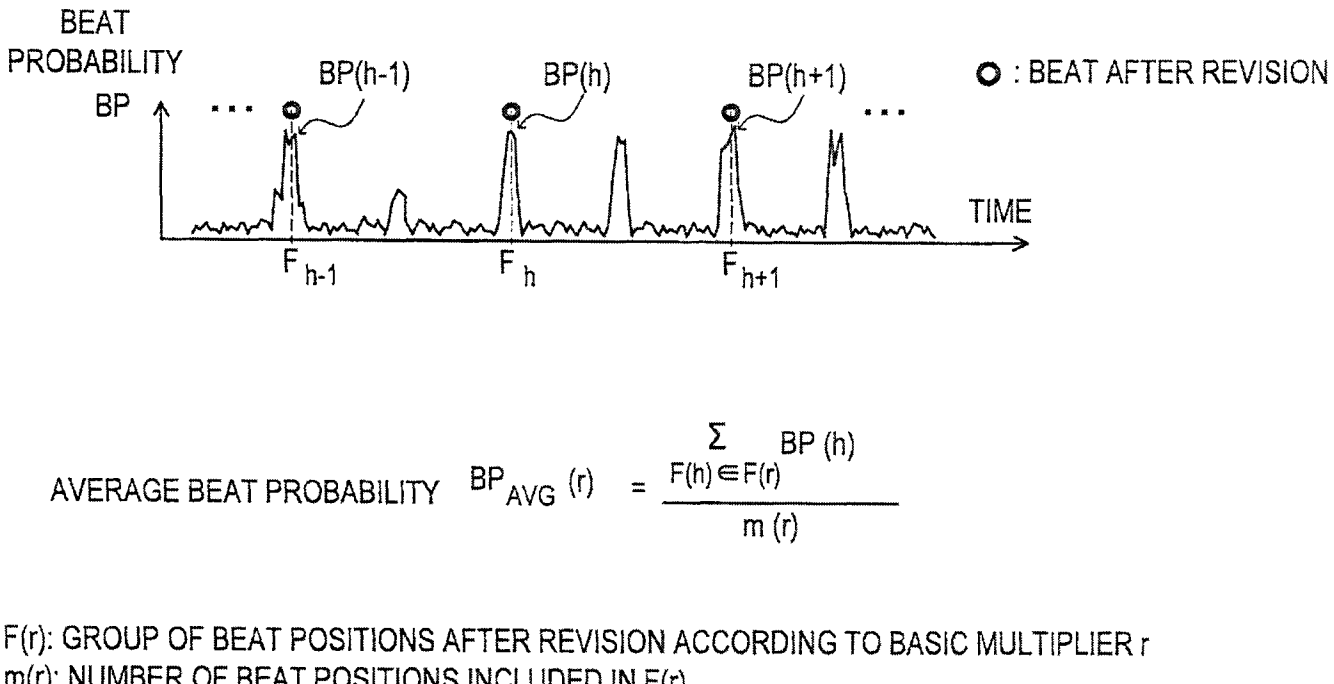
FIG. 36 is an explanatory diagram showing an example of the beat detection method according to the present embodiment.

In FIG. 36, the beat probability computed by the beat probability computation unit 142 is shown with a polygonal line on the time axis. Moreover, frame numbers $F_{h-1}$, $F_h$ and $F_{h+1}$ of three beats revised according to any of the multipliers are shown on the horizontal axis. Here, when the beat probability at the frame number $F_h$ is BP(h), an average beat probability $BP_{AVG}(r)$ of a group F(r) of the beat positions revised according to a multiplier r is given by the following equation (14). Here, m(r) is the number of pieces of frame numbers included in the group F(r).

[Equation 10]

$$BP_{AVG}(r) = \frac{\sum_{F(h)\in F(r)} BP(h)}{m(r)} \quad (14)$$

As described using patterns (C-1) and (C-2) of FIG. 34, there are two types of candidates for the beat positions in case the basic multiplier r is 1/2. In this case, the tempo revision unit 164 calculates the average beat probability $BP_{AVG}(r)$ for each of the two types of candidates for the beat positions, and adopts the beat positions with higher average beat probability $BP_{AVG}(r)$ as the beat positions revised according to the multiplier r=1/2. Similarly, in case the multiplier r is 1/3, there are three types of candidates for the beat positions. Accordingly, the tempo revision unit 164 calculates the average beat probability $BP_{AVG}(r)$ for each of the three types of candidates for the beat positions, and adopts the beat positions with the highest average beat probability $BP_{AVG}(r)$ as the beat positions revised according to the multiplier r=1/3.

After calculating the average beat probability for each basic multiplier, the tempo revision unit 164 computes, based on the estimated tempo and the average beat probability, the likelihood of the revised tempo for each basic multiplier (hereinafter, a tempo likelihood). The tempo likelihood can be expressed by the product of a tempo probability shown by a Gaussian distribution centering around the estimated tempo and the average beat probability. For example, the tempo likelihood as shown in FIG. 37 is computed by the tempo revision unit 164.

Figure 37:
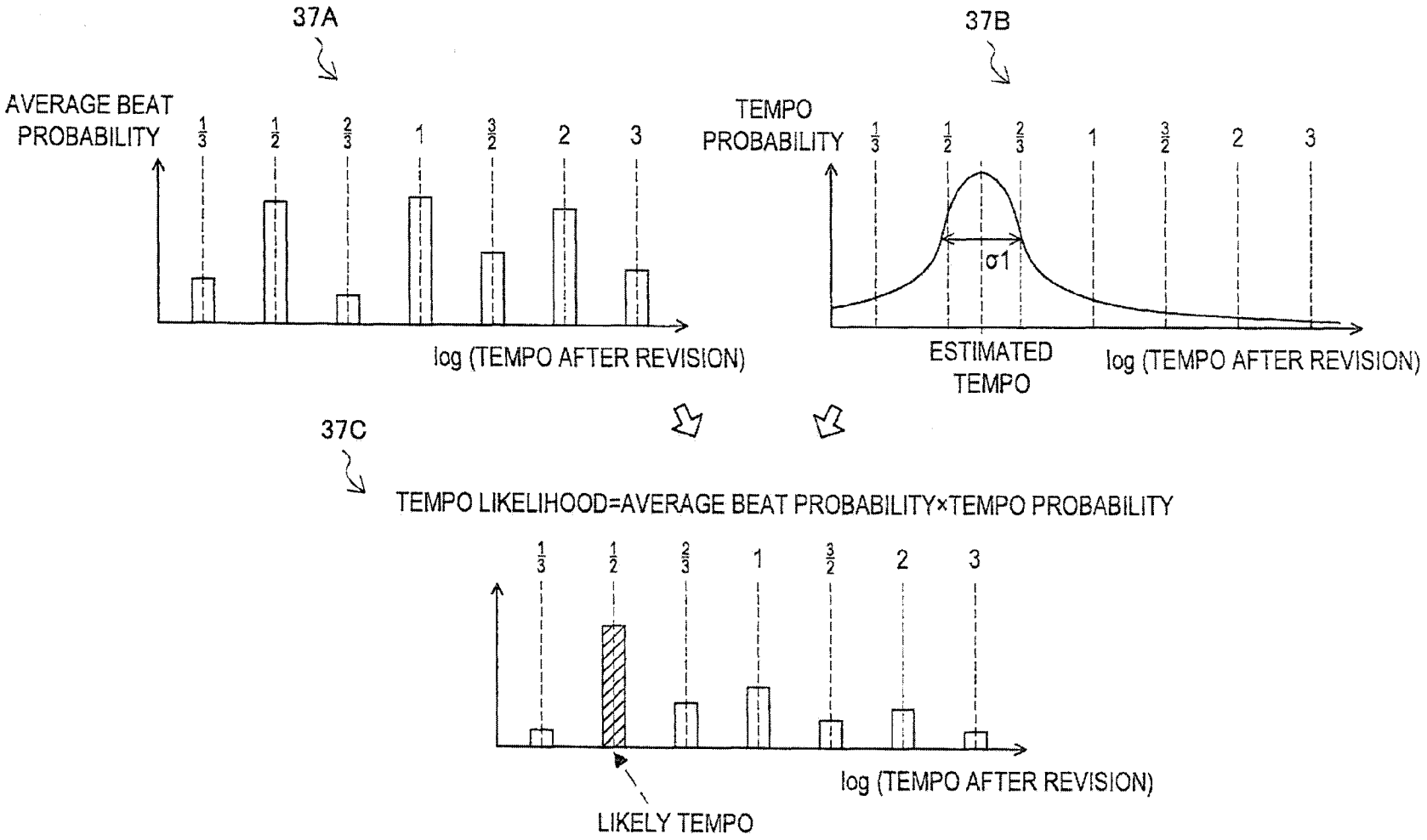
FIG. 37 is an explanatory diagram showing an example of the beat detection method according to the present embodiment.

The average beat probabilities computed by the tempo revision unit 164 for the respective multipliers are shown in FIG. 37(A). Also, FIG. 37(B) shows the tempo probability in the form of a Gaussian distribution that is determined by a specific variance σ1 given in advance and centering around the estimated tempo estimated by the tempo revision unit 164 based on the waveform of the audio signal. Moreover, the horizontal axes of FIGS. 37(A) and 37(B) represent the logarithm of tempo after the beat positions have been revised according to each multiplier. The tempo revision unit 164 computes the tempo likelihood shown in (C) for each of the basic multipliers by multiplying by each other the average beat probability and the tempo probability. In the example of FIG. 37, although the average beat probabilities are almost the same for when the basic multiplier is 1 and when it is 1/2, the tempo revised to 1/2 times is closer to the estimated tempo (the tempo probability is high). Thus, the computed tempo likelihood is higher for the tempo revised to 1/2 times. The tempo revision unit 164 computes the tempo likelihood in this manner, and determines the basic multiplier producing the highest tempo likelihood as the basic multiplier according to which the revised tempo is the closest to the original tempo of the music piece.

In this manner, by taking the tempo probability which can be obtained from the estimated tempo into account in the determination of a likely tempo, an appropriate tempo can be accurately determined among the candidates, which are tempos in constant multiple relationships and which are hard to discriminate from each other based on the local waveforms of the sound. When the tempo is revised in this manner, the tempo revision unit 164 performs (S3) Repetition of (S2) until Basic Multiplier is 1. Specifically, the calculation of the average beat probability and the computation of the tempo likelihood for each basic multiplier are repeated by the tempo revision unit 164 until the basic multiplier producing the highest tempo likelihood is 1. As a result, even if the tempo before the revision by the tempo revision unit 164 is 1/4 times, 1/6 times, 4 times, 6 times or the like of the original tempo of the music piece, the tempo can be revised by an appropriate multiplier for revision obtained by a combination of the basic multipliers (for example, 1/2 times×1/2 times=1/4 times).

Figure 38:
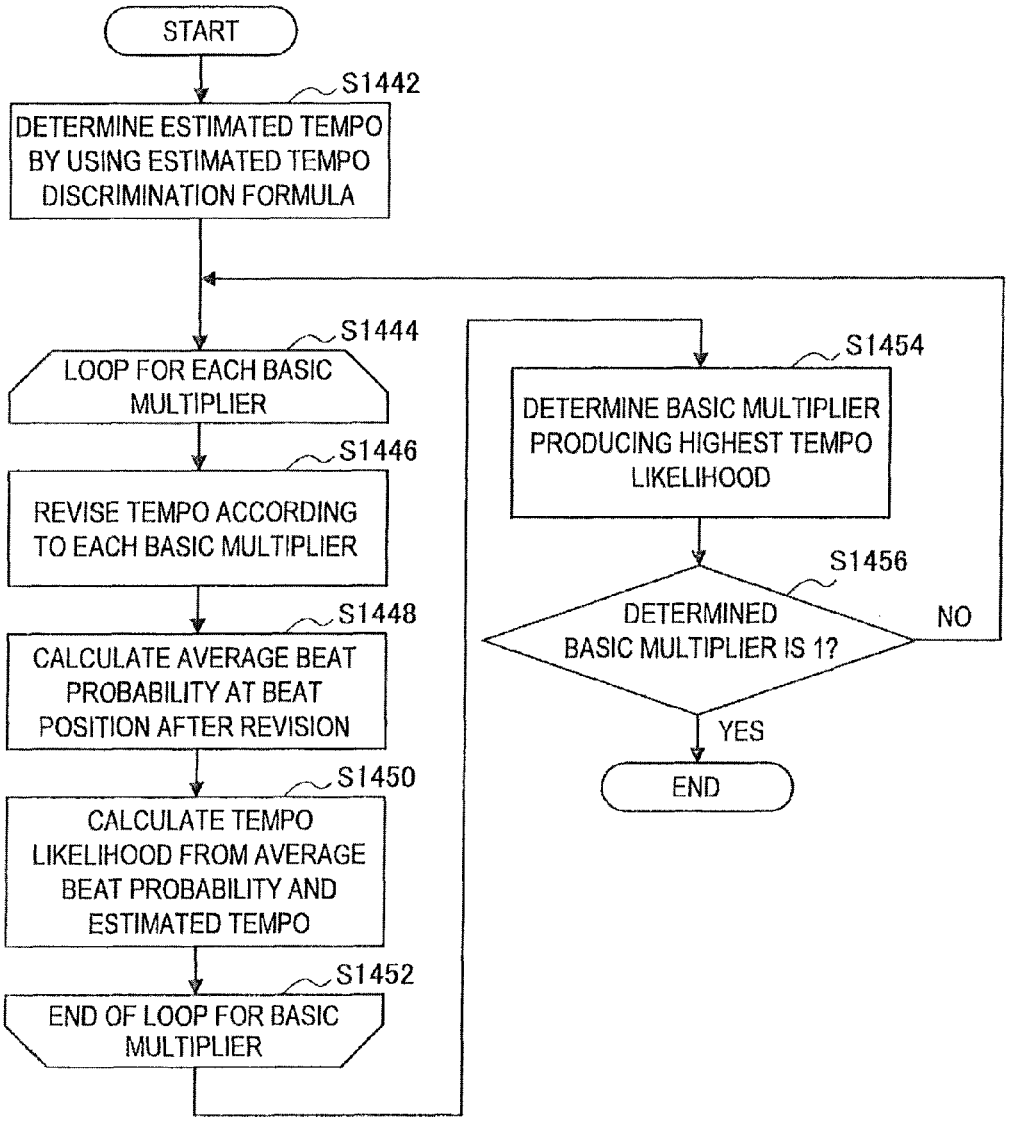
FIG. 38 is an explanatory diagram showing an example of the beat detection method according to the present embodiment.

Here, referring to FIG. 38, a revision process flow of the tempo revision unit 164 will be briefly described. As shown in FIG. 38, first, the tempo revision unit 164 determines an estimated tempo from the audio signal by using an estimated tempo discrimination formula obtained in advance by the feature quantity calculation formula generation apparatus 10 (S1442). Next, the tempo revision unit 164 sequentially executes a loop for a plurality of basic multipliers (such as 1/3, 1/2, or the like) (S1444). Within the loop, the tempo revision unit 164 changes the beat positions according to each basic multiplier and revises the tempo (S1446). Next, the tempo revision unit 164 calculates the average beat probability of the revised beat positions (S1448). Next, the tempo revision unit 164 calculates the tempo likelihood for each basic multiplier based on the average beat probability calculated at S1448 and the estimated tempo determined at S1442 (S1450).

Then, when the loop is over for all the basic multipliers (S1452), the tempo revision unit 164 determines the basic multiplier producing the highest tempo likelihood (S1454). Then, the tempo revision unit 164 decides whether the basic multiplier producing the highest tempo likelihood is 1 (S1456). If the basic multiplier producing the highest tempo likelihood is 1, the tempo revision unit 164 ends the revision process. On the other hand, when the basic multiplier producing the highest tempo likelihood is not 1, the tempo revision unit 164 returns to the process of step S1444. Thereby, a revision of tempo according to any of the basic multipliers is again conducted based on the tempo (beat positions) revised according to the basic multiplier producing the highest tempo likelihood.

Heretofore, the configuration of the beat detection unit 116 has been described. The smoothing unit 114 smoothes the melody line for each beat section based on the information of the beat positions detected in the above-described manner, and outputs the same as the detection result of the melody line. Also, the detection result by the beat detection unit 116 is input to the chord probability detection unit 120 (refer to FIG. 2).

(2-9-2. Configuration Example of Chord Probability Detection Unit 120)

Figure 39:
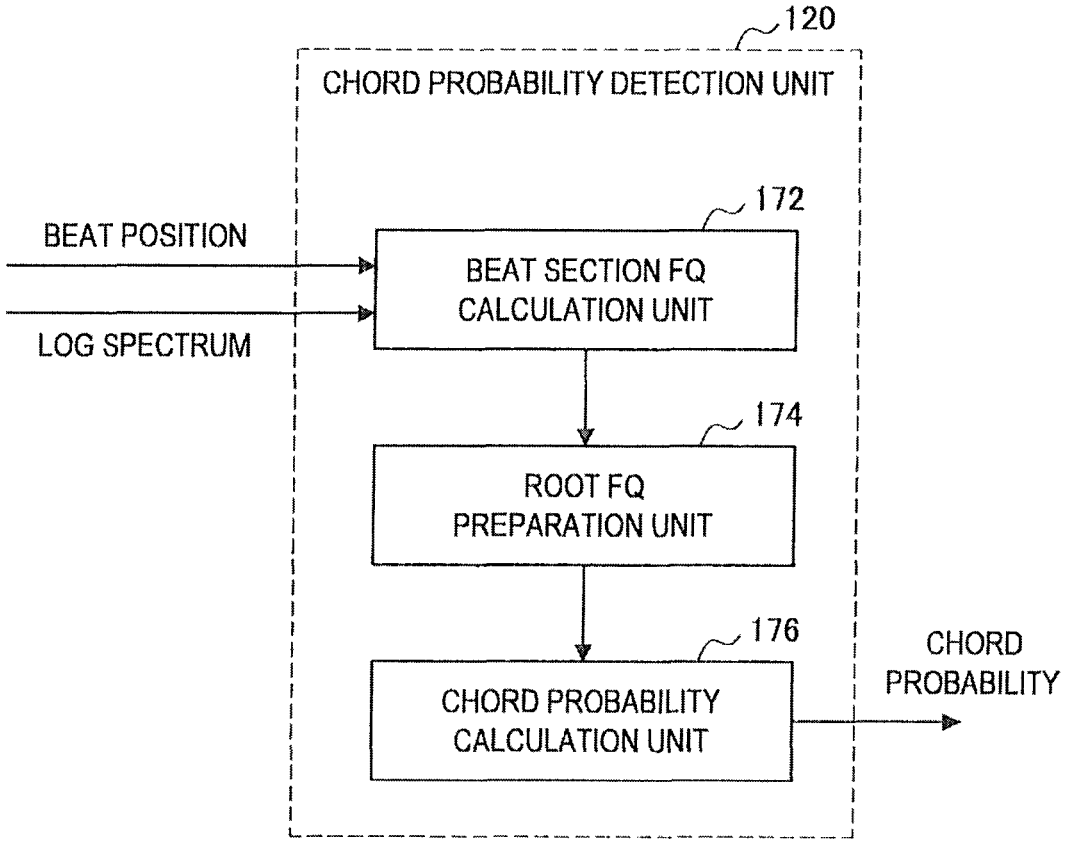
FIG. 39 is an explanatory diagram showing a detailed functional configuration example of a chord probability computation unit according to the present embodiment.

The chord probability detection unit 120 computes a probability (hereinafter, chord probability) of each chord being played in the beat section of each beat detected by the beat analysis unit 144. As described above, the chord probability computed by the chord probability detection unit 120 is used for the key detection process by the key detection unit 118. As shown in FIG. 39, the chord probability detection unit 120 includes a beat section feature quantity calculation unit 172, a root feature quantity preparation unit 174, and a chord probability calculation unit 176.

As described above, the information of the beat positions detected by the beat detection unit 116 and the log spectrum are input to the chord probability detection unit 120. Thus, the beat section feature quantity calculation unit 172 calculates energies-of-respective-12-notes as beat section feature quantity representing the feature of the audio signal in a beat section, with respect to each beat detected by the beat analysis unit 144. The beat section feature quantity calculation unit 172 calculates the energies-of-respective-12-notes as the beat section feature quantity, and inputs the same to the root feature quantity preparation unit 174. The root feature quantity preparation unit 174 generates root feature quantity to be used for the computation of the chord probability for each beat section based on the energies-of-respective-12-notes input from the beat section feature quantity calculation unit 172. For example, the root feature quantity preparation unit 174 generates the root feature quantity by methods shown in FIGS. 40 and 41.

Figure 40:
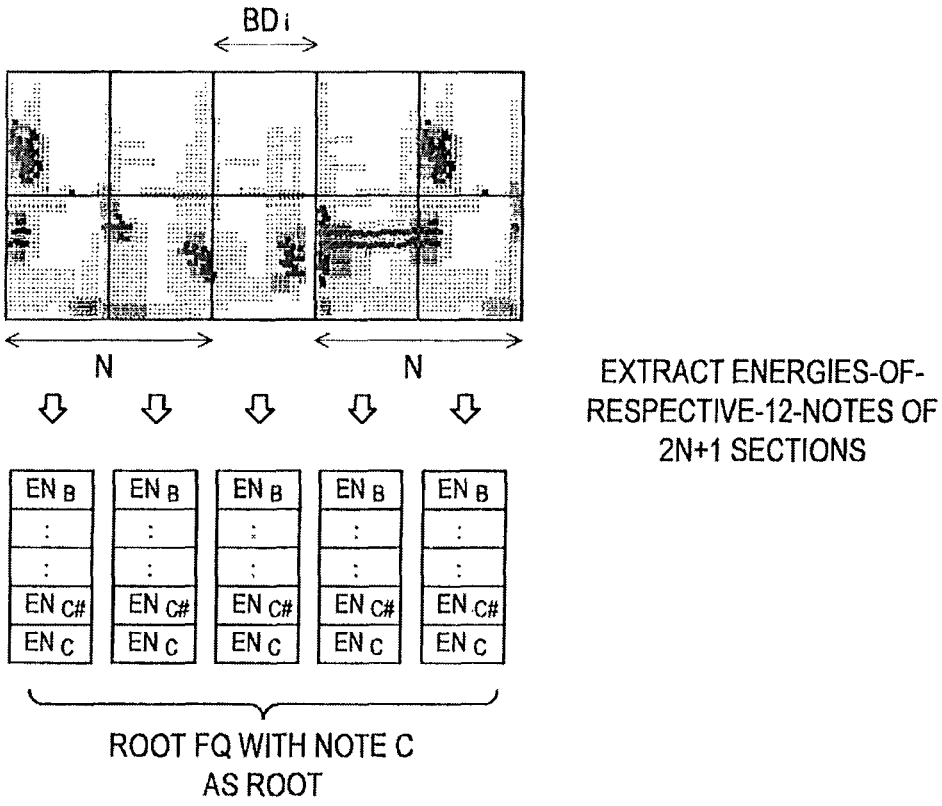
FIG. 40 is an explanatory diagram showing an example of a chord probability computation method according to the present embodiment.
Figure 41:
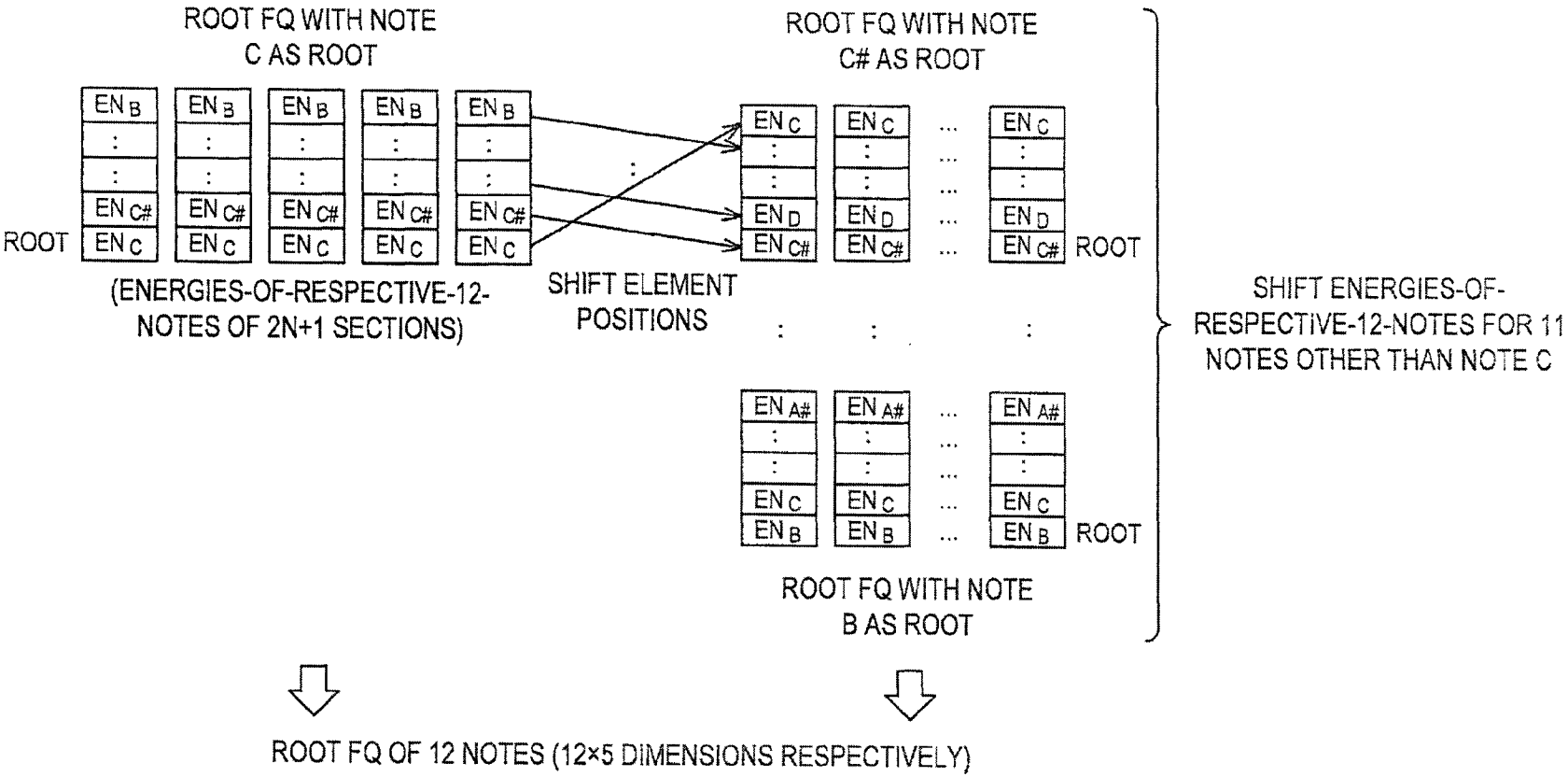
FIG. 41 is an explanatory diagram showing an example of a chord probability computation method according to the present embodiment.

First, the root feature quantity preparation unit 174 extracts, for a focused beat section $BD_i$, the energies-of-respective-12-notes of the focused beat section $BD_i$ and the preceding and following N sections (also referred to as "2N+1 sections") (refer to FIG. 40). The energies-of-respective-12-notes of the focused beat section $BD_i$ and the preceding and following N sections can be considered as a feature quantity with the note C as the root (fundamental note) of the chord. In the example of FIG. 40, since N is 2, a root feature quantity for five sections (12×5 dimensions) having the note C as the root is extracted. Next, the root feature quantity preparation unit 174 generates 11 separate root feature quantities, each for five sections and each having any of note C# to note B as the root, by shifting by a specific number the element positions of the 12 notes of the root feature quantity for five sections having the note C as the root (refer to FIG. 41). Moreover, the number of shifts by which the element position are shifted is 1 for a case where the note C# is the root, 2 for a case where the note D is the root, . . . , and 11 for a case where the note B is the root. As a result, the root feature quantities (12×5-dimensional, respectively), each having one of the 12 notes from the note C to the note B as the root, are generated for the respective 12 notes by the root feature quantity preparation unit 174.

The root feature quantity preparation unit 174 performs the root feature quantity generation process as described above for all the beat sections, and prepares a root feature quantity used for the computation of the chord probability for each section. Moreover, in the examples of FIGS. 40 and 41, a feature quantity prepared for one beat section is a 12×5×12-dimensional vector. The root feature quantities generated by the root feature quantity preparation unit 174 are input to the chord probability calculation unit 176. The chord probability calculation unit 176 computes, for each beat section, a probability (chord probability) of each chord being played, by using the root feature quantities input from the root feature quantity preparation unit 174. "Each chord" here means each of the chords distinguished based on the root (C, C#, D, . . . ), the number of constituent notes (a triad, a 7th chord, a 9th chord), the tonality (major/minor), or the like, for example. A chord probability formula learnt in advance by a logistic regression analysis can be used for the computation of the chord probability, for example.

For example, the chord probability calculation unit 176 generates the chord probability formula to be used for the calculation of the chord probability by a method shown in FIG. 42. The learning of the chord probability formula is performed for each type of chord. That is, a learning process described below is performed for each of a chord probability formula for a major chord, a chord probability formula for a minor chord, a chord probability formula for a 7th chord and a chord probability formula for a 9th chord, for example.

First, a plurality of root feature quantities (for example, 12×5×12-dimensional vectors described by using FIG. 41), each for a beat section whose correct chord is known, are provided as independent variables for the logistic regression analysis. Furthermore, dummy data for predicting the generation probability by the logistic regression analysis is provided for each of the root feature quantity for each beat section. For example, when learning the chord probability formula for a major chord, the value of the dummy data will be a true value (1) if a known chord is a major chord, and a false value (0) for any other case. On the other hand, when learning the chord probability formula for a minor chord, the value of the dummy data will be a true value (1) if a known chord is a minor chord, and a false value (0) for any other case. The same can be said for the 7th chord and the 9th chord.

Figure 43:
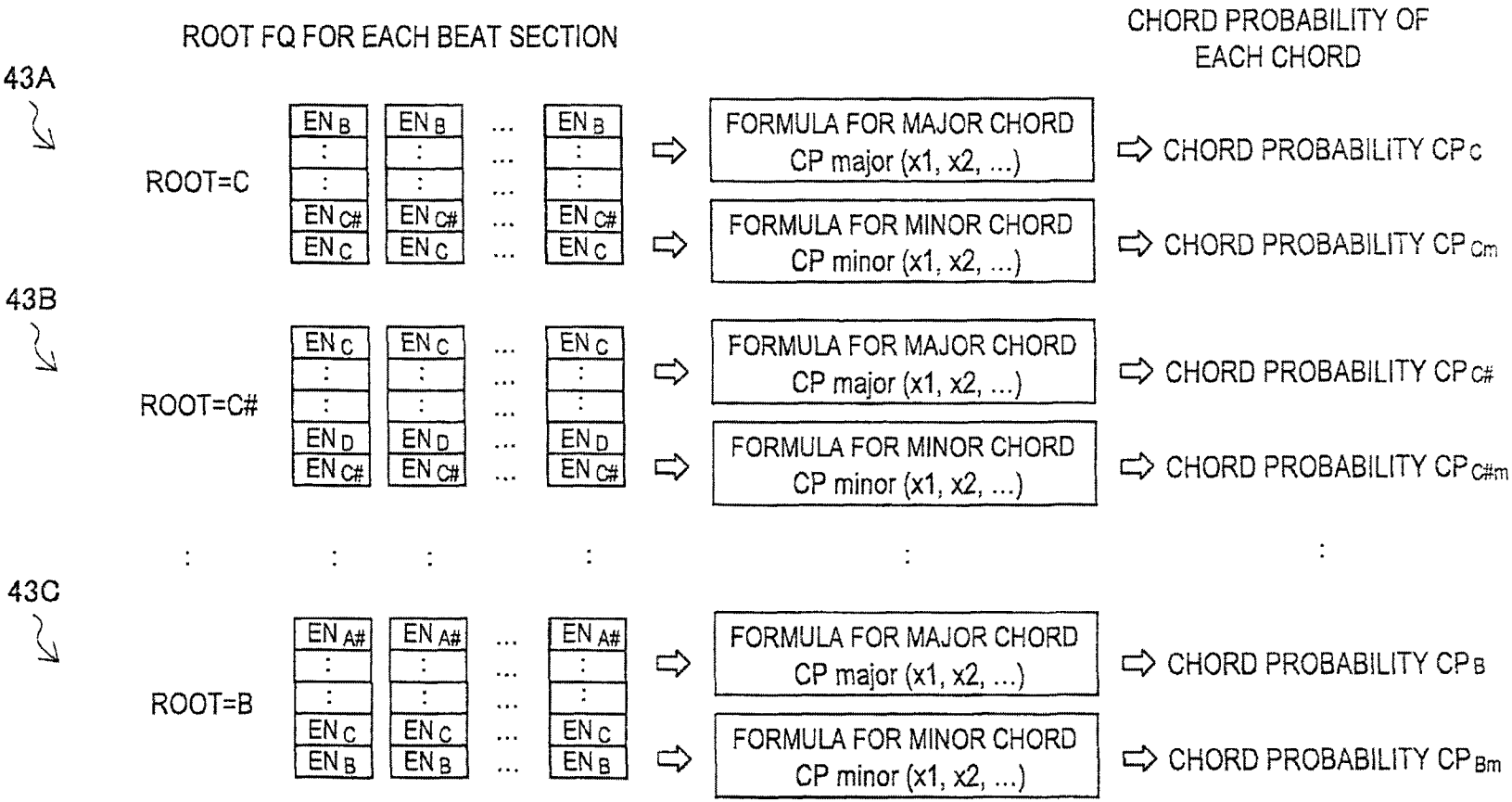
FIG. 43 is an explanatory diagram showing an example of the chord probability computation method according to the present embodiment.

By performing the logistic regression analysis for a sufficient number of the root feature quantities, each for a beat section, by using the independent variables and the dummy data as described above, chord probability formulae for computing the chord probabilities from the root feature quantity for each beat section are generated. Then, the chord probability calculation unit 176 applies the root feature quantities input from the root feature quantity preparation unit 174 to the generated chord probability formulae, and sequentially computes the chord probabilities for respective types of chords for each beat section. The chord probability calculation process by the chord probability calculation unit 176 is performed by a method as shown in FIG. 43, for example. In FIG. 43(A), a root feature quantity with the note C as the root, among the root feature quantity for each beat section, is shown.

For example, the chord probability calculation unit 176 applies the chord probability formula for a major chord to the root feature quantity with the note C as the root, and calculates a chord probability $CP_C$ of the chord being "C" for each beat section. Furthermore, the chord probability calculation unit 176 applies the chord probability formula for a minor chord to the root feature quantity with the note C as the root, and calculates a chord probability $CP_{Cm}$ of the chord being "Cm" for the beat section. In a similar manner, the chord probability calculation unit 176 applies the chord probability formula for a major chord and the chord probability formula for a minor chord to the root feature quantity with the note C# as the root, and can calculate a chord probability $CP_{C\#}$ for the chord "C#" and a chord probability $CP_{C\#m}$ for the chord "C#m" (B). A chord probability $CP_B$ for the chord "B" and a chord probability $CP_{Bm}$ for the chord "Bm" are calculated in the same manner (C).

Figure 44:
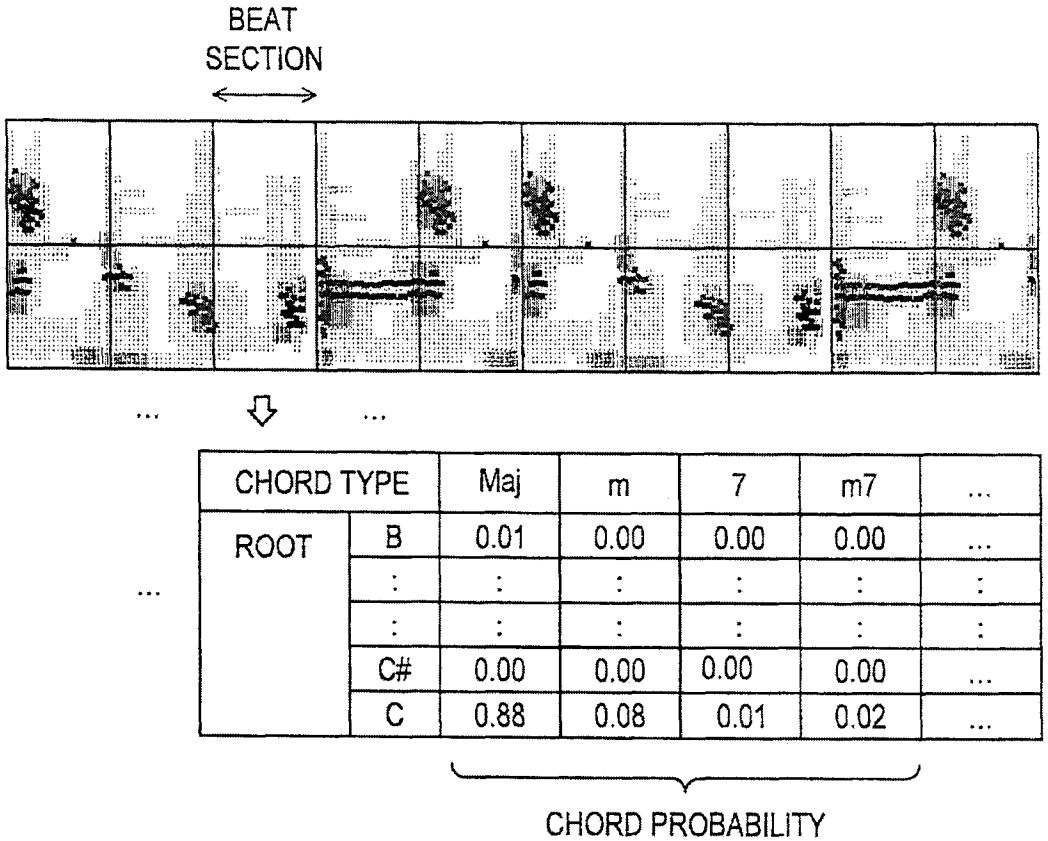
FIG. 44 is an explanatory diagram showing an example of the chord probability computation method according to the present embodiment.

The chord probability as shown in FIG. 44 is computed by the chord probability calculation unit 176 by the above-described method. Referring to FIG. 44, the chord probability is calculated, for a certain beat section, for chords, such as "Maj (major)," "m (minor)," 7 (7th)," and "m7 minor 7th)," for each of the 12 notes from the note C to the note B. According to the example of FIG. 44, the chord probability $CP_C$ is 0.88, the chord probability $CP_{Cm}$ is 0.08, the chord probability $CP_{C7}$ is 0.01, the chord probability $CP_{Cm7}$ is 0.02, and the chord probability $CP_B$ is 0.01. Chord probability values for other types all indicate 0. Moreover, after calculating the chord probability for a plurality of types of chords in the above-described manner, the chord probability calculation unit 176 normalizes the probability values in such a way that the total of the computed probability values becomes 1 per beat section. The calculation and normalization processes for the chord probabilities by the chord probability calculation unit 176 as described above are repeated for all the beat sections included in the audio signal.

The chord probability is computed by the chord probability detection unit 120 by the processes by the beat section feature quantity calculation unit 172, the root feature quantity preparation unit 174 and the chord probability calculation unit 176 as described above. Then, the chord probability computed by the chord probability detection unit 120 is input to the key detection unit 118 (refer to FIG. 2).

(2-9-3. Configuration Example of Key Detection Unit 118)

Figure 45:
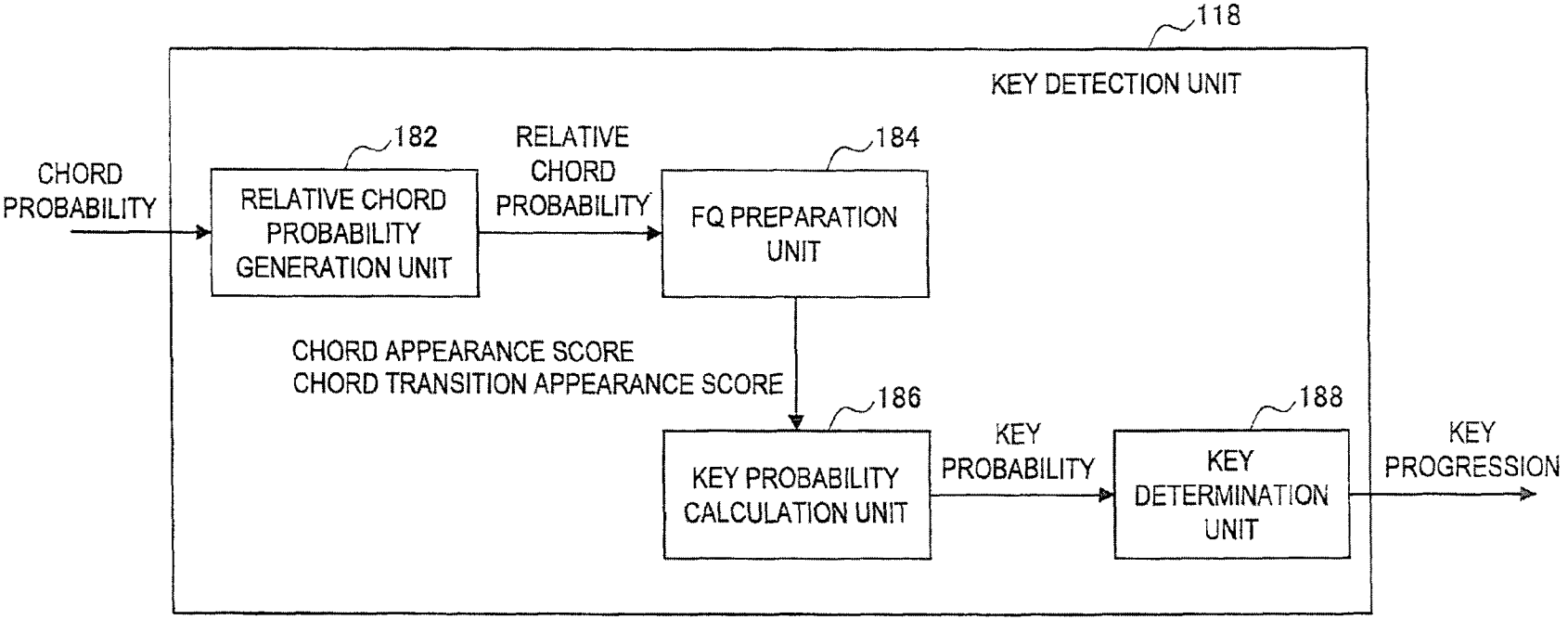
FIG. 45 is an explanatory diagram showing a detailed functional configuration example of a key detection unit according to the present embodiment.

Next, the configuration of the key detection unit 118 will be described. As described above, the chord probability computed by the chord probability detection unit 120 is input to the key detection unit 118. The key detection unit 118 is means for detecting the key (tonality/basic scale) for each beat section by using the chord probability computed by the chord probability detection unit 120 for each beat section. As shown in FIG. 45, the key detection unit 118 includes a relative chord probability generation unit 182, a feature quantity preparation unit 184, a key probability calculation unit 186, and a key determination unit 188.

Figure 46:
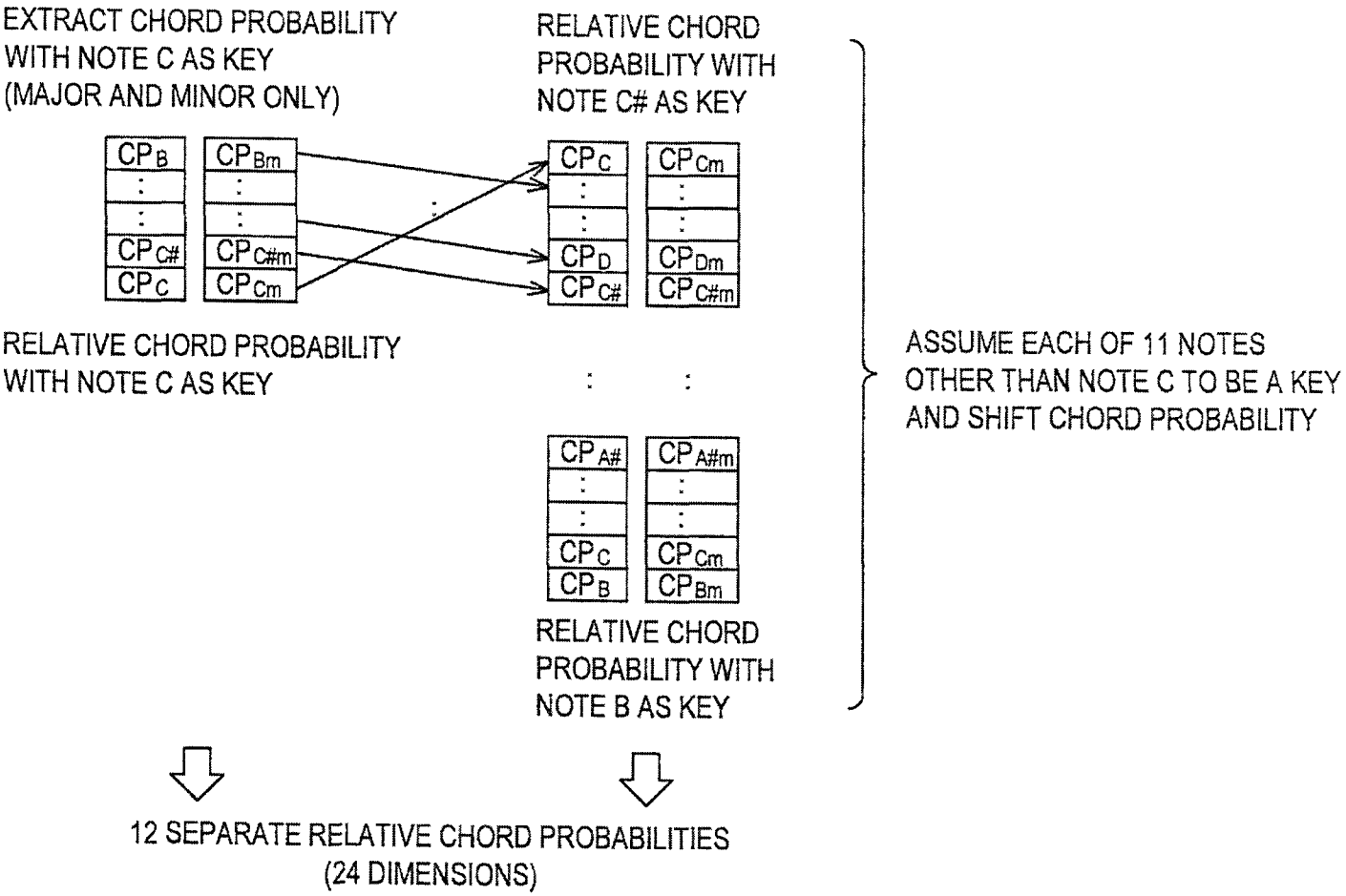
FIG. 46 is an explanatory diagram showing an example of a key detection method according to the present embodiment.

First, the chord probability is input to the relative chord probability generation unit 182 by the chord probability detection unit 120. The relative chord probability generation unit 182 generates a relative chord probability used for the computation of the key probability for each beat section, from the chord probability for each beat section that is input from the chord probability detection unit 120. For example, the relative chord probability generation unit 182 generates the relative chord probability by a method as shown in FIG. 46. First, the relative chord probability generation unit 182 extracts the chord probability relating to the major chord and the minor chord from the chord probability for a certain focused beat section. The chord probability values extracted here are expressed as a vector of total 24 dimensions, i.e. 12 notes for the major chord and 12 notes for the minor chord. Hereunder, the 24-dimensional vector including the chord probability values extracted here will be treated as the relative chord probability with the note C assumed to be the key.

Next, the relative chord probability generation unit 182 shifts, by a specific number, the element positions of the 12 notes of the extracted chord probability values for the major chord and the minor chord. By shifting in this manner, 11 separate relative chord probabilities are generated. Moreover, the number of shifts by which the element positions are shifted is the same as the number of shifts at the time of generation of the root feature quantities as described using FIG. 41. In this manner, 12 separate relative chord probabilities, each assuming one of the 12 notes from the note C to the note B as the key, are generated by the relative chord probability generation unit 182. The relative chord probability generation unit 182 performs the relative chord probability generation process as described for all the beat sections, and inputs the generated relative chord probabilities to the feature quantity preparation unit 184.

The feature quantity preparation unit 184 generates a feature quantity to be used for the computation of the key probability for each beat section. A chord appearance score and a chord transition appearance score for each beat section that are generated from the relative chord probability input to the feature quantity preparation unit 184 from the relative chord probability generation unit 182 are used as the feature quantity to be generated by the feature quantity preparation unit 184.

Figure 47:
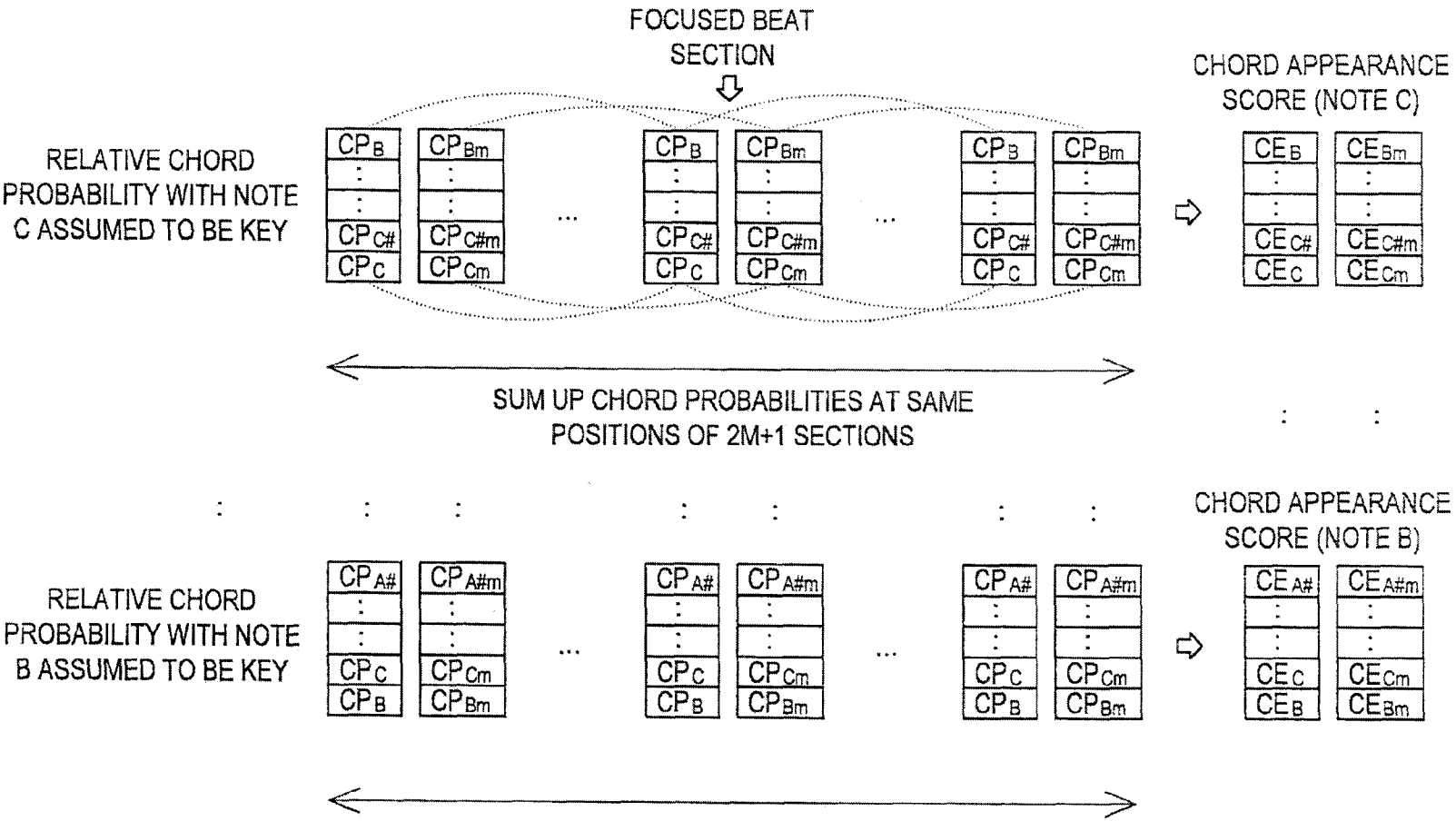
FIG. 47 is an explanatory diagram showing an example of the key detection method according to the present embodiment.

First, the feature quantity preparation unit 184 generates the chord appearance score for each beat section by a method as shown in FIG. 47. First, the feature quantity preparation unit 184 provides relative chord probabilities CP, with the note C assumed to be the key, for the focused beat section and the preceding and following M beat sections. Then, the feature quantity preparation unit 184 sums up, across the focused beat section and the preceding and following M sections, the probability values of the elements at the same position, the probability values being included in the relative chord probabilities with the note C assumed to be the key. As a result, a chord appearance score ($CE_C$, $CE_{C\#}$, $CE_{Bm}$) (24-dimensional vector) is obtained, which is in accordance with the appearance probability of each chord, the appearance probability being for the focused beat section and a plurality of beat sections around the focused beat section and assuming the note C to be the key. The feature quantity preparation unit 184 performs the calculation of the chord appearance score as described above for cases each assuming one of the 12 notes from the note C to the note B to be the key. According to this calculation, 12 separate chord appearance scores are obtained for one focused beat section.

Figure 48:
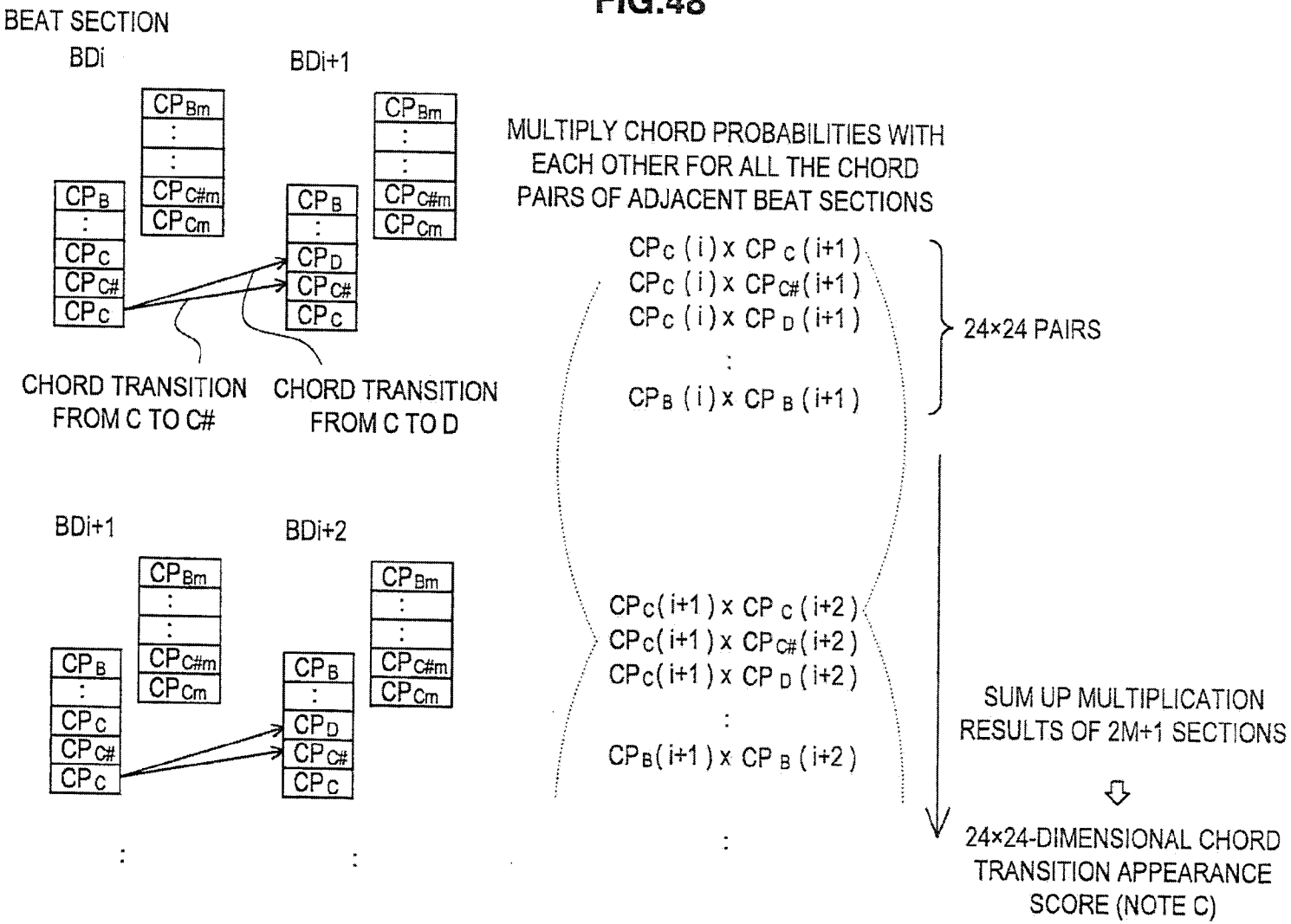
FIG. 48 is an explanatory diagram showing an example of the key detection method according to the present embodiment.

Next, the feature quantity preparation unit 184 generates the chord transition appearance score for each beat section by a method as shown in FIG. 48. First, the feature quantity preparation unit 184 first multiplies with each other the relative chord probabilities before and after the chord transition, the relative chord probabilities assuming the note C to be the key, with respect to all the pairs of chords (all the chord transitions) between a beat section $BD_i$ and an adjacent beat section $BD_{i+1}$. Here, "all the pairs of the chords" means the 24×24 pairs, i.e. "C"→"C," "C"→"C#," "C"→"D," . . . , "B"→"B." Next, the feature quantity preparation unit 184 sums up the multiplication results of the relative chord probabilities before and after the chord transition for over the focused beat section and the preceding and following M sections. As a result, a 24×24-dimensional chord transition appearance score (a 24×24-dimensional vector) is obtained, which is in accordance with the appearance probability of each chord transition, the appearance probability being for the focused beat section and a plurality of beat sections around the focused beat section and assuming the note C to be the key. For example, a chord transition appearance score $CT_{C\rightarrow C\#(i)}$ regarding the chord transition from "C" to "C#" for a focused beat section $BD_i$ is given by the following equation (15).

[Equation 11]

$$CT_{C\rightarrow C\#}(i)=CP_C(i-M)\cdot CP_{C\#}(i-M+1)+\ldots+CP_C(i+M)\cdot CP_{C\#}(i+M+1) \quad (15)$$

In this manner, the feature quantity preparation unit 184 performs the above-described 24×24 separate calculations for the chord transition appearance score CT for each case assuming one of the 12 notes from the note C to the note B to be the key. According to this calculation, 12 separate chord transition appearance scores are obtained for one focused beat section. Moreover, unlike the chord which is apt to change for each bar, for example, the key of a music piece remains unchanged, in many cases, for a longer period. Thus, the value of M defining the range of relative chord probabilities to be used for the computation of the chord appearance score or the chord transition appearance score is suitably a value which may include a number of bars such as several tens of beats, for example. The feature quantity preparation unit 184 inputs, as the feature quantity for calculating the key probability, the 24-dimensional chord appearance score CE and the 24×24-dimensional chord transition appearance score that are calculated for each beat section to the key probability calculation unit 186.

Figure 49:
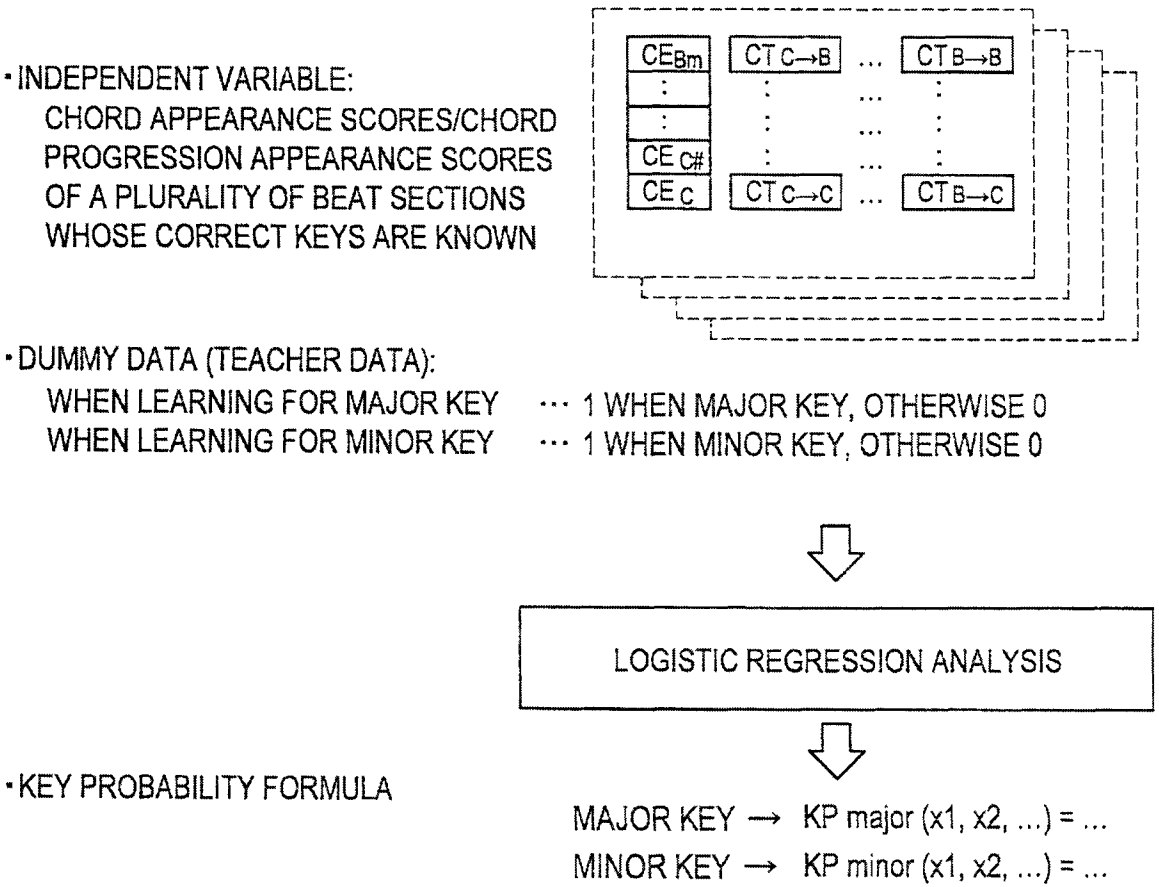
FIG. 49 is an explanatory diagram showing an example of the key detection method according to the present embodiment.

The key probability calculation unit 186 computes, for each beat section, the key probability indicating the probability of each key being played, by using the chord appearance score and the chord transition appearance score input from the feature quantity preparation unit 184. "Each key" means a key distinguished based on, for example, the 12 notes (C, C#, D, . . . ) or the tonality (major/minor). For example, a key probability formula learnt in advance by the logistic regression analysis is used for the calculation of the key probability. For example, the key probability calculation unit 186 generates the key probability formula to be used for the calculation of the key probability by a method as shown in FIG. 49. The learning of the key probability formula is performed independently for the major key and the minor key. Accordingly, a major key probability formula and a minor key probability formula are generated.

As shown in FIG. 49, a plurality of chord appearance scores and chord progression appearance scores for respective beat sections whose correct keys are known are provided as the independent variables in the logistic regression analysis. Next, dummy data for predicting the generation probability by the logistic regression analysis is provided for each of the provided pairs of the chord appearance score and the chord progression appearance score. For example, when learning the major key probability formula, the value of the dummy data will be a true value (1) if a known key is a major key, and a false value (0) for any other case. Also, when learning the minor key probability formula, the value of the dummy data will be a true value (1) if a known key is a minor key, and a false value (0) for any other case.

Figure 50:
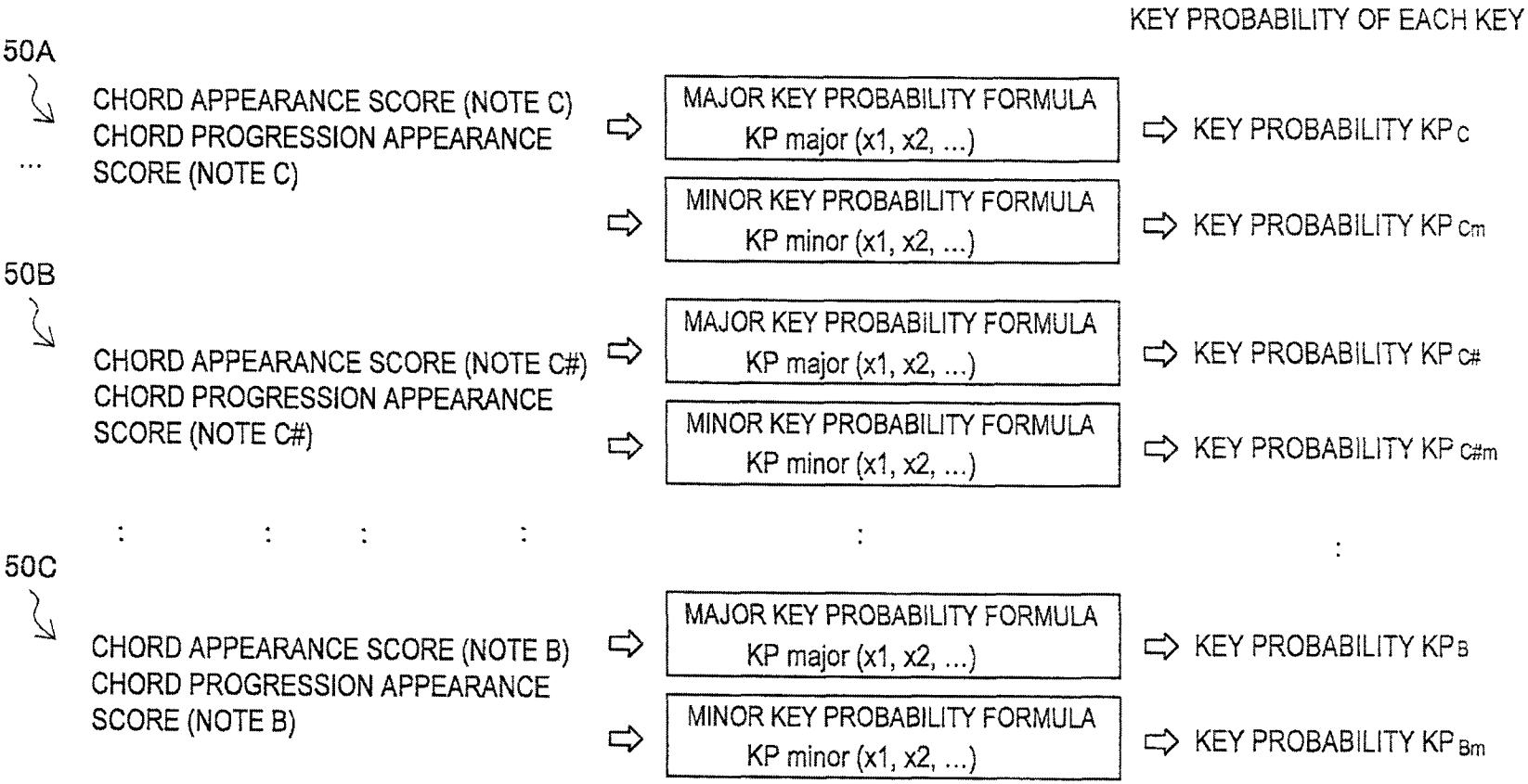
FIG. 50 is an explanatory diagram showing an example of the key detection method according to the present embodiment.

By performing the logistic regression analysis by using a sufficient number of pairs of the independent variable and the dummy data, the key probability formula for computing the probability of the major key or the minor key from a pair of the chord appearance score and the chord progression appearance score for each beat section is generated. The key probability calculation unit 186 applies a pair of the chord appearance score and the chord progression appearance score input from the feature quantity preparation unit 184 to each of the key probability formulae, and sequentially computes the key probabilities for respective keys for each beat section. For example, the key probability is calculated by a method as shown in FIG. 50.

For example, in FIG. 50(A), the key probability calculation unit 186 applies a pair of the chord appearance score and the chord progression appearance score with the note C assumed to be the key to the major key probability formula obtained in advance by learning, and calculates a key probability $KP_C$ of the key being "C" for each beat section. Also, the key probability calculation unit 186 applies the pair of the chord appearance score and the chord progression appearance score with the note C assumed to be the key to the minor key probability formula, and calculates a key probability $KP_{Cm}$ of the key being "Cm" for the corresponding beat section. Similarly, the key probability calculation unit 186 applies a pair of the chord appearance score and the chord progression appearance score with the note C# assumed to be the key to the major key probability formula and the minor key probability formula, and calculates key probabilities $KP_{C\#}$ and $KP_{C\#m}$ (B). The same can be said for the calculation of key probabilities $KP_B$ and $KP_{Bm}$ (C).

Figure 51:
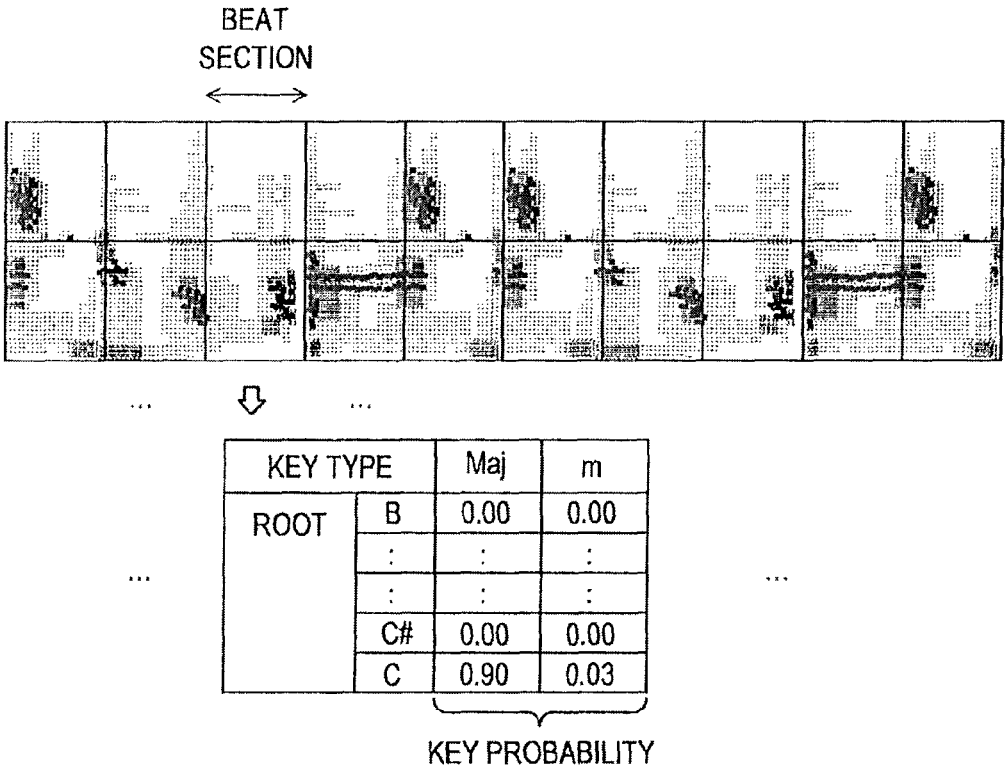
FIG. 51 is an explanatory diagram showing an example of the key detection method according to the present embodiment.

By such calculations, a key probability as shown in FIG. 51 is computed, for example. Referring to FIG. 51, two types of key probabilities, each for "Maj (major)" and "m (minor)," are calculated for a certain beat section for each of the 12 notes from the note C to the note B. According to the example of FIG. 51, the key probability $KP_C$ is 0.90, and the key probability $KP_{Cm}$ is 0.03. Furthermore, key probability values other than the above-described key probability all indicate 0. After calculating the key probability for all the types of keys, the key probability calculation unit 186 normalizes the probability values in such a way that the total of the computed probability values becomes 1 per beat section. The calculation and normalization process by the key probability calculation unit 186 as described above are repeated for all the beat sections included in the audio signal. The key probability for each key computed for each beat section in this manner is input to the key determination unit 188.

Figure 52:
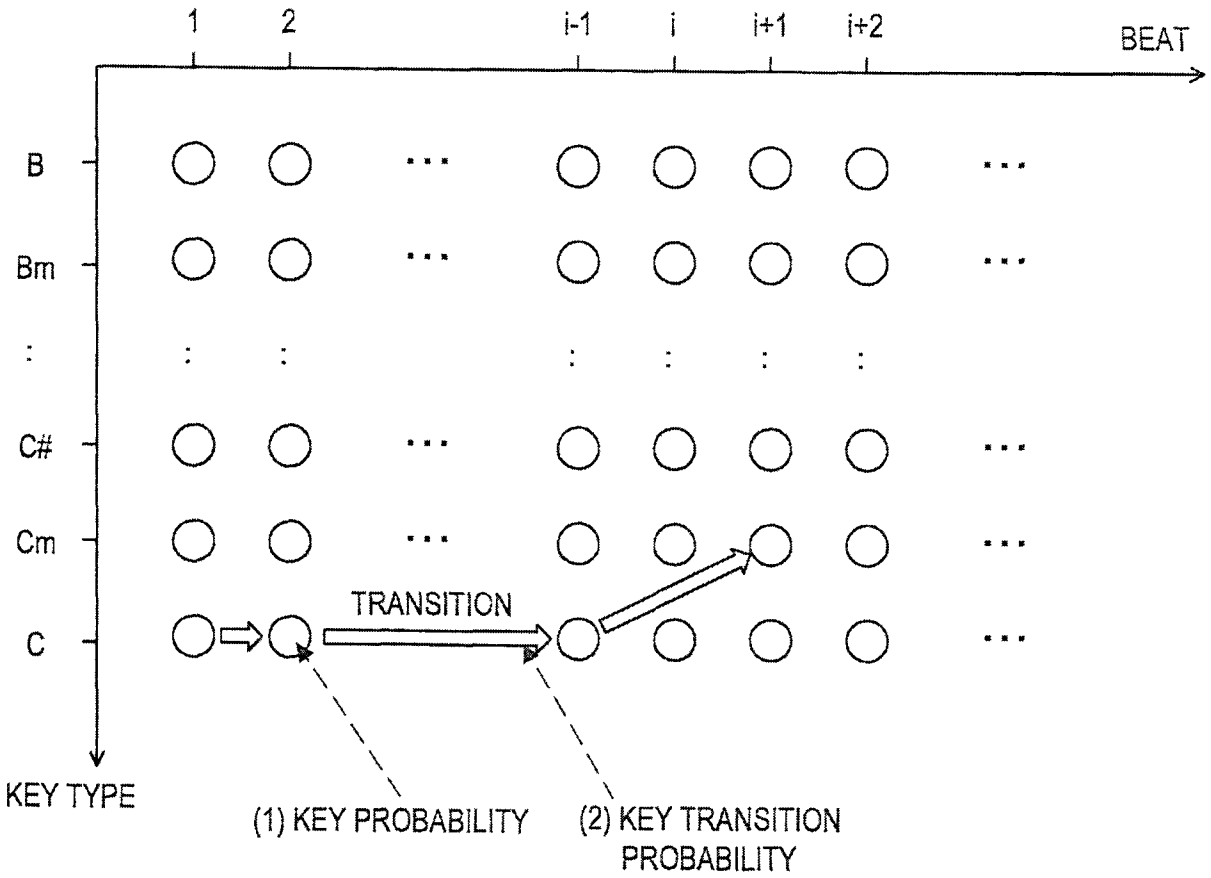
FIG. 52 is an explanatory diagram showing an example of the key detection method according to the present embodiment.

The key determination unit 188 determines a likely key progression by a path search based on the key probability of each key computed by the key probability calculation unit 186 for each beat section. The Viterbi algorithm described above is used as the method of path search by the key determination unit 188, for example. The path search for a Viterbi path is performed by a method as shown in FIG. 52, for example. At this time, beats are arranged sequentially as the time axis (horizontal axis) and the types of keys are arranged as the observation sequence (vertical axis). Accordingly, the key determination unit 188 takes, as the subject node of the path search, each of all the pairs of the beat for which the key probability has been computed by the key probability calculation unit 186 and a type of key.

With regard to the node as described, the key determination unit 188 sequentially selects, along the time axis, any of the nodes, and evaluates a path formed from a series of selected nodes by using two evaluation values, (1) key probability and (2) key transition probability. Moreover, skipping of beat is not allowed at the time of selection of a node by the key determination unit 188. Here, (1) key probability to be used for the evaluation is the key probability that is computed by the key probability calculation unit 186. The key probability is given to each of the node shown in FIG. 52. On the other hand, (2) key transition probability is an evaluation value given to a transition between nodes. The key transition probability is defined in advance for each pattern of modulation, based on the occurrence probability of modulation in a music piece whose correct keys are known.

Twelve separate values in accordance with the modulation amounts for a transition are defined as the key transition probability for each of the four patterns of key transitions: from major to major, from major to minor, from minor to major, and from minor to minor. FIG. 53 shows an example of the 12 separate probability values in accordance with the modulation amounts for a key transition from major to major. In the example of FIG. 53, when the key transition probability in relation to a modulation amount $\Delta k$ is $Pr(\Delta k)$, the key transition probability Pr(0) is 0.9987. This indicates that the probability of the key changing in a music piece is very low. On the other hand, the key transition probability Pr(1) is 0.0002. This indicates that the probability of the key being raised by one pitch (or being lowered by 11 pitches) is 0.02%. Similarly, in the example of FIG. 53, Pr(2), Pr(3), Pr(4), Pr(5), Pr(7), Pr(8), Pr(9) and Pr(10) are respectively 0.0001. Also, Pr(6) and Pr(11) are respectively 0.0000. The 12 separate probability values in accordance with the modulation amounts are respectively defined also for each of the transition patterns: from major to minor, from minor to major, and from minor to minor.

Figure 54:
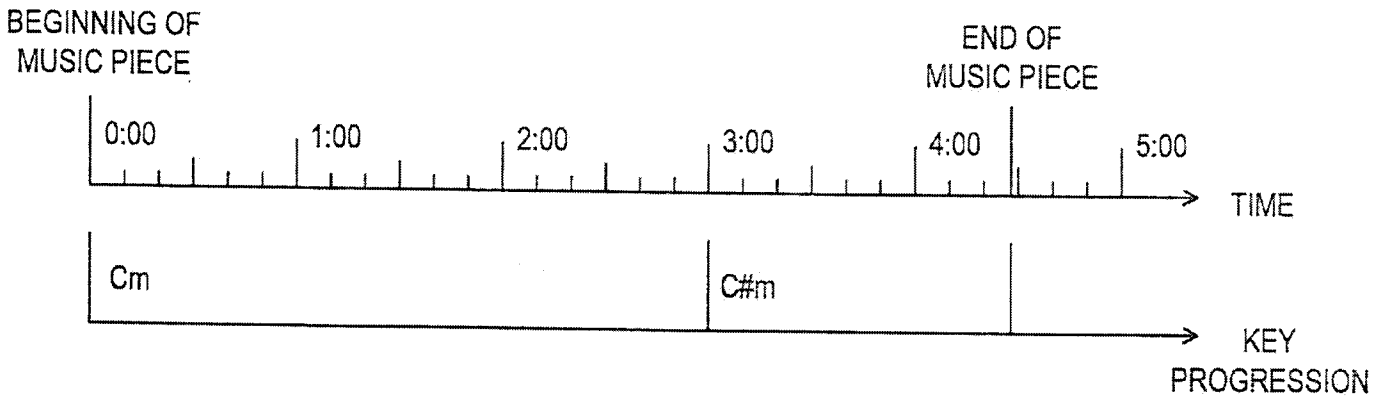
FIG. 54 is an explanatory diagram showing an example of the key detection method according to the present embodiment.

The key determination unit 188 sequentially multiplies with each other (1) key probability of each node included in a path and (2) key transition probability given to a transition between nodes, with respect to each path representing the key progression. Then, the key determination unit 188 determines the path for which the multiplication result as the path evaluation value is the largest as the optimum path representing a likely key progression. For example, a key progression as shown in FIG. 54 is determined by the key determination unit 188. In FIG. 54, an example of a key progression of a music piece determined by the key determination unit 188 is shown under the time scale from the beginning of the music piece to the end. In this example, the key of the music piece is "Cm" for three minutes from the beginning of the music piece. Then, the key of the music piece changes to "C#m" and the key remains the same until the end of the music piece. The key progression determined by the processing by the relative chord probability generation unit 182, the feature quantity preparation unit 184, the key probability calculation unit 186 and the key determination unit 188 in this manner is input to the melody line determination unit 112 (refer to FIG. 2).

Heretofore, the configurations of the beat detection unit 116, the chord probability detection unit 120 and the key detection unit 118 have been described in detail. As described above, the beats of a music piece detected by the beat detection unit 116 are used by the chord probability detection unit 120 and the smoothing unit 114. Also, the chord probability computed by the chord probability detection unit 120 is used by the key detection unit 118. Furthermore, the key progression detected by the key detection unit 118 is used by the melody line determination unit 112. According to this configuration, a melody line can be extracted with high accuracy from music data by the information processing apparatus 100.

(2-10. Hardware Configuration (Information Processing Apparatus 100))

Figure 55:
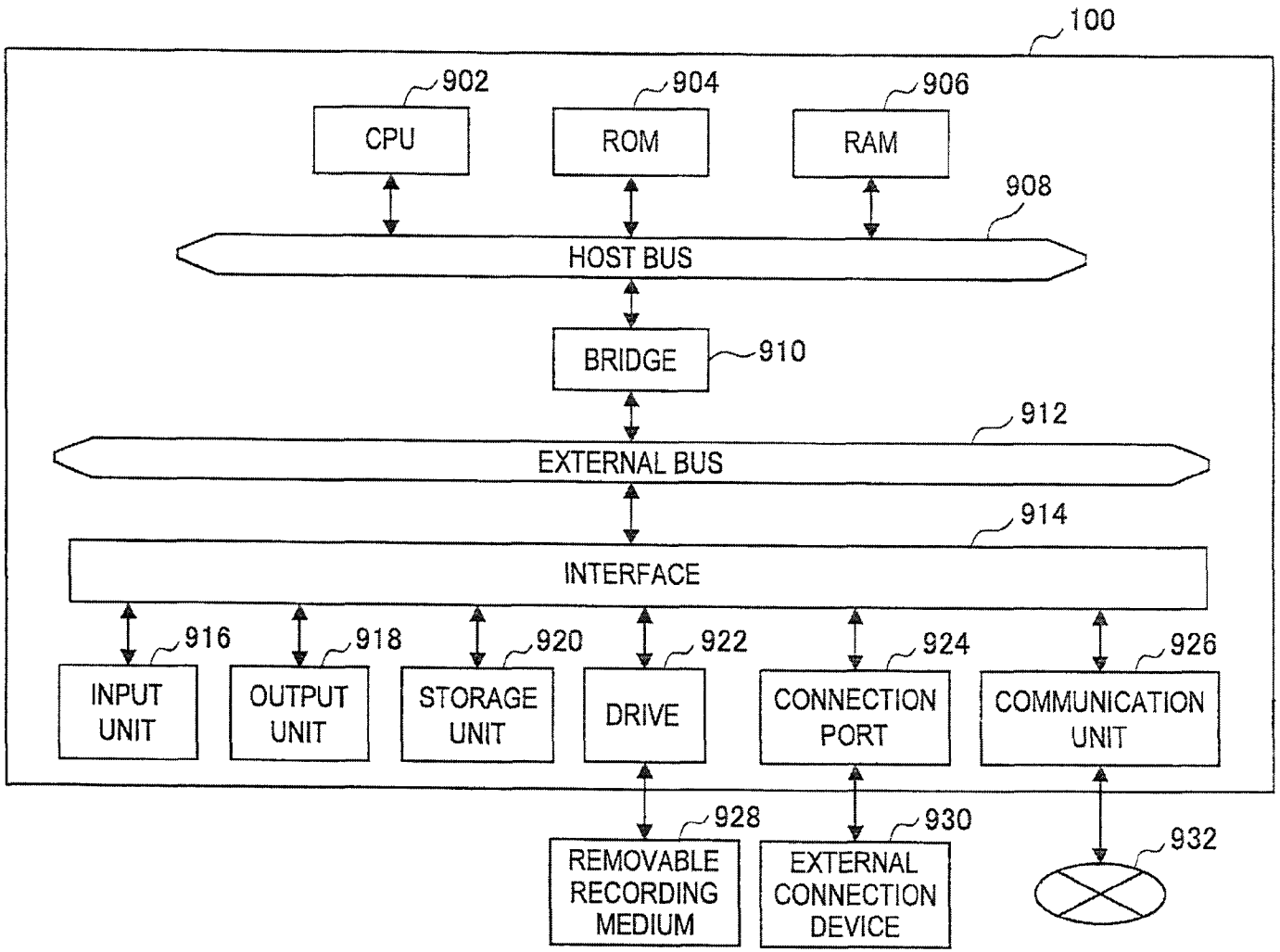
FIG. 55 is an explanatory diagram showing a hardware configuration example of the information processing apparatus according to the present embodiment.

The function of each structural element of the above-described apparatus can be realized by a hardware configuration shown in FIG. 55 and by using a computer program for realizing the above-described function, for example. FIG. 55 is an explanatory diagram showing a hardware configuration of an information processing apparatus capable of realizing the function of each structural element of the above-described apparatus. The mode of the information processing apparatus is arbitrary, and includes modes such as a mobile information terminal such as a personal computer, a mobile phone, a PHS or a PDA, a game machine, or various types of information appliances. Moreover, the PHS is an abbreviation for Personal Handy-phone System. Also, the PDA is an abbreviation for Personal Digital Assistant.

As shown in FIG. 55, the information processing apparatus 100 includes a CPU 902, a ROM 904, a RAM 906, a host bus 908, a bridge 910, an external bus 912, and an interface 914. Furthermore, the information processing apparatus 10 includes an input unit 916, an output unit 918, a storage unit 920, a drive 922, a connection port 924, and a communication unit 926. Moreover, the CPU is an abbreviation for Central Processing Unit. Also, the ROM is an abbreviation for Read Only Memory. Furthermore, the RAM is an abbreviation for Random Access Memory.

The CPU 902 functions as an arithmetic processing unit or a control unit, for example, and controls an entire operation of the structural elements or some of the structural elements on the basis of various programs recorded on the ROM 904, the RAM 906, the storage unit 920, or a removal recording medium 928. The ROM 904 stores, for example, a program loaded on the CPU 902 or data or the like used in an arithmetic operation. The RAM 906 temporarily or perpetually stores, for example, a program loaded on the CPU 902 or various parameters or the like arbitrarily changed in execution of the program. These structural elements are connected to each other by, for example, the host bus 908 which can perform high-speed data transmission. The host bus 908 is connected to the external bus 912 whose data transmission speed is relatively low through the bridge 910, for example.

The input unit 916 is, for example, operation means such as a mouse, a keyboard, a touch panel, a button, a switch, or a lever. The input unit 916 may be remote control means (so-called remote control) that can transmit a control signal by using an infrared ray or other radio waves. The input unit 916 includes an input control circuit or the like to transmit information input by using the above-described operation means to the CPU 902 as an input signal.

The output unit 918 is, for example, a display device such as a CRT, an LCD, a PDP, or an ELD. Also, the output unit 918 is a device such an audio output device such as a speaker or headphones, a printer, a mobile phone, or a facsimile that can visually or auditorily notify a user of acquired information. The storage unit 920 is a device to store various data, and includes, for example, a magnetic storage device such as an HDD, a semiconductor storage device, an optical storage device, or a magneto-optical storage device. Moreover, the CRT is an abbreviation for Cathode Ray Tube. Also, the LCD is an abbreviation for Liquid Crystal Display. Furthermore, the PDP is an abbreviation for Plasma Display Panel. Furthermore, the ELD is an abbreviation for Electro-Luminescence Display. Furthermore, the HDD is an abbreviation for Hard Disk Drive.

The drive 922 is a device that reads information recorded on the removal recording medium 928 such as a magnetic disk, an optical disk, a magneto-optical disk, or a semiconductor memory or writes information in the removal recording medium 928. The removal recording medium 928 is, for example, a DVD medium, a Blue-ray medium, or an HD-DVD medium. Furthermore, the removable recording medium 928 is, for example, a compact flash (CF; CompactFlash) (registered trademark), a memory stick, or an SD memory card. As a matter of course, the removal recording medium 928 may be, for example, an IC card on which a non-contact IC chip is mounted. Moreover, the SD is an abbreviation for Secure Digital. Also, the IC is an abbreviation for Integrated Circuit.

The connection port 924 is a port such as an USB port, an IEEE1394 port, a SCSI, an RS-232C port, or a port for connecting an external connection device 930 such as an optical audio terminal. The external connection device 930 is, for example, a printer, a mobile music player, a digital camera, a digital video camera, or an IC recorder. Moreover, the USB is an abbreviation for Universal Serial Bus. Also, the SCSI is an abbreviation for Small Computer System Interface.

The communication unit 926 is a communication device to be connected to a network 932. The communication unit 926 is, for example, a communication card for a wired or wireless LAN, Bluetooth (registered trademark), or WUSB, an optical communication router, an ADSL router, or various communication modems. The network 932 connected to the communication unit 926 includes a wire-connected or wirelessly connected network. The network 932 is, for example, the Internet, a home-use LAN, infrared communication, visible light communication, broadcasting, or satellite communication. Moreover, the LAN is an abbreviation for Local Area Network. Also, the WUSB is an abbreviation for Wireless USB. Furthermore, the ADSL is an abbreviation for Asymmetric Digital Subscriber Line.

(2-11. Conclusion)

Lastly, the functional configuration of the information processing apparatus of the present embodiment, and the effects obtained by the functional configuration will be briefly described.

First, the functional configuration of the information processing apparatus according to the present embodiment can be described as follows. The information processing apparatus includes a signal conversion unit, a melody estimation unit and a melody line determination unit as follows. The signal conversion unit is for converting an audio signal to a pitch signal indicating a signal intensity of each pitch. The audio signal is normally given as a signal intensity distribution in a time-frequency space. However, since the centre frequency of each pitch is logarithmically distributed, the signal processing becomes complicated. Thus, the conversion to the pitch signal is performed by the signal conversion unit. Converting the audio signal to the pitch signal in a time-frequency space enables to improve the efficiency of the processes performed later.

Furthermore, the melody probability estimation unit is for estimating a probability of each pitch of the pitch signal being a melody note (melody probability). At this time, the melody probability estimation unit estimates the melody probability for each frame (time unit) of the pitch signal. For example, the learning algorithm already described is used for the estimation of the melody probability. The melody probability estimated for each frame is used by the melody line determination unit. The melody line determination unit is for detecting a maximum likelihood path from among paths of pitches from a start frame to an end frame of the audio signal, and for determining the maximum likelihood path as a melody line, based on the probability of each pitch being a melody note, the probability being estimated for each frame by the melody probability estimation unit. As described, a melody line is estimated not by using the learning algorithm and estimating the whole melody line, but by performing a path search based on the melody probability estimated for each frame by using the learning algorithm. As a result, estimation accuracy for the melody line can be improved.

Furthermore, the above-described information processing apparatus may further include a centre extraction unit for extracting, in a case the audio signal is a stereo signal, a centre signal from the stereo signal. By including the centre extraction unit, an estimation accuracy can be improved at the time of estimating a melody line from the stereo signal. Moreover, in a case of including the centre extraction unit, the signal conversion unit converts the centre signal extracted by the centre extraction unit to the pitch signal. Then, the subsequent processing is performed based on the pitch signal which has been converted from the centre signal.

Furthermore, the above-described information processing apparatus may further include a signal classification unit for classifying the audio signal into a specific category. In this case, the melody probability estimation unit estimates the probability of each pitch being a melody note based on a classification result of the signal classification unit. Furthermore, the melody line determination unit detects the maximum likelihood path based on the classification result of the signal classification unit. As described above, the estimation of the melody probability is realized using the learning algorithm. Therefore, by narrowing down the audio signal (and the feature quantity) to be given to the learning algorithm by the category, more likely melody probability can be estimated. Furthermore, at the time of performing the path search, by weighting, according to each category, the probability for each node (pitch of each frame) and the probability for the transition between node, the estimation accuracy for the maximum likelihood path (melody line) can be improved.

Furthermore, the above-described information processing apparatus may further include a pitch distribution estimation unit for estimating a standard deviation of a pitch which is a melody note, at the same time as estimating for each frame an expectation value for a pitch which is a melody note, with respect to the pitch signal. A rough melody probability distribution can be obtained from the expectation value and the standard deviation estimated by the pitch distribution estimation unit. Thereby, the melody line determination unit detects the maximum likelihood path based on the estimation results of the pitch distribution estimation unit. In this manner, by taking into account a rough melody probability distribution, a detection error relating to the octaves can be reduced.

Furthermore, a smoothing unit for smoothing, for each beat section, a pitch of the melody line determined by the melody line determination unit may be further included. As described, the melody line determined by the melody line determination unit is estimated by an estimation processing for the melody probability and a path search processing. Thus, a subtle fluctuation in the pitch is included in each frame unit. Accordingly, the smoothing unit smoothes the pitch for each beat section and shapes the melody line. By such a shaping process, a neat melody line close to the actual melody line is output.

Furthermore, the melody probability estimation unit may be configured to generate a calculation formula for extracting the probability of each pitch being a melody note by supplying a plurality of audio signals whose melody lines are known and the melody lines to a calculation formula generation apparatus for generating a calculation formula for extracting feature quantity of an arbitrary audio signal, and to estimate for each frame the probability of each pitch being a melody note by using the calculation formula, the calculation formula generation apparatus automatically generating the calculation formula by using a plurality of audio signals and the feature quantity of each of the audio signals. As described, for example, a calculation formula generated by learning processing using an audio signal whose feature quantity is known is used for the estimation processing for the melody probability. By performing the learning processing by using a sufficient number of audio signals, the melody probability is estimated with high accuracy.

Furthermore, the above-described information processing apparatus may further include a beat detection unit for detecting each beat section of the audio signal, a chord probability detection unit for detecting, for each beat section detected by the beat detection unit, a probability of each chord being played, and a key detection unit for detecting a key of the audio signal by using the probability of each chord being played detected for each beat section by the chord probability detection unit. In this case, the melody line determination unit detects the maximum likelihood path based on the key detected by the key detection unit. In this manner, by performing the path search taking into account the key o the audio signal, the estimation accuracy for the melody line can be improved. Particularly, a frequency of detection error by the unit of semitone occurring due to the vibrato or the like can be reduced.

Furthermore, the above-described information processing apparatus may further include a signal conversion unit for converting an audio signal to a pitch signal indicating a signal intensity of each pitch, a bass probability estimation unit for estimating for each frame a probability of each pitch being a bass note, based on the audio signal, and a bass line determination unit for detecting a maximum likelihood path from among paths of pitches from a start frame to an end frame of the audio signal, and for determining the maximum likelihood path as a bass line, based on the probability of each pitch being a bass note, the probability being estimated for each frame by the bass probability estimation unit. In this manner, the above-described information processing apparatus can also estimate the bass line in a manner similar to the estimation processing for the melody line.

(Remarks)

The above-described log spectrum is an example of the pitch signal. The above-described log spectrum analysis unit 104 is an example of the signal conversion unit. The above-described Viterbi search is an example of a maximum likelihood path detection method. The above-described feature quantity calculation formula generation apparatus 10 is an example of the calculation formula generation apparatus.

It should be understood by those skilled in the art that various modifications, combinations, sub-combinations and alterations may occur depending on design requirements and other factors insofar as they are within the scope of the appended claims or the equivalents thereof.

In the explanation of the embodiment, a method for extracting a melody line of a music piece has been described. However, the technology of the present embodiment can also be applied to a method for extracting a bass line. For example, by changing the information relating to the melody line to be given as the learning data to the information relating to the bass line, a bass line can be extracted with high accuracy from music data while using a substantially same configuration.

The present application contains subject matter related to that disclosed in Japanese Priority Patent Application JP 2008-311566 filed in the Japan Patent Office on Dec. 5, 2008, the entire content of which is hereby incorporated by reference.

What is claimed is:

1. An information processing apparatus comprising:

a signal conversion unit for converting an audio signal to a pitch signal indicating a signal intensity of each pitch;

a melody probability estimation unit for estimating for each frame a probability of each pitch being a melody note, based on the audio signal; and a melody line determination unit for detecting a maximum likelihood path from among paths of pitches from a start frame to an end frame of the audio signal, and for determining the maximum likelihood path as a melody line, based on the probability of each pitch being a melody note, the probability being estimated for each frame by the melody probability estimation unit.

2. The information processing apparatus according to claim 1, further comprising:

a centre extraction unit for extracting, in a case the audio signal is a stereo signal, a centre signal from the stereo signal, wherein the signal conversion unit converts the centre signal extracted by the centre extraction unit to the pitch signal.

3. The information processing apparatus according to claim 1, further comprising:

a signal classification unit for classifying the audio signal into a specific category, wherein the melody probability estimation unit estimates the probability of each pitch being a melody note, based on a classification result of the signal classification unit, and the melody line determination unit detects the maximum likelihood path based on the classification result of the signal classification unit.

4. The information processing apparatus according to claim 3, further comprising:

a pitch distribution estimation unit for estimating for the pitch signal, for each of specific periods, a distribution of pitches which are melody notes, wherein the melody line determination unit detects the maximum likelihood path based on estimation results of the pitch distribution estimation unit.

5. The information processing apparatus according to claim 4, further comprising:

a smoothing unit for smoothing, for each beat section, a pitch of the melody line determined by the melody line determination unit.

6. The information processing apparatus according to claim 1, wherein the melody probability estimation unit generates a calculation formula for extracting the probability of each pitch being a melody note by supplying a plurality of audio signals whose melody lines are known and the melody lines to a calculation formula generation apparatus capable of automatically generating a calculation formula for extracting feature quantity of an arbitrary audio signal, and estimates for each frame the probability of each pitch being a melody note by using the calculation formula, the calculation formula generation apparatus automatically generating the calculation formula by using a plurality of audio signals and the feature quantity of each of the audio signals.

7. The information processing apparatus according to claim 5, further comprising:

a beat detection unit for detecting each beat section of the audio signal;

a chord probability detection unit for detecting, for each beat section detected by the beat detection unit, a probability of each chord being played; and a key detection unit for detecting a key of the audio signal by using the probability of each chord being played detected for each beat section by the chord probability detection unit, wherein the melody line determination unit detects the maximum likelihood path based on the key detected by the key detection unit.

8. An information processing apparatus comprising:

a signal conversion unit for converting an audio signal to a pitch signal indicating a signal intensity of each pitch;

a bass probability estimation unit for estimating for each frame a probability of each pitch being a bass note, based on the audio signal; and a bass line determination unit for detecting a maximum likelihood path from among paths of pitches from a start frame to an end frame of the audio signal, and for determining the maximum likelihood path as a bass line, based on the probability of each pitch being a bass note, the probability being estimated for each frame by the bass probability estimation unit.

9. A melody line extraction method, comprising the steps of:

converting an audio signal to a pitch signal indicating a signal intensity of each pitch;

estimating for each frame a probability of each pitch being a melody note, based on the audio signal; and detecting a maximum likelihood path from among paths of pitches from a start frame to an end frame of the audio signal, and determining the maximum likelihood path as a melody line, based on the probability of each pitch being a melody note, the probability being estimated for each frame by the step of estimating a probability of each pitch being a melody note, wherein the steps are performed by an information processing apparatus.

10. A bass line extraction method, comprising the steps of:

converting an audio signal to a pitch signal indicating a signal intensity of each pitch;

estimating for each frame a probability of each pitch being a bass note, based on the audio signal; and detecting a maximum likelihood path from among paths of pitches from a start frame to an end frame of the audio signal, and determining the maximum likelihood path as a bass line, based on the probability of each pitch being a bass note, the probability being estimated for each frame by the step of estimating a probability of each pitch being a bass note, wherein the steps are performed by an information processing apparatus.

11. A non-transitory computer-readable storage device storing a computer program, which when executed by a computer, performs a method comprising the steps of:

converting an audio signal to a pitch signal indicating a signal intensity of each pitch;

estimating for each frame a probability of each pitch being a melody note, based on the audio signal; and detecting a maximum likelihood path from among paths of pitches from a start frame to an end frame of the audio signal, and determining the maximum likelihood path as a melody line, based on the probability of each pitch being a melody note, the probability being estimated for each frame by the step of estimating a probability of each pitch being a melody note.

12. A non-transitory computer-readable storage device storing a computer program, which when executed by a computer, performs a method comprising the steps of:

converting an audio signal to a pitch signal indicating a signal intensity of each pitch;

estimating for each frame a probability of each pitch being a bass note, based on the audio signal; and detecting a maximum likelihood path from among paths of pitches from a start frame to an end frame of the audio signal, and determining the maximum likelihood path as a bass line, based on the probability of each pitch being a bass note, the probability being estimated for each frame by the step of estimating a probability of each pitch being a bass note.

* * * * *